US009227758B2

(12) United States Patent
Maiworm et al.

(10) Patent No.: US 9,227,758 B2
(45) Date of Patent: Jan. 5, 2016

(54) AUXILIARY TRANSPORT UNIT AND METHOD FOR USE THEREOF

(75) Inventors: Frank Maiworm, Neuenrade (DE); Glenn van Doorn, Wintelre (NL); Frans Verstappen, Milheeze (NL); Peter den Besten, Eindhoven (NL)

(73) Assignee: @Vance B.V., NG Geldrop (NL)

( * ) Notice: Subject to any disclaimer, the term of this patent is extended or adjusted under 35 U.S.C. 154(b) by 111 days.

(21) Appl. No.: 13/884,511

(22) PCT Filed: May 24, 2011

(86) PCT No.: PCT/EP2011/002577

§ 371 (c)(1),
(2), (4) Date: Jul. 16, 2013

(87) PCT Pub. No.: WO2012/062381

PCT Pub. Date: May 18, 2012

(65) Prior Publication Data

US 2013/0284687 A1 Oct. 31, 2013

(30) Foreign Application Priority Data

Nov. 12, 2010 (DE) ..... 10 2010 051 236
Jan. 5, 2011 (DE) ..... 10 2011 008 019

(51) Int. Cl.
*B65D 19/44* (2006.01)
*B65D 19/38* (2006.01)

(52) U.S. Cl.
CPC ..... *B65D 19/385* (2013.01); *B65D 2519/0097* (2013.01); *B65D 2519/00273* (2013.01);

(Continued)

(58) Field of Classification Search
CPC ..... B65D 2519/00; B65D 2519/00223; B65D 2519/0081
USPC ..... 108/53.1, 53.3, 53.5, 51.11, 55.1; 211/49.1; 206/386, 600; 248/346.02
See application file for complete search history.

(56) References Cited

U.S. PATENT DOCUMENTS 2,577,276 A * 12/1951 Saul, Jr. ..... 108/110
3,980,185 A * 9/1976 Cain ..... 206/509

(Continued)

FOREIGN PATENT DOCUMENTS

BE 1011601 11/1999
DE 1181633 11/1964

(Continued)

OTHER PUBLICATIONS

Office action from parallel application KR 069378644.

(Continued)

*Primary Examiner* — Jose V Chen
(74) *Attorney, Agent, or Firm* — Greer, Burns & Crain, Ltd.

(57) ABSTRACT

An auxiliary transport unit is provided in particular for pallets, wherein the pallets include a loading base which, during transport, is oriented substantially horizontally. The auxiliary transport unit has a supporting device which, during transport, extends substantially in the vertical direction. The auxiliary transport unit also includes a connecting device which connects the supporting device to at least one first, lower pallet. The auxiliary transport unit also has a holding device which is connected to the supporting device. The holding device is provided for holding at least one second pallet vertically spaced from the at least one first pallet.

11 Claims, 62 Drawing Sheets

(52) U.S. Cl.
CPC ..... *B65D2519/00293* (2013.01); *B65D 2519/00323* (2013.01); *B65D 2519/00333* (2013.01); *B65D 2519/00437* (2013.01); *B65D 2519/00676* (2013.01)

(56) References Cited

U.S. PATENT DOCUMENTS

| | | | | |
|---|---|---|---|---|
| 4,344,368 | A * | 8/1982 | Remington et al. | 108/57.15 |
| 4,703,702 | A | 11/1987 | Speicher | |
| 5,598,787 | A * | 2/1997 | Pronk | 108/51.3 |
| 5,806,701 | A * | 9/1998 | Bae | 220/1.5 |
| 5,918,551 | A * | 7/1999 | Liu | 108/55.1 |
| 6,463,863 | B1 * | 10/2002 | Ishikawa et al. | 108/53.1 |
| 6,925,943 | B2 * | 8/2005 | Salmanson et al. | 108/55.1 |
| 7,491,024 | B2 * | 2/2009 | Heinrichs et al. | 410/32 |
| 2003/0219323 | A1 | 11/2003 | Shoup | |
| 2004/0112260 | A1 * | 6/2004 | Grainger | 108/53.1 |
| 2005/0235885 | A1 | 10/2005 | Salmanson et al. | |
| 2009/0057191 | A1 * | 3/2009 | Temple et al. | 206/600 |
| 2010/0116178 | A1 * | 5/2010 | Harris | 108/53.3 |
| 2011/0303129 | A1 * | 12/2011 | Harris | 108/53.1 |

FOREIGN PATENT DOCUMENTS

| | | |
|---|---|---|
| EP | 0206410 | 12/1986 |
| FR | 2660910 | 10/1991 |
| GB | 2091209 | 7/1982 |
| GB | 2231552 | 11/1990 |
| JP | S49-127155 | 10/1974 |
| JP | 51-068155 | 5/1976 |
| JP | S58-187786 | 7/1985 |
| JP | S61-188370 | 6/1988 |
| JP | 0263333 | 3/1990 |
| WO | 0207570 | 1/2002 |

OTHER PUBLICATIONS

"Notice of Reasons for Rejection" from the Japanese Patent Office in Japanese Patent Application No. 2013-538081 dated Mar. 23, 2015.

* cited by examiner

Fig.20
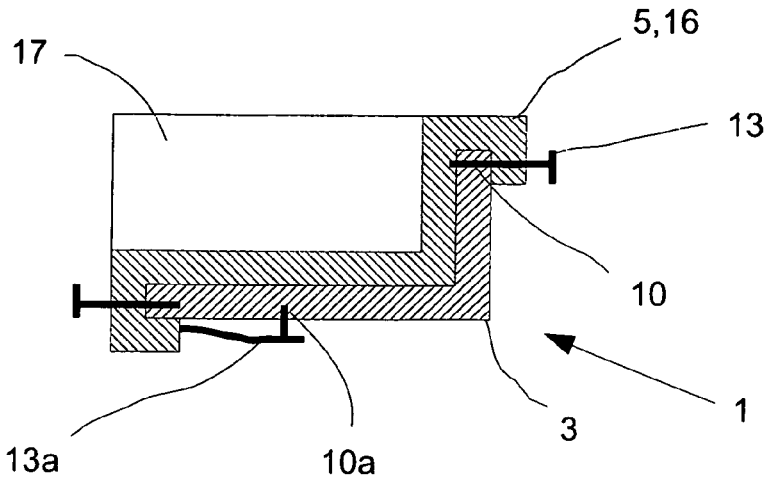
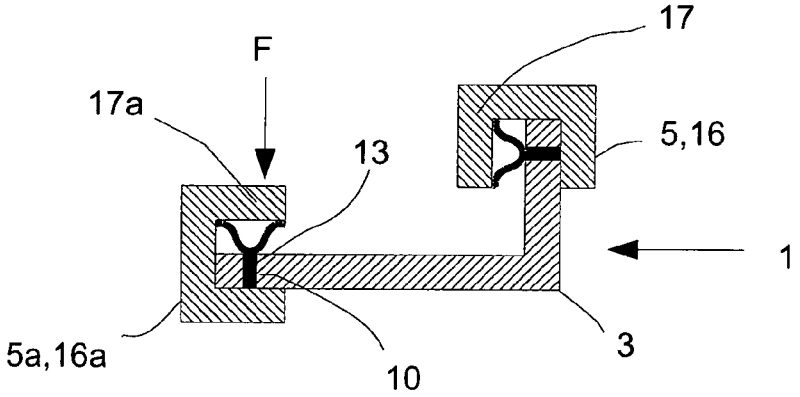
Fig.21
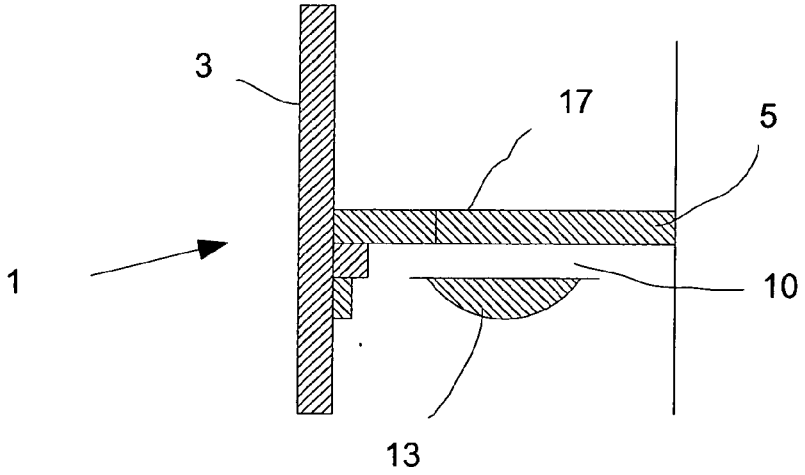
Fig.22

AUXILIARY TRANSPORT UNIT AND METHOD FOR USE THEREOF

BACKGROUND

The present invention relates to an auxiliary transport unit and a method for use thereof. The present invention in particular relates to an apparatus suited to improving the transport of objects transported on pallets and which are therefore hereinafter called palletized goods.

It is known and standard practice to transport objects on pallets which cannot be transported as bulk goods or piece goods or the like, e.g. on trucks, in containers or in ship and airplane cargo holds. In so doing, the cargo hold should be used as effectively as possible in view of the transport costs. In practice, however, the available cargo hold cannot always be used in the best possible way, and thus economically, when transporting palletized goods.

SUMMARY

The invention is based on the objective of providing an apparatus and a method for the more economical transport of palletized goods.

The invention solves the problem of inadequately utilizing space in the case of pallets which are only loaded to a relatively low height.

When such a pallet is set e.g. onto the floor of a truck body (normally also called the bed), the space above the pallet cannot be used further for transport. Doing so is then only possible when the objects on the pallet are exceptionally stable and thus shaped such that a second pallet can be placed directly on top of said objects. As a rule, however, this is not possible. The cargo capacity of the truck body can then only be used to an insufficient extent.

The present invention provides an auxiliary transport unit which enables remedying this problem. The auxiliary transport unit comprises a supporting device connectable to the lower pallet.

Another pallet can be placed on said supporting device and is held there at a distance from the first pallet by a retaining device. The supporting device holds the full weight exerted by the pallet so that the objects arranged on the lower pallet are not stressed by the weight of the upper pallet.

In the terms of the invention, a pallet is to be understood as a device which in particular holds objects described in the present invention as palletized goods. To do so, the pallet comprises at least one loading deck on which the palletized goods are placed for transport. The pallet preferably comprises at least one notch for so-called lifting means, particularly for a fork of a forklift, a lift truck, crane slings, conveyor jacks or high-bay warehouse load-bearing devices.

In accordance with one preferred embodiment, the pallet comprises at least two notches arranged at a predetermined angle to each other, particularly preferentially a 90° angle. In accordance with one preferred embodiment, the loading deck is of substantially rectangular configuration. Spacer blocks are preferably arranged at predetermined positions on the loading deck which in particular serve to distance the pallet's loading deck from the floor of a warehouse, a shelf or a cargo hold of a transport means. In accordance with one preferred embodiment, a respective spacer block is arranged at three, four or more positions underneath the loading deck to advantageously counter the unintentional toppling of the loading deck. It is particularly preferential for a respective in particular prismatic spacer block to be affixed under each corner of the particularly rectangular loading deck. In accordance with one preferred embodiment, two spacer blocks delimit one notch. In accordance with one preferred embodiment, a bottom deckboard extends parallel to the loading deck underneath a spacer block, particularly preferentially under a plurality of spacer blocks. The following will also refer to the pallet's loading decks, spacer blocks and deckboards as pallet bodies or bodies of the pallet.

In the terms of the invention, a supporting device is to be understood as a device which in particular holds at least one connecting device and one retaining device at a predefined distance from one another. The supporting device comprises at least one support spar having a first and second end which serves in particular to absorb a force, particularly a weight, acting substantially along its longitudinal axis during transport. In accordance with one preferred embodiment, the support spar absorbs a transverse force and/or a side load and/or a torque. In accordance with one preferred embodiment, a supporting device comprises two or more support spars, particularly four support spars, which are particularly preferentially connected to each other. In accordance with one preferred embodiment, the support spar comprises an inner surface which faces the first pallet during transport.

In accordance with one preferred embodiment, the structural elements of the inventive auxiliary transport unit exhibit a material from among a group comprising wood, plastic, metal, cardboard, steel, light metals, aluminum and aluminum alloys. In accordance with one preferred embodiment, one structural element comprises fiber-reinforced plastic. Conceivable fibers are preferably those of glass, carbon, mineral fibers and wood fibers. In accordance with one preferred embodiment, the structural element comprises a structure of cavities, particularly preferentially hardened foam and/or honeycomb. In accordance with one preferred embodiment, a hardened foam and/or honeycomb structure is provided with at least one cover, particularly preferentially a thin-walled plate. It is particularly preferential for the structural element to be configured as a so-called sandwich panel in which both sides of a foam layer or honeycomb layer extending substantially in one plane are connected, particularly materially bonded, to a respective cover plate.

In accordance with one preferred embodiment, the support spar comprises a transverse section, the resisting torque of which is at a predetermined ratio to two bending axes arranged at right angles to each other. Doing so counters uneven biaxial bending when a force transverse to the longitudinal axis and/or a side load subjects the support spar to load. The stability of the auxiliary transport unit designed in such manner is thereby advantageously improved. The ratio of the resisting torque is preferably between 2 and 0.5, further preferably between 1.5 and 0.75, further preferably between 1.1 and 0.9. In accordance with one preferred embodiment, the at least one support spar exhibits a rectangular, circular, elliptical or trapezoidal cross section. In accordance with one preferred embodiment, the support spar is configured as a tube, flat bar, profiled rod, I-beam, T-beam or L-beam. In accordance with one preferred embodiment, one wall of a support spar exhibits recesses, particularly to save weight.

In accordance with one preferred embodiment, a support spar comprises a base plate preferably connected to the first end of said support spar. Integrally forming the base plate with the support spar is particularly preferential. In accordance with one preferred embodiment, the base plate is arranged on the loading deck of the first pallet during transport. In accordance with another preferred embodiment, the base plate is arranged underneath a spacer block of the first pallet during transport. In accordance with one preferred embodiment, the base plate extends underneath and horizontally along a defining edge of the loading deck during transport.

The support spar preferably comprises at least one first connecting element. Same serves particularly in the connection to a retaining device, preferably to a second connecting element of the retaining device. A first connecting element is advantageously designed in particular as a recess, projection, bore, window, pocket, lug, notch, pawl, cam, worm, frictional surface, groove, spring, tongue, hook, eye, clamp, bolt or pin. In accordance with one preferred embodiment, the supporting device comprises two or more first connecting elements. In accordance with one preferred embodiment, the supporting device, in particular its support spar, comprises a plurality of first connecting elements which are disposed substantially vertically one above the other during transport.

In the terms of the invention, a connecting device is to be understood as a device which connects in particular a supporting device of the auxiliary transport unit to a first pallet. In particular, the connecting device transfers a force and/or a torque between the supporting device and the first pallet during transport, preferably by means of positive and/or frictional connection. The connecting device advantageously creates a flow of force between the second pallet and a lifting means. The connecting device advantageously transfers the weight from the second pallet to a lifting means which is at the same time subjected to the weight of the first pallet, for instance when transporting a unit comprised of a first and second pallet.

The connecting device preferably comprises a plurality of connecting means. Each support spar is preferably allocated its own connecting means. In accordance with one preferred embodiment, particularly one connecting means is in particular materially bonded to one support spar, particularly preferentially formed integrally. In accordance with one preferred embodiment, the connecting means connects the support spar to a spacer block and/or the loading deck of the first pallet. In accordance with a further preferred embodiment, the connecting means is supported on a bottom deckboard of the pallet which extends parallel to the loading deck underneath a spacer block of the pallet and/or its loading deck. In so doing, the connecting means in particular transfers particularly perpendicular force from the second pallet to a bottom deckboard and/or the loading deck of the first pallet, particularly during transport.

In accordance with one preferred embodiment, the connecting means is designed as a projection, particularly preferentially together with a recess in the support spar. In accordance with one preferred embodiment, the projection extends into the body of the first pallet, particularly preferentially into its loading deck and/or one of its spacer blocks. Said projection with in particular a prismatic round cross section preferably extends parallel to the plane of the loading deck.

In accordance with one preferred embodiment, upon a support spar being fixed to a first pallet, the projection enters into its loading deck and/or one of its spacer blocks. It is particularly preferential for the projection to be configured as a peg or a pin and to be arranged through or on an inner surface of a support spar facing the first pallet and/or its bottom deckboard. When a support spar is fixed to a first pallet, such a projection is advantageously countersunk by means of an impact, for example being struck into a spacer block and/or the loading deck by a hammer. Provided the projection is fixed to the base plate of a support spar, the dead weight of the first pallet also advantageously supports the counter-sinking of the projection into a bottom deckboard, spacer block and/or into the loading deck.

In accordance with a further preferred embodiment, a support spar exhibits a recess, particularly a bore, through which a connecting means designed as a projection extends into a spacer block and/or loading deck of a first pallet. Given the corresponding design, a connecting means designed as a projection is not countersunk through a recess of said support spar into a spacer block and/or the loading deck of the first pallet until the support spar is fixed to said first pallet. In accordance with one preferred embodiment, the projection is designed as a cramp. In accordance with one preferred embodiment, when a support spar is fixed to a first pallet, the projection is conveyed by a conveyor device and connected to a bottom deckboard, spacer block and/or the pallet loading deck by a powered hand tool.

In accordance with a further preferred embodiment, a connecting means is designed as a clamp. Same is particularly provided to engage, particularly in form-fit or force-fit manner, around a spacer block, a bottom deckboard and/or the loading deck of the first pallet. The clamp exhibits at least one boundary surface facing the first pallet and is preferably aligned substantially parallel to an inner surface of a support spar. In accordance with one preferred embodiment, the connecting means designed as a clamp is integrally connected to the support spar. At least a part of the clamp is preferably supported on the first pallet such that said part of the clamp introduces a force and/or a torque from the second pallet into the first pallet. To this end, said part of the clamp in particular positively bears on the loading deck and/or a bottom deckboard of the first pallet. In accordance with one preferred embodiment, the clamp comprises at least one rigid and one movable part. It is particularly preferential for the movable part to be spring-loaded or configured as a spring. The rigid and/or movable part of the clamp preferably exhibits a boundary surface disposed substantially parallel to an inner surface of a support spar. In accordance with one preferred embodiment, the movable part comprises a second insertion aid which is particularly preferentially configured as an inclined surface. Said inclined surface advantageously facilitates the opening of the clamp as it approaches a spacer block, a deckboard and/or the loading deck of the first pallet by withdrawing the movable part of the clamp from its immovable part; the clamp thereby being pretensioned. In accordance with one preferred embodiment, the movable part of the clamp exhibits a pawl which engages around a spacer block and/or part of the loading deck when the clamp is affixed. It is particularly preferential for the movable part of the clamp, the pawl and second insertion aid to be integrally formed. In accordance with a further preferred embodiment, one connecting device comprises both a projection as well as a clamp.

In accordance with a further preferred embodiment, a connecting means is configured particularly as a plate-shaped or prismatic force-transmitting element. The force-transmitting element comprises at least one first and one second boundary surface or defining edge which extends substantially parallel to the loading deck of a first pallet. In accordance with one preferred embodiment, the two boundary surfaces or defining edges are arranged underneath the loading deck. In accordance with one preferred embodiment, the force-transmitting element is supported on a bottom deckboard of the pallet and/or its loading deck, particularly preferentially by at least one of the boundary surfaces or defining edges. In so doing, the force-transmitting element particularly advantageously transfers an in particular perpendicular force from the second pallet to a bottom deckboard or the loading deck of the first pallet during transport. In accordance with one preferred embodiment, the force-transmitting element is formed integrally with a support spar.

In accordance with a further preferred embodiment, the connecting means is designed to engage around a spacer block of the first pallet or its loading deck. In accordance with one preferred embodiment, the connecting means only engages partly around a particularly prismatic spacer block during transport. It is particularly preferable for one of the boundary surfaces of the in particular prismatic spacer block and the auxiliary transport unit connected to the first pallet to remain exposed during transport. Doing so thus advantageously allows the connecting of the first pallet and the support spar, even if the loading deck is completely covered by goods. In accordance with one preferred embodiment, the connecting means to engage around the base plate of the support spar is connected to, particularly preferentially integrally formed with, said base plate. In accordance with a further preferred embodiment, the connecting means for engaging is combined with the force-transmitting element and/or projection.

In the terms of the invention, a retaining device is to be understood as a device which in particular serves in supporting a second pallet. The retaining device thereby intermittently receives particularly a weight from the second pallet and routes said weight to the supporting device. The retaining device advantageously absorbs transverse forces from the weight of the second pallet at least intermittently and transmits them to the supporting device. The retaining device is connected to the supporting device during transport. During transport, the retaining device exhibits a predetermined distance from the first end of the supporting device or connecting device respectively. In accordance with one preferred embodiment, the auxiliary transport unit comprises two or more retaining devices. It is particularly preferred for a plurality of retaining devices to be arranged one above the other during transport.

The retaining device comprises one or more support bodies, preferably one support body per support spar. During transport, the support body supports a part of in particular a spacer block and/or a bottom deckboard of the second pallet. The support body exhibits a support surface aligned substantially horizontal at least during transport. In accordance with one preferred embodiment, the support body exhibits recesses serving to reduce weight.

In accordance with one preferred embodiment, a support body is materially bonded to the support spar, particularly preferentially integrally formed with the support spar. In accordance with one preferred embodiment, said support body is configured with an L-shaped cross section.

In accordance with a further preferred embodiment, a support body is designed as a retaining collar which in particular engages at least partially around the support spar. The retaining collar exhibits at least one support surface aligned substantially horizontal at least during transport. In accordance with one preferred embodiment, the retaining collar engages around the support spar such that the retaining collar forms a guide for a displaceable support spar therein, comparable to a carriage guide of a machine tool. In this preferred embodiment, the retaining collar comprises at least one second connecting element. Same particularly serves in the releasable connection to particularly a first connecting element of the support spar. The second connecting element is configured as a counterpart to a first connecting element, particularly preferentially as a recess, projection, bore, window, pocket, lug, notch, pawl, cam, worm, frictional surface, groove, spring, tongue, hook, eye, clamp, bolt or pin.

In accordance with a further preferred embodiment, the support body is designed as a carrier. Said carrier exhibits at least one support surface aligned substantially horizontal at least during transport. The carrier is releasably connected in particular to an inner surface of the support spar during transport. The carrier comprises at least one first and one second boundary surface substantially perpendicular to the former. The first boundary surface serves as a support surface for supporting the second pallet. The second boundary surface comprises the at least one second connecting element corresponding to the above-preferred embodiment and in particular abuts the inner surface of the support spar. The present preferred embodiment of the retaining means can be advantageously manufactured economically, in particular as a pressed part.

In accordance with one preferred embodiment, the carrier exhibits an L-shaped cross section with a first and second limb. The first limb of the L-shaped cross section, particularly horizontal during transport, forms the support surface. The second limb of the L-shaped cross section, particularly vertical during transport, comprises the at least one second connecting element corresponding to the above-preferred embodiment and abuts the inner surface of the support spar. The present preferred embodiment can be of advantageously economical and lightweight manufacture, in particular as a pressed part.

In accordance with a further preferred embodiment, the carrier extends in an L-shape along various inner surfaces of the L-shaped support spar. Said L-shaped carrier advantageously reinforces the support spar. In accordance with one preferred embodiment, the L-shaped carrier exhibits an L-shaped cross section as described above. The present preferred embodiment of the retaining means can be advantageously manufactured so as to be lightweight, in particular as a pressed part.

In accordance with one preferred embodiment, the support spar exhibits one or more markings. The marking is disposed at a predefined distance from the first end of the support spar. The marking advantageously serves to indicate a predetermined height for the retaining device or its retaining means respectively during transport, provided same is affixed according to the marking. In accordance with one preferred embodiment, the support spar exhibits a plurality of in particular colored markings. In accordance with one preferred embodiment, these multiple particularly differently colored markings are arranged substantially one above the other along the substantially perpendicular longitudinal axis of the support spar during transport. Marking advantageously facilitates adjusting the height of the retaining means when a plurality of support spars are used at the same time with the same pallet, particularly for the tip-resistant, horizontal supporting of the second pallet. In accordance with a further preferred embodiment, said multiple particularly colored markings are disposed at the same predetermined distance to the first end of the support spar. The ability to recognize a marking from different lines of sight is advantageously improved.

In accordance with one preferred embodiment, the auxiliary transport unit is allocated an auxiliary lifting device. In the terms of the invention, an auxiliary lifting device refers to a device particularly for supporting weight from the second pallet on lifting means. The auxiliary lifting device is thereby designed in particular as a metallic or fiber-reinforced profiled rod which extends through one or more notches underneath the loading deck. The auxiliary lifting device is thereby in particular arranged underneath the connecting means of a support spar during transport, preferably underneath the connecting means of two support spars. The connecting device is thereby designed as a force-transmitting element and/or a clamp. When a lifting means is introduced into a notch of the first pallet and no connecting means is disposed in said notch, the lifting means then comes to rest underneath the auxiliary lifting device. A force from a second pallet is thus advantageously supported on the lifting means by way of retaining means, support spars, connecting means particularly designed as a force-transmitting element, and the auxiliary lifting device. A bottom deckboard of the first pallet is thereby advantageously not subjected to load by the weight from a second pallet.

In accordance with one preferred embodiment, the auxiliary transport unit is allocated a bearing aid. In the terms of the invention, a bearing aid is to be understood as a device which is in particular supported on one or more support bodies during transport and subject to the load of the weight from the second pallet. In accordance with one preferred embodiment, the bearing aid is supported by a plurality of support bodies of different support spars during transport, wherein the various support spars are connected to the same first pallet. A second pallet of smaller size than the first pallet can be advantageously placed on the bearing aid. Advantageously, two second pallets with respective loading decks only half as large as the loading deck of the first pallet can be placed on the bearing aid together. In accordance with one preferred embodiment, the bearing aid comprises at least one third connecting element, in particular a bore or a projection for connecting to a support body. The support body thereby comprises at least one complementary fourth connecting element. In accordance with one preferred embodiment, the bearing aid exhibits at least one recess, particularly for saving weight. It is particularly preferred for the bearing aid to be designed essentially as a frame.

One preferred embodiment of the auxiliary transport unit according to the invention comprises at least one, preferably four, particularly fiber-reinforced support spars having an L-shaped cross section with a first and second limb. The support spars extend along a vertical during transport. At least one, preferably both limbs exhibit a number of bores (first connecting elements). Said bores are arranged in a support spar one above the other and parallel to its longitudinal axis. Each bore of the first and second limb advantageously exhibits the same predefined spacing from the first end of the support spar. In accordance with one preferred embodiment, the fiber-reinforced support spar comprises a metallic insert, particularly preferably a profiled steel sheet or at least a metal rod. The load-bearing capacity of the support spar is thus advantageously increased.

The connecting means of this embodiment are essentially designed as plate-shaped force-transmitting elements.

The force-transmitting elements are connected to a limb of a respective support spar, preferentially formed integrally. During transport, the plate-shaped force-transmitting elements are disposed between the first pallet's bottom deckboard and loading deck. When the first pallet is hoisted, the force-transmitting elements each come into contact with a bottom deckboard of said pallet. In particular, the support spar and force-transmitting element advantageously route the weight of the second pallet to the bottom deckboard of the first pallet. In accordance with one preferred embodiment, the plate-shaped force-transmitting element comprises a second limb which extends in particular at a right angle to the first limb and substantially parallel to the loading deck of the pallet within one of its notches. When a lifting means is guided into said notch and the first pallet is lifted by said lifting means, the lifting means simultaneously lift the force-transmitting element. The bottom deckboard of the first pallet is thereby advantageously free of load from the second pallet.

A retaining collar of fiber-reinforced plastic is slid onto the support spar. The transfer of force from the retaining collar to the support spar ensues by means of pins or screws (second connecting element) which extend through bores in the support spar during transport. In accordance with one preferred embodiment, the pins are of spring-loaded and displaceable configuration within the retaining collar. The retaining collar comprises a plate as the support surface for the second pallet. The plate is advantageously supported relative the retaining collar by means of a strut. The in particular spring-loaded strut is preferably displaceable relative the supporting element and comprises a second connecting element which is urged by the spring to engage with the support spar.

As a variation of the above-cited preferred embodiment of the inventive auxiliary transport unit, the limbs of the support spar are articulated to one another. The articulated connection of the limbs in particular serves in facilitating the connection of the inventive auxiliary transport unit to a pallet without notches in the bearer means underneath the loading deck as is common in the USA. In all other respects, this preferred embodiment corresponds to the aforementioned preferred embodiment.

In accordance with a further preferred embodiment of the inventive auxiliary transport unit, the support spar is designed as a metal profile, particularly from steel sheet. In accordance with one preferred embodiment, the metal profile is edged or deep-drawn and comprises two profile elements angled to one another. Both profile elements exhibit a plurality of particularly punched recesses (first connecting element) which extend along the longitudinal axis of the metal profile in at least two rows. A force-transmitting element as connecting means is in particular materially bonded to the metal profile. The force-transmitting element extends into a notch of the first pallet during transport and is preferably designed in correspondence to the force-transmitting element of the previously described preferred embodiment. In accordance with one preferred embodiment, the metal profile comprises a pin as an additional connecting means, said pin being driven in particular into one of the spacer blocks of the first pallet during the connection of the auxiliary transport unit and said first pallet. The support bodies of the present preferred embodiment are configured as L-shaped carriers. Prior to the second pallet loading the retaining device, the second connecting elements of a carrier are inserted into the recesses of the metal profile. The carrier advantageously effects a reinforcing of the metal profile. In accordance with one preferred embodiment, the second connecting elements of the carrier are designed as tongues, clips or hooks which point substantially downward, or in the direction of the first pallet respectively, during transport. The weight of the positioned second pallet advantageously counters the separation of the carrier and the metal profile.

In accordance with one preferred embodiment, the retaining device is detachably fixed to the support spar. It is particularly preferential for the retaining device to be fixed to the support spar by means of a plug-and-socket connection.

In accordance with a further preferred embodiment, the support spar and support body are in particular materially bonded together. The support spar is thereby manufactured at a predetermined length. The distance between the support body and connecting device is likewise predefined. In accordance with one preferred embodiment, doing so particularly serves in realizing bearing capacity, economical manufacture and/or specific longevity even given heavy use.

Provided two to four support spars of the inventive auxiliary transport unit are connected to a first pallet, introducing a second pallet can cause difficulties due to the fitting precision of the auxiliary transport unit. For economic reasons, however, the daily routine in the transport industry dictates that goods to be transported need to be handled quickly. Hence, the inventive auxiliary transport unit is also to enable quick handling.

In accordance with one first preferred embodiment, an inventive supporting device is advantageously equipped with at least one insertion aid which in particular serves to facilitate the inserting of a second pallet into a number of support spars arranged around a first pallet. The insertion aid is at least intermittently connected to at least one support spar, in particular seated thereon. The insertion aid exhibits at least one, preferably two inclined surfaces. The inclined surfaces exhibit a predefined angle relative to the vertical during transport. In accordance with one preferred embodiment, the angle of the inclined surface relative the vertical amounts to between 0° and 90°, preferably between 10° and 80°, further preferentially between 20° and 70°, further preferentially between 30° and 60°, particularly preferentially between 40° and 50°. The inclined surface advantageously acts by urging the second pallet toward the inner surface of the support spar analogously to a funnel. At least two insertion aids are preferably connected together during insertion, particularly by way of stabilizing means. It is particularly preferential for the stabilizing means to be configured as a belt, bar, strap, spring or cable and to extend between two support spars substantially parallel to the loading deck. Two insertion aids connected to the support spars and to the stabilizing means advantageously act to counter unwanted displacing of the support spars. When four support spars are connected to a first pallet and each support spar has an insertion aid, the insertion aids are then preferably connected to only three stabilizers along three edges of the first pallet's loading deck, forming an incomplete square. The fourth edge of the first pallet remains free. Lowering of the second pallet is advantageously enabled by the absent connecting bar along the fourth, free edge not hindering the lowering of the lifting means.

In accordance with a further preferred embodiment of the insertion aid, the second end of a support spar exhibits at least one inclined surface as described in the aforementioned embodiment. The inclined surface advantageously acts by urging the second pallet toward the inner surface of the support spar analogously to a funnel. In accordance with one preferred embodiment, each of a plurality of support spars exhibit respective inner surfaces of an inclined surface about the first pallet. It is particularly preferable for an L-shaped support spar with two inner surfaces to have a respective inner surface of inclined surface.

In accordance with a further preferred embodiment, a plurality of support spars connected to a first pallet exhibit predefined and different lengths and/or heights. One, preferably two, support spars project above the others. The longer support spars advantageously act as limit stops against which the second pallet is moved substantially horizontally before being stopped by a support body. In accordance with one preferred embodiment, at least two support spars are thereby connected together, particularly preferentially braced by means of a tensioning device, so as to counter relative motion of a support spar vis-à-vis the first pallet.

In accordance with a further preferred embodiment, a controlled relative motion of at least one support spar with respect to the first pallet is intermittently enabled. The upper region of one or a plurality of support spars thereby displaces substantially horizontally outward; i.e. the upper region of at least one support spar is distanced from the first pallet. After the second pallet is introduced, the support spar reassumes its original position relative to the first pallet. To this end, the connecting means is in particular configured as a peg or screw and allows a limited horizontal displacement and/or rotational motion of the support spar relative the first pallet.

In accordance with a further preferred embodiment, the connecting means is configured as a clamp of at least two parts, particularly preferentially with a distanced boundary surface. The movable part of the clamp advantageously yields to a limited extent upon applied support spar force and allows a limited tilting or displacing of said support spar.

In accordance with a further preferred embodiment, the connecting means are configured as force-transmitting elements. During transport and upon connection of the support spar and first pallet, the force-transmitting element with boundary surface is arranged underneath the pallet's loading deck and adjacent to one of its spacer blocks. The force-transmitting element is connected to a first limb of the L-shaped support spar. The boundary surface of the force-transmitting element is at a predefined distance from the second limb of the same support spar.

The boundary surface of the force-transmitting element also exhibits a predefined distance to a spacer block, first pallet bottom deckboard and/or its loading deck after a support spar has been fixed on said first pallet. In accordance with one preferred embodiment, the predefined allowance amounts to between 1 and 20 mm, particularly preferentially between 5 and 15 mm. In accordance with one preferred embodiment, the factor amounts to between 1.02 and 1.1. In accordance with one preferred embodiment, the lower boundary surface of the force-transmitting element is supported on a bottom deckboard of the first pallet. In accordance with one preferred embodiment, the upper boundary surface of the force-transmitting element exhibits an angle relative to the loading deck of between 1° and 15°, further preferably between 2° and 10°, particularly preferably between 3° and 5°.

According to one preferred embodiment, at least one support spar comprises a hinge mechanism having a first and second limb. This special hinge mechanism joins a support body and its second connecting element. The first limb of the hinge mechanism forms an inclined surface as described above and is articulated to the second end of the support spar. As described above, the first limb is tensioned by a spring vis-à-vis the inner surface of the support spar so as to assume a predetermined angle. As a consequence of its pitch, the hinge mechanism advantageously acts on the second pallet to be introduced similar to a funnel and pushes the second pallet between two support spars as it's being introduced. The hinge mechanism is vertically aligned during insertion and the second pallet is set on the integrally formed support body.

In accordance with a further preferred embodiment, the auxiliary transport unit comprises an in particular prismatic insertion block. Said insertion block particularly counters unwanted support spar displacement during transport. The insertion block is thereby inserted into a recess of the support spar during transport. Said recess is arranged in the area of a first pallet notch. Its presence results in the Insertion block filling a gap between the connecting means, support spar respectively, and the first pallet at a predefined distance. The inserted Insertion block thus form-fits flush with both the support spar, connecting means respectively, and the first pallet. The Insertion block is preferably wedge-shaped and/or made from a flexible material.

When a pallet is damaged or cannot be professionally repaired, individual parts of the pallet, particularly the dimensions of the loading deck, spacer blocks and/or bottom deckboard can deviate from the nominal dimensions. The auxiliary transport unit is to take such circumstances into account.

In accordance with one preferred embodiment, the individual dimensions of the connecting device and/or supporting device of the auxiliary transport unit are designed at a predetermined oversize with respect to the selected nominal dimensions of the first pallet. The predetermined oversize is particularly in terms of the nominal dimension for a pallet's loading deck, bottom deckboard or spacer blocks. In accordance with one preferred embodiment, the predefined allowance, in particular for the width of the spacer block, amounts to between 1 and 20 mm, particularly preferably between 5 and 15 mm. In accordance with one preferred embodiment, the factor amounts to between 1.02 and 1.1. In accordance with one preferred embodiment, a support spar of the auxiliary transport unit exhibits an L-shaped cross section with a first and second limb. A force-transmitting element is connected to the first limb. A boundary surface of the force-transmitting element is aligned substantially parallel to the second limb of the support spar and distanced from said second limb by a predefined measure.

In accordance with a further preferred embodiment, further boundary surfaces of the force-transmitting element are aligned substantially parallel to the loading deck and/or a bottom deckboard. In accordance with one preferred embodiment, the predefined allowance to the nominal dimension of the first pallet notch in which the force-transmitting element extends during transport amounts to between 1 and 20 mm, particularly preferably between 5 and 15 mm. In accordance with one preferred embodiment, the factor amounts to between 1.02 and 1.1.

In accordance with one preferred embodiment, an insertion block fills the gaps between force-transmitting element and pallet body during transport. Said Insertion block is preferably wedge-shaped and/or made from a flexible material.

According to a further preferred embodiment, the connecting means is configured as a clamp and comprises a movable, in particular spring-loaded, element with integrally formed pawl. The spring-loaded element exhibits a substantially plate-shaped area adjacent the supporting device and an area with the pawl distanced from the supporting device. The clamp engages in particular around a spacer block of the first pallet at a distance between the movable element and the spacer block. The pawl thereby snaps around the spacer block and counters separation of the auxiliary transport unit and first pallet. Particularly when manually operating the movable element, particularly its plate-shaped area, the clamp opens up enough that the pawl can no longer interact with the spacer block and the support spar can be separated from the first pallet.

In accordance with a further preferred embodiment, the supporting device of the auxiliary transport unit can comprise two support spars, preferably four support spars, and at least one support spar connecting device, preferably two support spar connecting devices, wherein the support spar is designed to connect to the support spar connecting device. One advantage of this design is in increasing stability in terms of slippage when taking curves.

It has proven advantageous with the present auxiliary transport unit for the support spars to comprise a connecting part receiving element to receive a connecting part of the support spar connecting device. In particular, the connecting part receiving element of the support spar can be designed as an eye and the connecting part of the support spar connecting device as a hook. One advantage of this design lies in enabling quick connection.

It has further proven advantageous with the present auxiliary transport unit for the support spar connecting device to be configured as a crossbar with two connecting parts.

In accordance with a further preferred embodiment, the support spar connecting device can comprise at least one loading surface connecting element on the underside to connect to a loading surface. The loading surface connecting element can further be configured as a projection, preferably as a pin for being received in notches of the loading surface, in particular for form-fit and/or force-fit receiving in notches of the loading surface. Alternatively and/or additionally, the loading surface connecting element can comprise a rubber element for the force-fit connection to the loading surface. One advantage of this design lies in increasing the connection's stability.

In accordance with a further embodiment of the auxiliary transport unit, the support spar connecting device is designed as a strut, preferably as a substantially plate-shaped strut which extends substantially horizontal during transport. It has proven advantageous with the present auxiliary transport unit for the strut to comprise at least one longitudinal notch on the underside and/or at least one longitudinal opening. In the present auxiliary transport unit, the longitudinal notch and/or longitudinal opening can in particular be designed and disposed such that a lifting means can be introduced. Arranging the upper edge of the longitudinal notch and/or longitudinal opening in the region of a lower pallet loading deck has proven particularly advantageous. The upper edge of the longitudinal notch can furthermore exhibit a chamfer designed and disposed such that the lifting means which is introduced into the longitudinal opening or longitudinal notch raises the strut such that the strut's connecting part does not separate from the support spar's connecting part receiving element. Alternatively and/or additionally, a lower edge of the longitudinal opening can exhibit a chamfer designed and disposed such that the lifting means which is introduced into the longitudinal opening raises the strut such that the strut's connecting part does not separate from the support spar's connecting part receiving element.

In accordance with a further embodiment of the auxiliary transport unit, the support spar connecting device can be designed as a support crosspiece. The support crosspiece can preferentially be connected to the support spars by means of fasteners, particularly by means of screws and/or hooks. It is particularly preferential for the support crosspiece to comprise at least one telescopic boom.

Utilizing an auxiliary transport unit according to the invention will be described using the example of a Euro pallet without limiting the use of the auxiliary transport unit to such pallets.

A first pallet, particularly rectangular, is initially provided. The support spars of the auxiliary transport unit are thereafter connected to the corners of the first pallet. Depending upon the embodiment of the connection means, the connection is made by the force-transmitting elements being introduced into the notches of the first pallet, clamps engaging around spacer blocks, and/or projections being urged into the body of the first pallet. The support bodies are arranged at the same height relative the first pallet's loading deck and secured against unwanted displacement. If necessary, the height of the support bodies can be adjusted prior to connecting the support spars to the first pallet. In one preferential embodiment, insertion aids are placed onto the support spars. A second pallet is hoisted by a lifting means and positioned over the first pallet. In one preferential embodiment, the second pallet is thereby moved against at least one of the support spars projecting out beyond the other support spars and acting as a stop. The second pallet is lowered onto the support bodies between the support spars of the auxiliary transport unit. The lifting means is removed. According to a further design, the auxiliary transport unit can comprise additional support bodies which are designed and disposed so as to support additional pallets during transport. In particular, the support spar can comprise a number of support body connecting part receiving elements and the support bodies can comprise support body connecting parts in order to be able to fix the support bodies to the support spar at variable heights.

In one specific design of the support spars, same are secured with insertion blocks and/or braced against one another by tensioning means, in particular a cord, band, belt, spring or bar. Bracing and the use of insertion blocks advantageously counters unwanted relative motion of the pallets and the associated support spars.

In one specific design, two auxiliary lifting devices are introduced into notches of the first pallet and secured, wherein connection means, in particular force-transmitting elements, are arranged in the notches.

In a further design, a support spar connecting device is provided which can in particular be designed as a substantially plate-shaped strut able to connect the two support spars during transport, particularly in the region of the support spars' lower ends.

The auxiliary transport unit can further comprise a supporting part having at least one connecting part, wherein the support spar comprises at least one receiving element designed and disposed to receive the connecting part. The supporting part can in particular exhibit an odd number of connecting parts, preferably three or five connecting parts. One advantage of this design is being able to increase the stability. The connecting parts can be configured as pins or screws.

According to a further embodiment of the auxiliary transport unit, the connecting device can comprise at least one preferably rod-shaped horizontal support surface. In conjunction hereto, it has proven advantageous for the connecting device to comprise two preferably rod-shaped horizontal support surfaces. Particularly preferential is for the connecting device to exhibit an arched horizontal support surface which is preferably designed and disposed so as to connect two ends of the two horizontal support surfaces. One advantage of this design lies in being able to better prevent possible stress to the support spars when pallets are being pushed in.

The support spar connecting device in the auxiliary transport unit can furthermore comprise a respective end region on both ends adapted to bear against the inner sides of the support spars, wherein the end region is preferably of rectangular configuration, whereby the stability of the support spar connection can be increased.

Each end region can furthermore comprise a respective first connecting part preferably arranged on the outward facing end face of the end region and a second connecting part preferably arranged parallel to the longitudinal direction of the support spar connecting device and the support spars can comprise at least one first connecting part receiving element to receive the first connecting part and at least one second connecting part receiving element to receive the second connecting part, whereby the stability of the support spar connection can be improved.

Moreover, the first connecting part receiving element can be designed as a first notch in the support spar, the second connecting part receiving element as a second notch in the support spar, the first connecting part as a first dimensionally stable slat to advance through the first notch, and the second connecting part as a second dimensionally stable slat to advance through the second notch. In conjunction hereto, it has proven advantageous for the second dimensionally stable slat to exhibit a kink or a bend in an area distanced from the support spar connecting device.

The support spar can furthermore comprise a base plate designed and disposed to receive the pallet, whereby load can be better distributed throughout the pallet.

Alternatively and/or additionally, the support spar can comprise a stand support, preferably on the support spar's external base periphery, whereby concentrated pallet load on the edges of the support spars can be prevented.

Flaring out, preferably outward curving, at least one of the side walls of the support spar, preferably both side walls of the support spar, at the walls' upper edge region has proven particularly advantageous in the auxiliary transport unit. One advantage of this design is being able to facilitate pallet positioning onto the stack.

In one preferred embodiment, the support spar comprises a pallet receiving element designed to insert the pallets, whereby stability can be increased.

The dimensions of the support spars are preferentially adapted to the dimensions of a Euro pallet or the dimensions of a US pallet.

BRIEF DESCRIPTION OF THE DRAWINGS

Further advantages, features and possible applications of the present invention will follow from the following description in conjunction with the figures. Shown are.

DETAILED DESCRIPTION

Figure 1:
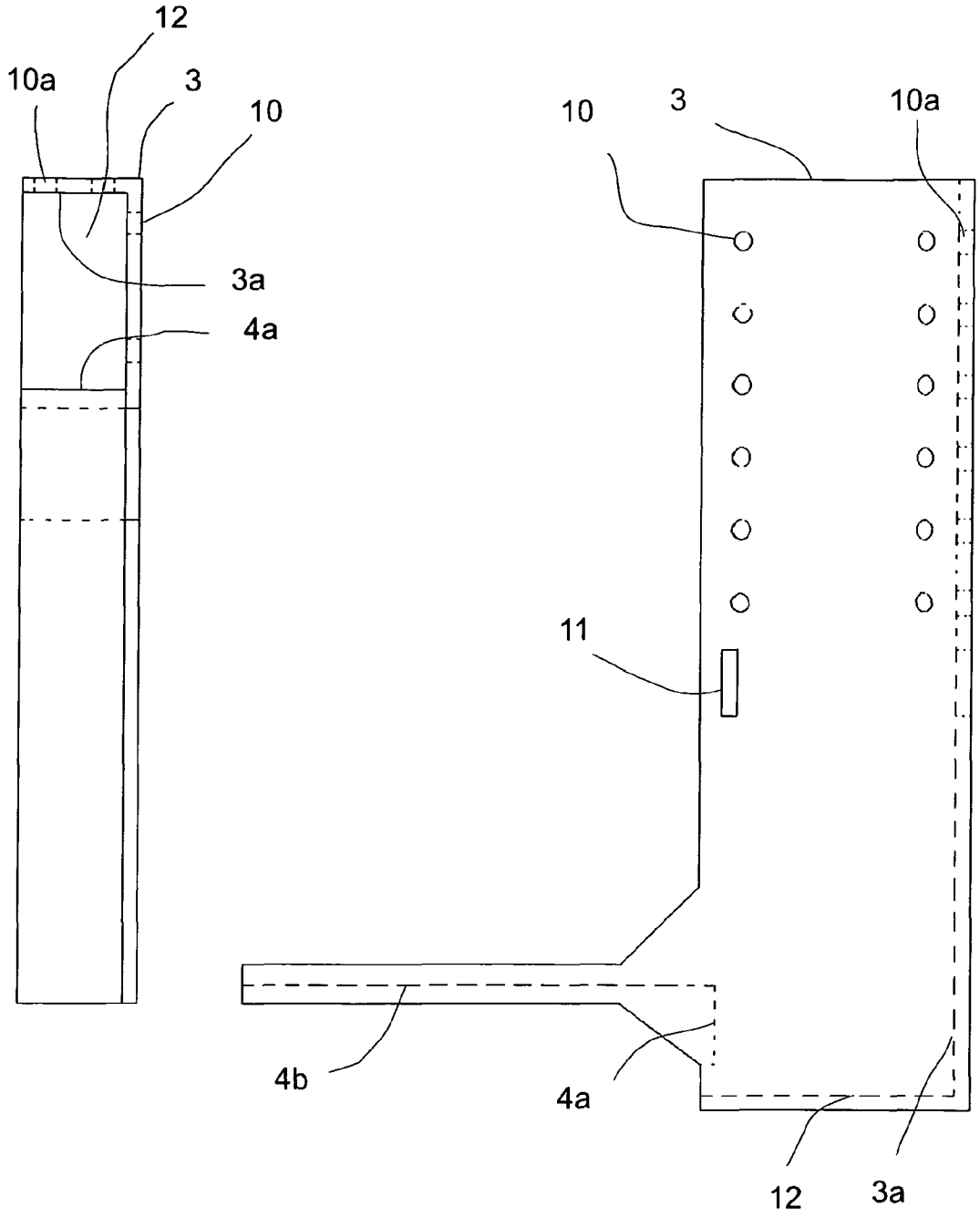
FIG. 1 a top view and a front view of a support spar.

FIG. 1 shows a support spar 3 with integrally formed connecting means 4, configured here as a force-transmitting element. The support spar 3 in accordance with the first preferred embodiment is manufactured from a fiber-reinforced plastic. The cross section of the support spar 3 is of L-shape configuration. The force-transmitting element 4 is provided to be introduced into a notch of the first pallet during connection. The support spar 3 comprises a base plate 12. The support spar 3 further comprises a recess 11 to impact a not-shown tensioning means which serves in connecting to a further support spar. A tension belt can advantageously be routed through said recess 11. The support spar 3 further comprises multiple rows of first connecting elements 10, 10*a*, configured here as bores. The support spar 3 with integrally formed connecting means 4 is designed to engage around a spacer block of the first pallet. To this end, the distance between the inner surface 3*a* of the support spar 3 and the vertical limb 4*a* of the connecting means 4 is of larger dimension (oversize) than the width of the spacer block. The present embodiment of the supporting device can advantageously also receive a spacer block which is too wide. The oversize further allows a limited relative motion between the first pallet and support spar. Thus, introducing the second pallet is in particular facilitated.

Figure 2:
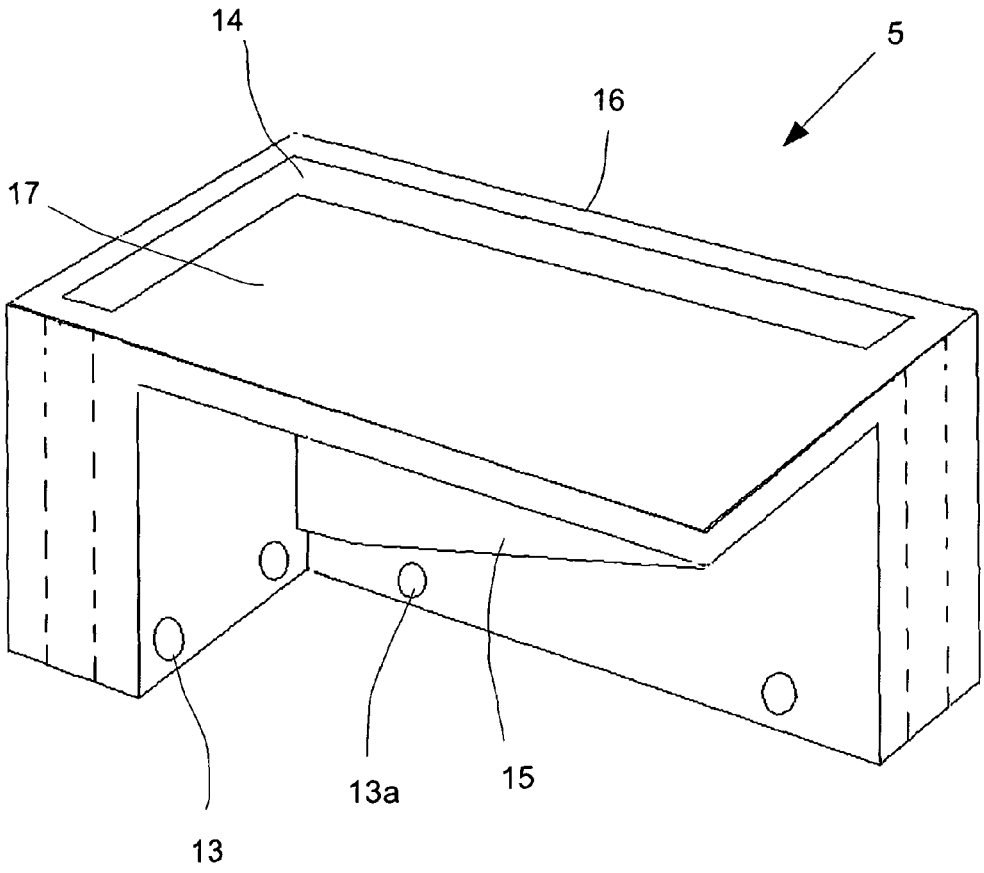
FIG. 2 a perspective view of a retaining collar.

FIG. 2 shows a retaining collar 16 in accordance with the second preferred embodiment. The retaining collar 16 exhibits a shaft 14 for the not-shown supporting device. The retaining collar 16 comprises an integrally formed support surface 17 which is additionally supported relative the retaining collar 16 by strut 15. The retaining collar 16 comprises second connecting elements 13, 13*a*, configured here as bores. Not shown are bolts which are routed through said bores to connect to the not-shown supporting device.

Figure 3:
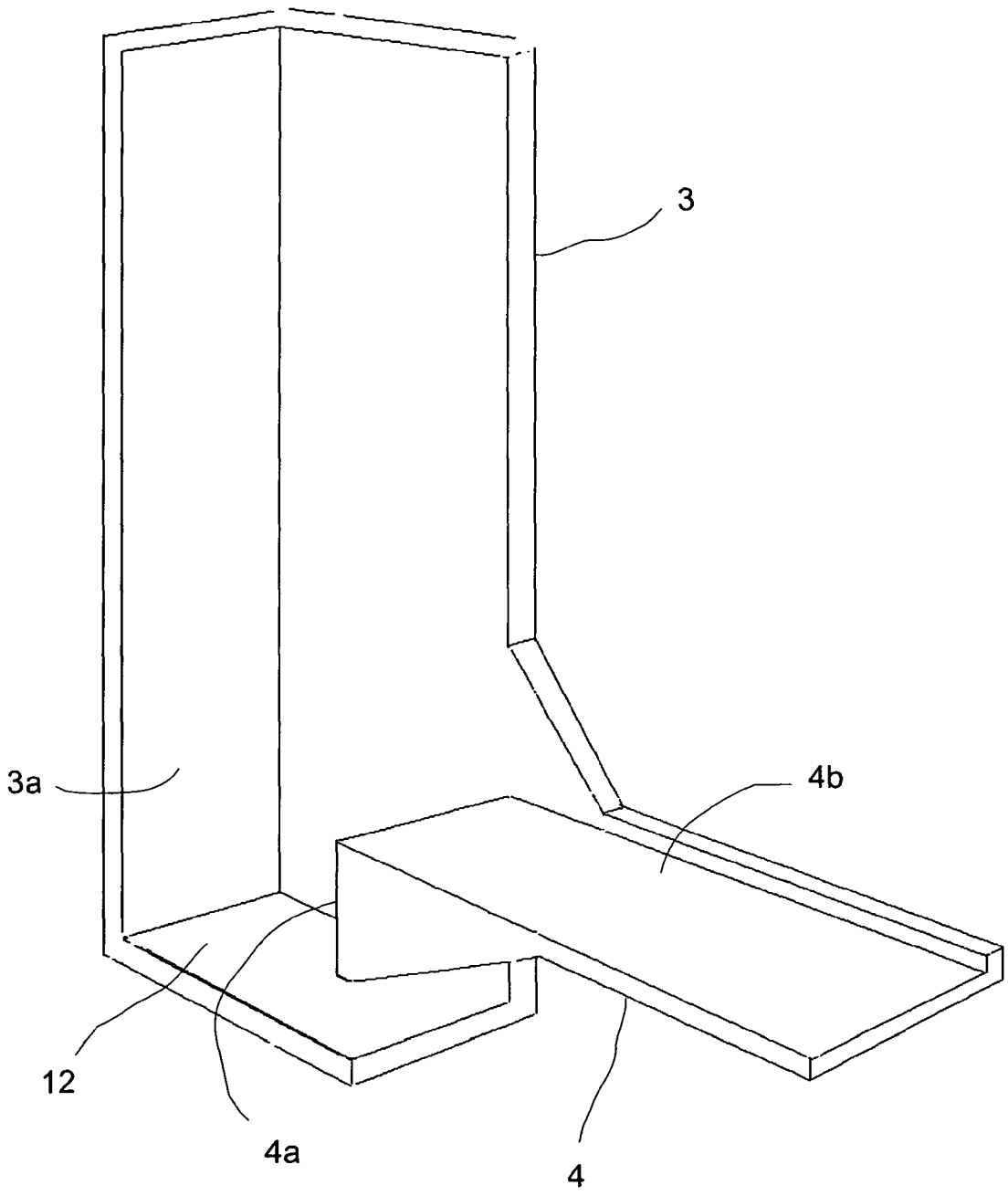
FIG. 3 a perspective view of a support spar.

FIG. 3 shows a simplified perspective interior view of the support spar 3 according to FIG. 1. A base plate 12 and connecting means 4 are integrally formed on the support spar 3. The inner surface 3*a* of the support spar 3 as well as the boundary surface 4*a* of the connecting means 4 parallel thereto are also marked. The distance between the inner surface 3*a* and the boundary surface 4*a* is selected such that connecting means 4 can engage around a spacer block of the first pallet at a predetermined distance. The loading deck of the first pallet extends above the horizontal surface 4*b* of connecting means 4. The bottom deckboard of the pallet extends through the gaps between connecting means 4 and base plate 12. Upon the connecting of support spar 3 and the first pallet, the connecting means 4 is introduced into one of its notches.

Figure 4:
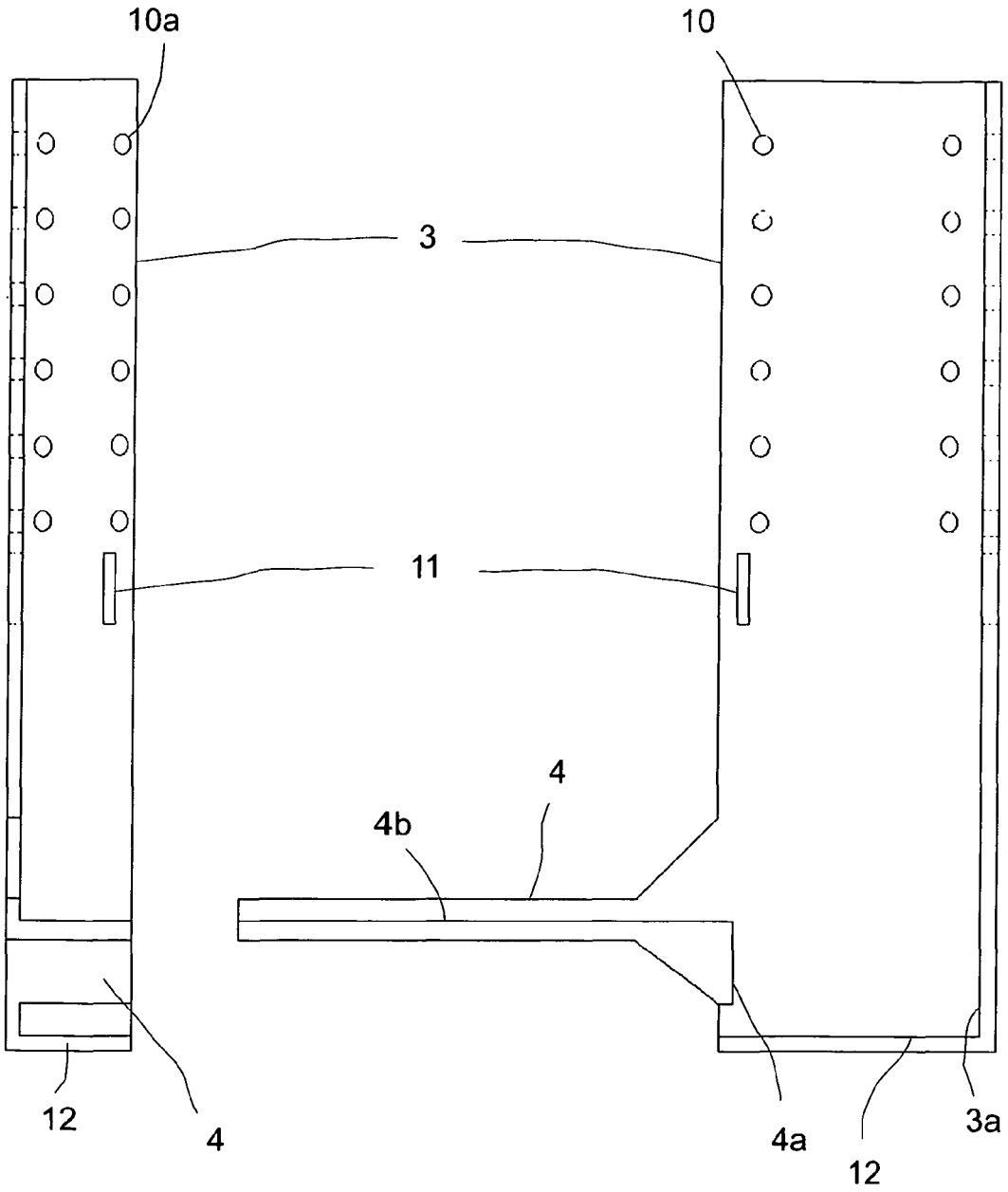
FIG. 4 a front view and a side view of a support spar.

FIG. 4 shows views of a support spar 3 with integrally formed connecting means 4 which is mirror-symmetrical to that of FIG. 1. The gap between base plate 12 and connecting means 4, through which a bottom deckboard of the first pallet is led, is recognizable in the left-side depiction.

Figure 5:
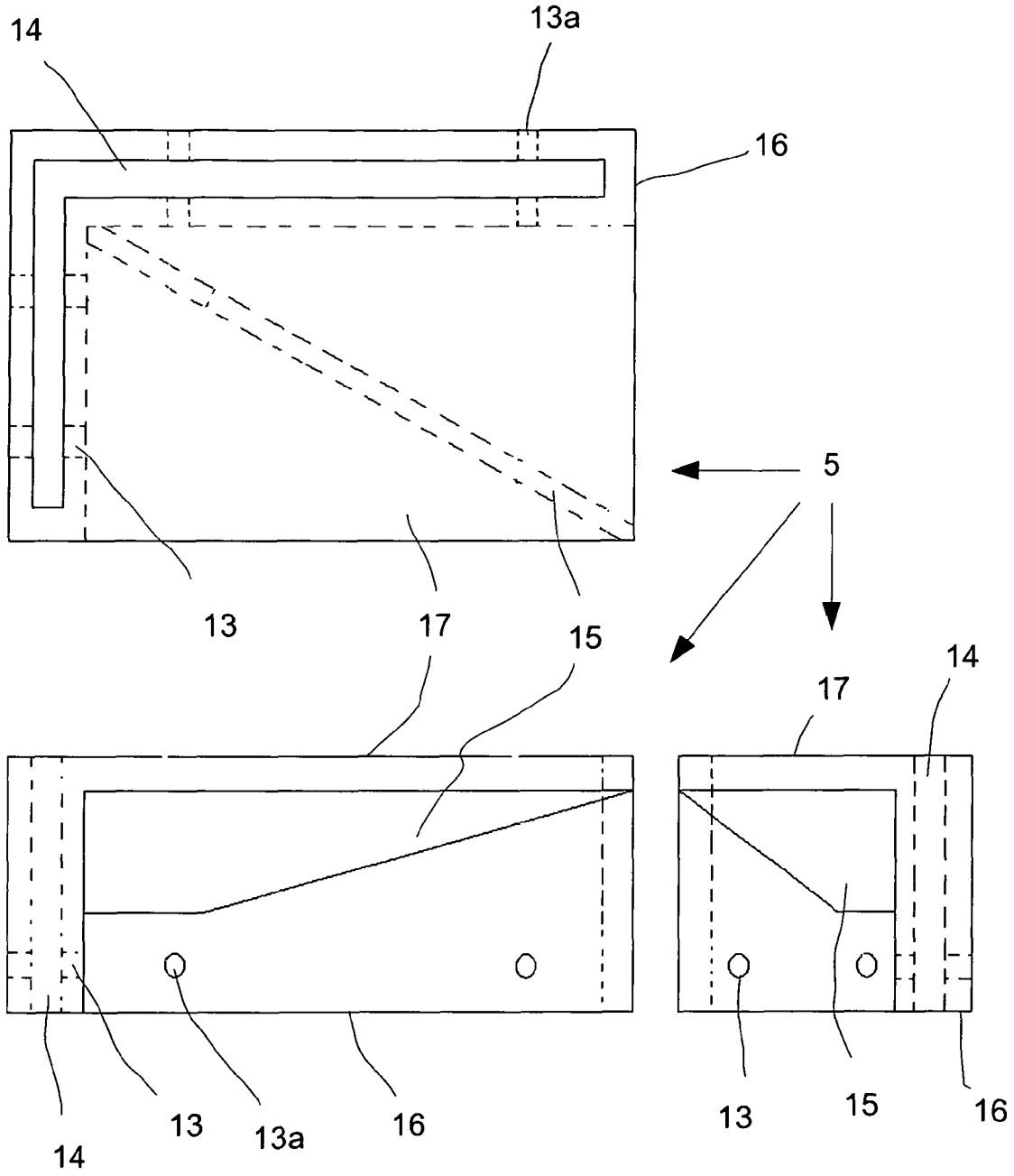
FIG. 5 three crevices of a retaining collar.

FIG. 5 shows projections of the retaining collar 16 according to FIG. 2 using the same reference numerals. What is not shown is that support surface 17 comprises recesses to save weight and preferably for connecting to the bearing aid for smaller second pallets.

Figure 6:
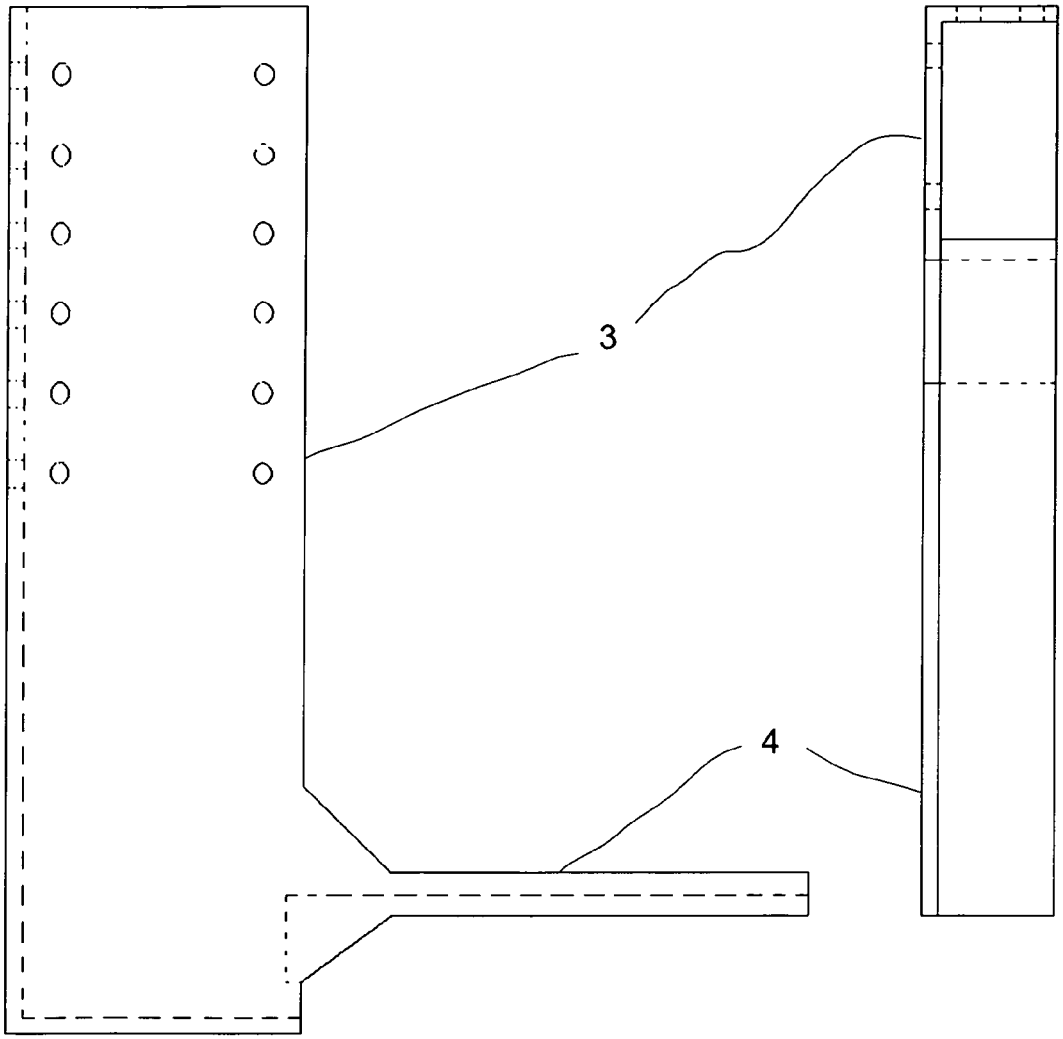
FIG. 6 a front view and a top view of a support spar.
Figure 7:
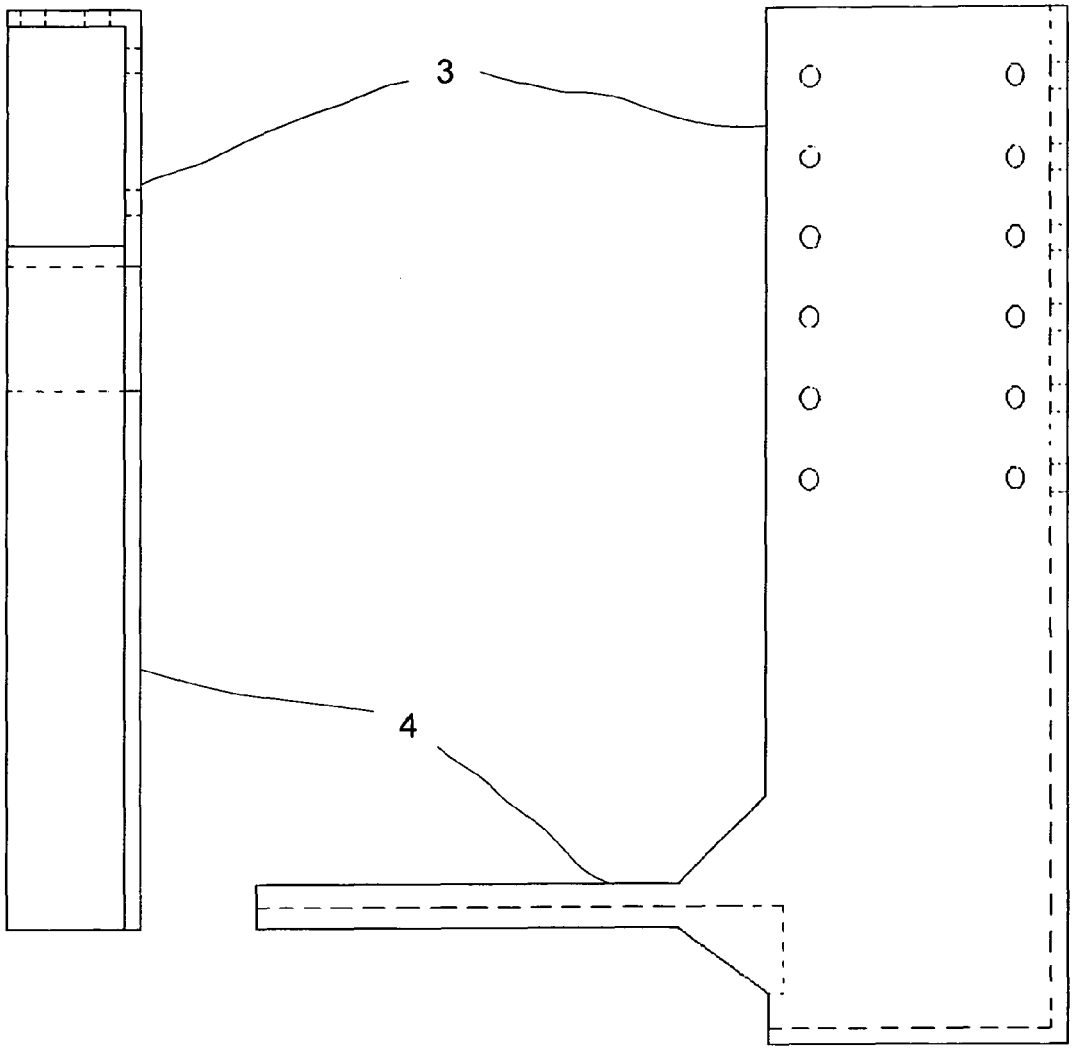
FIG. 7 top view and front view of a support spar.
Figure 8:
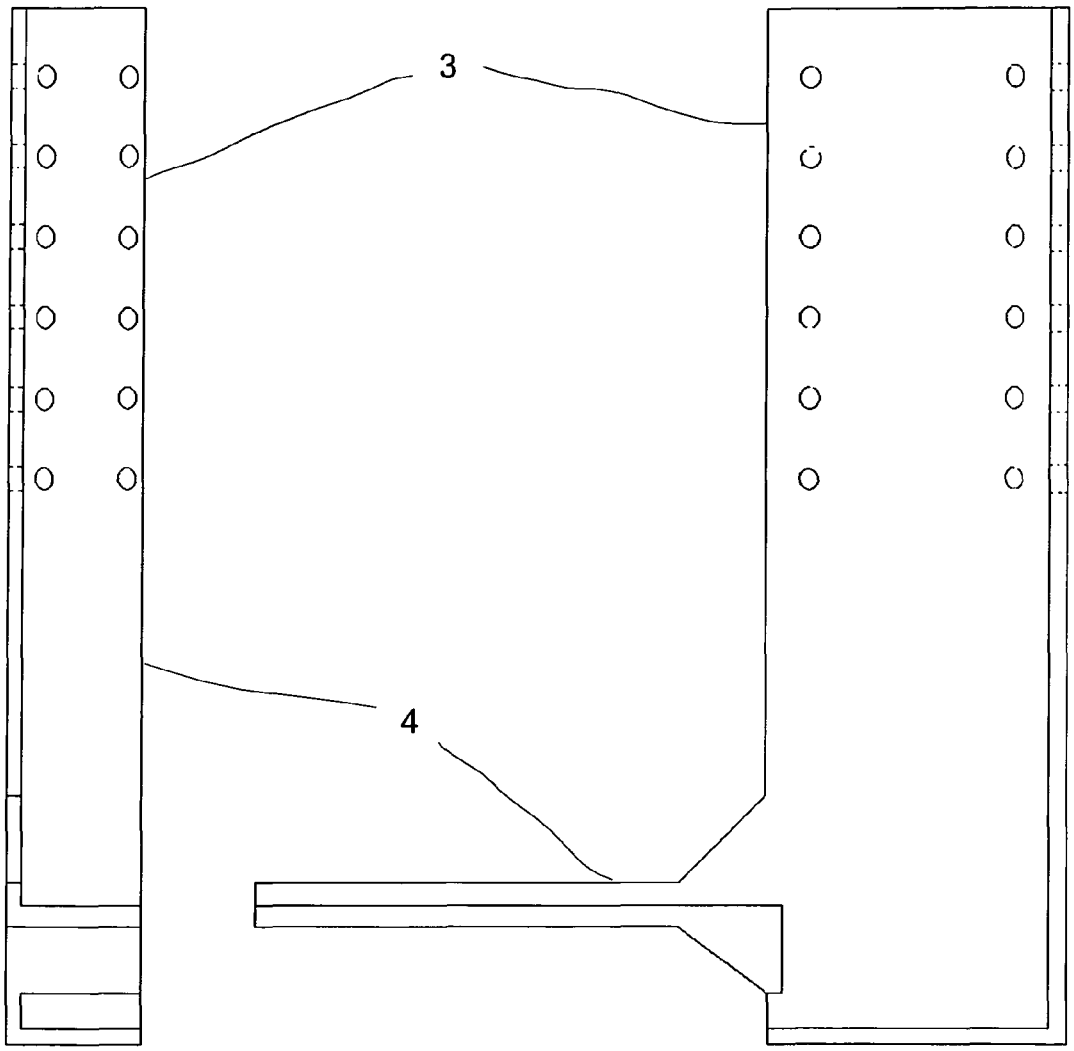
FIG. 8 side view and front view of a support spar.
Figure 9:
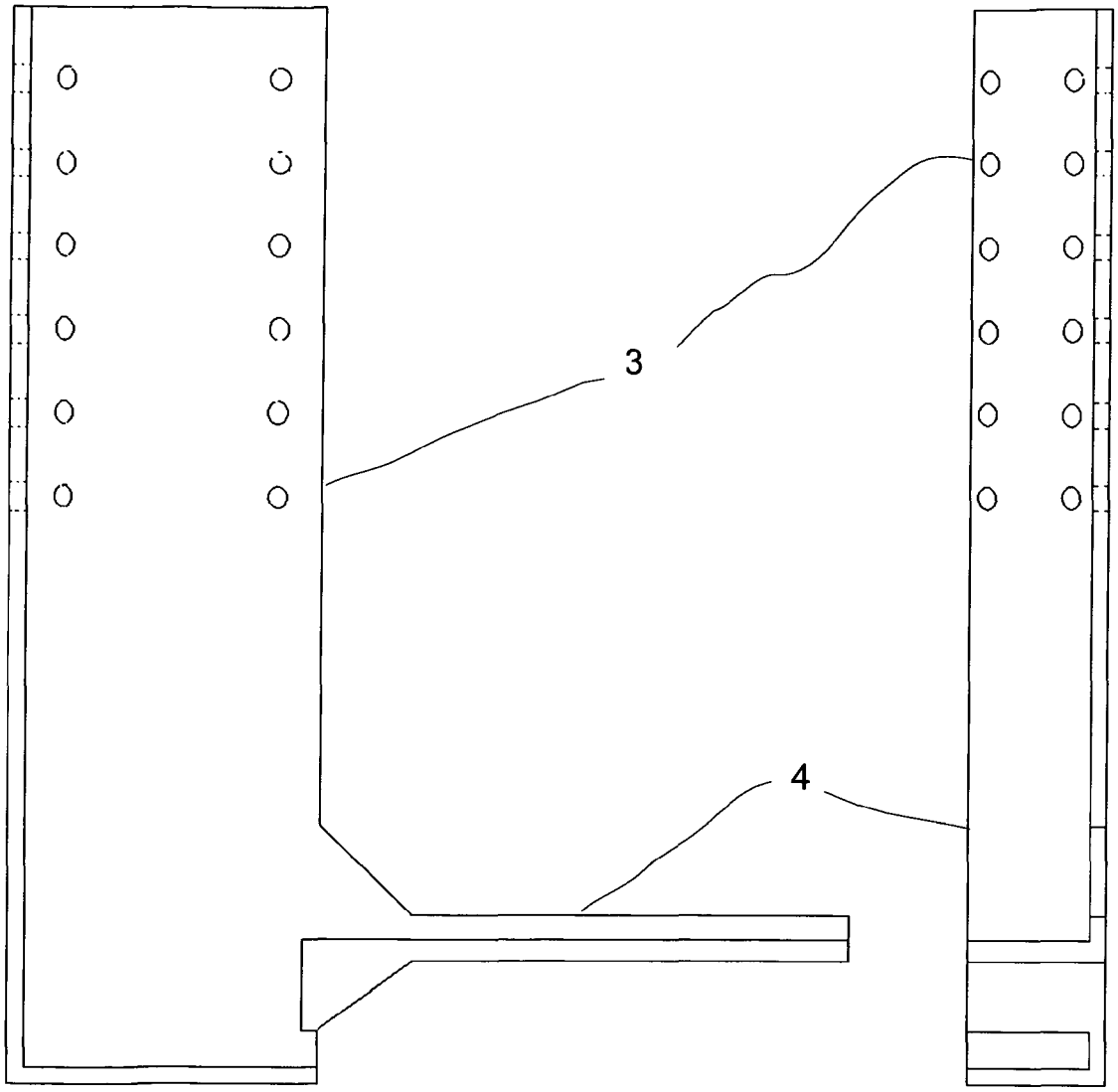
FIG. 9 front view and side view of a support spar symmetrical to FIG. 8, FIG. 10 a perspective view of a support spar with retaining collar and force-transmitting element, FIG. 11 a front view and side view of a support spar with inserted insertion block, FIG. 12 an auxiliary lifting device arranged underneath the loading deck of a pallet, FIG. 13 a schematic view of a first pallet with auxiliary lifting device, two braced support spars and positioned second pallet, FIG. 14 a perspective view of a further embodiment of a support spar with articulated limbs, FIG. 15 a side view and top view of the support spar according to FIG. 14, FIG. 16 a bearing aid for attaching smaller second pallets, FIG. 17 a slot-guided mechanism in a support spar with first and second connecting elements, FIG. 18 the L-shaped cross section of a support spar with various inserts, FIG. 19 a detail of a support spar with a special locking mechanism having first and second locking elements, FIG. 20 a section through a preferred embodiment of a support spar with retaining collar, FIG. 21 a section through a support spar with two retaining collars in accordance with a further preferred embodiment, FIG. 22 a further preferred embodiment of a support spar with carrier, FIG. 23 an embodiment of an auxiliary transport unit with two support spars and a support spar connecting device in the unconnected state, FIG. 24 the embodiment of the auxiliary transport unit from FIG. 23 in the connected state, FIG. 25 the embodiment of the auxiliary transport unit from FIG. 23 with lifting means, FIG. 26 the embodiment of the auxiliary transport unit from FIG. 23 in a state in which the support spar connecting device is connected to a loading surface, FIG. 27 a first embodiment of the support spar connecting device, FIG. 28 a second embodiment of the support spar connecting device, FIG. 29 a third embodiment of the support spar connecting device, FIG. 30 a further embodiment of the auxiliary transport unit with a supporting member, FIG. 31 the embodiment of the auxiliary transport unit from FIG. 30 during assembly, FIG. 32 a perspective depiction of a further preferred embodiment of the auxiliary transport unit, FIG. 33 a view of the auxiliary transport unit from FIG. 32 from below, FIG. 34 a cross-sectional depiction of the auxiliary transport unit from FIG. 32, FIG. 35 a perspective depiction of a support spar of the auxiliary transport unit from FIG. 32, FIG. 36 a further perspective depiction of a support spar of the auxiliary transport unit from FIG. 32, FIG. 37 a further embodiment of a support spar with a connecting device arranged on the right side, FIG. 38 a support spar corresponding to the embodiment of FIG. 37 with a connecting device arranged on the left side, FIG. 39 a further embodiment of a support spar with a connecting device arranged on the right side, FIG. 40 a support spar corresponding to the embodiment of FIG. 39 with a connecting device arranged on the left side, FIG. 41 a plan view of a further embodiment of a support spar with a connecting device arranged on the right side, FIG. 42 a plan view of a support spar corresponding to the embodiment of FIG. 41 with a connecting device arranged on the left side, FIG. 43 a further embodiment of a support spar with a connecting device arranged on the right side, FIG. 44 a support spar corresponding to the embodiment of FIG. 43 with a connecting device arranged on the left side, FIG. 45 a further embodiment of a support spar with a connecting device arranged on the right side, FIG. 46 a support spar corresponding to the embodiment of FIG. 45 with a connecting device arranged on the left side, FIG. 47 a plan view of a further embodiment of a support spar with a connecting device arranged on the right side, FIG. 48 a plan view of a support spar corresponding to the embodiment of FIG. 47 with a connecting device arranged on the left side, FIG. 49 a front view of a support spar with a base plate in accordance with a further embodiment, FIG. 50 a side view of the support spar according to the embodiment of FIG. 49, FIG. 51 a plan view of the support spar according to the embodiment of FIG. 49, FIG. 52 a perspective three-dimensional depiction of the support spar according to the embodiment of FIG. 49, FIG. 53 a front view of a support spar without base plate according to a further embodiment, FIG. 54 a side view of the support spar according to the embodiment of FIG. 53, FIG. 55 a plan view of the support spar according to the embodiment of FIG. 53, FIG. 56 a perspective three-dimensional depiction of the support spar according to the embodiment of FIG. 53, FIG. 57 a schematic depiction of the connection of two support spars in accordance with the embodiment of FIG. 49 by means of a support spar connecting device, FIG. 58 a perspective three-dimensional depiction of the support spar connecting device according to the embodiment of FIG. 57, FIG. 59 an enlarged depiction of a connecting part from FIG. 58, FIG. 60 a schematic depiction of the process of connecting a support spar having a base plate to a pallet, FIG. 61 a front view of the support spar according to the embodiment of FIG. 60, FIG. 62 a side view of the support spar according to the embodiment of FIG. 60, FIG. 63 a plan view of the support spar according to the embodiment of FIG. 60, FIG. 64 a schematic depiction of the process of connecting a support spar without a base plate to a pallet, FIG. 65 a front view of the support spar according to the embodiment of FIG. 64, FIG. 66 a side view of the support spar according to the embodiment of FIG. 64, FIG. 67 a plan view of the support spar according to the embodiment of FIG. 64, FIG. 68 a side view of a support spar having a base plate with a pallet in accordance with a further embodiment, FIG. 69 a further side view of the support spar according to the embodiment of FIG. 68 without pallet, FIG. 70 a plan view of the support spar according to the embodiment of FIG. 68 without pallet, FIG. 71 a side view of a support spar without base plate with a pallet according to a further embodiment, FIG. 72 a further side view of the support spar according to the embodiment of FIG. 71 without pallet, and FIG. 73 a plan view of the support spar according to the embodiment of FIG. 71 without pallet.

FIG. 6 shows a simplified embodiment of the support spar 3 with integrally formed connecting means 4 not having a recess for tensioning means which is mirror-symmetrical vis-à-vis the embodiment of FIG. 1. The support spar 3 with integrally formed connecting means 4 of FIG. 7 is of mirror-symmetrical design to that of FIG. 6. The support spar 3 with integrally formed connecting means 4 of FIG. 8 substantially corresponds to the embodiment of FIG. 4 apart from the absent recess for tensioning means. The support spar 3 with integrally formed connecting means 4 of FIG. 9 is of mirror-symmetrical design to the embodiment according to FIG. 8.

Figure 10:
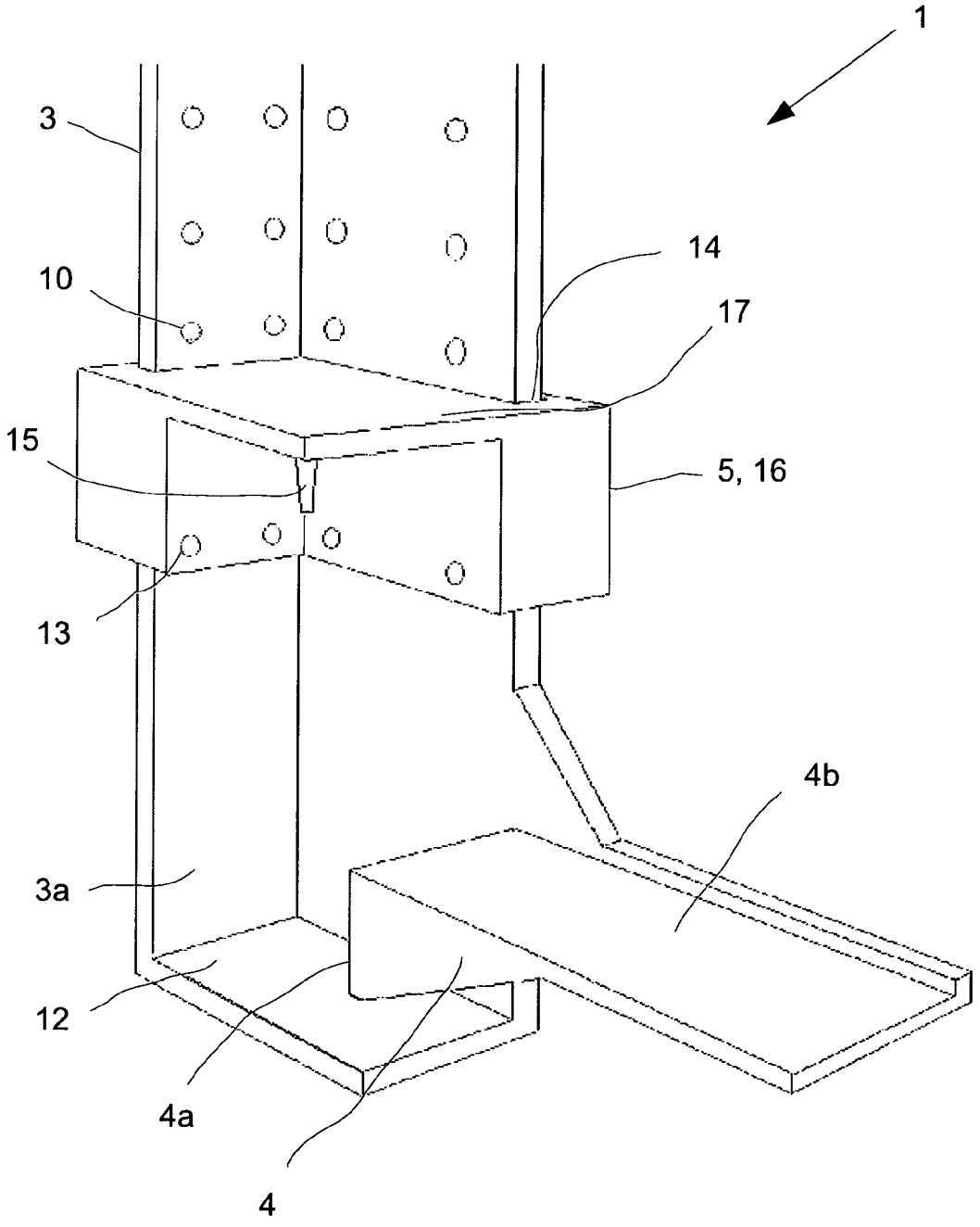

FIG. 10 shows a perspective view of a support spar 3 in accordance with the first preferred embodiment. The connecting means 4 is integrally formed on the support spar 3. The base plate 12 is integrally configured with the support spar 3. The retaining collar 16 is pushed onto the support spar 3. The retaining collar 16 comprises a support element 17, supported by strut 15, as well as second connecting elements 13. The support spar 3 is displaceably guided through the shaft 14. The support spar 3 and retaining collar 16 are connected by first connecting elements 10 and second connecting elements 13, both configured as bores. The screws or bolts routed through the bores are not shown.

Figure 11:
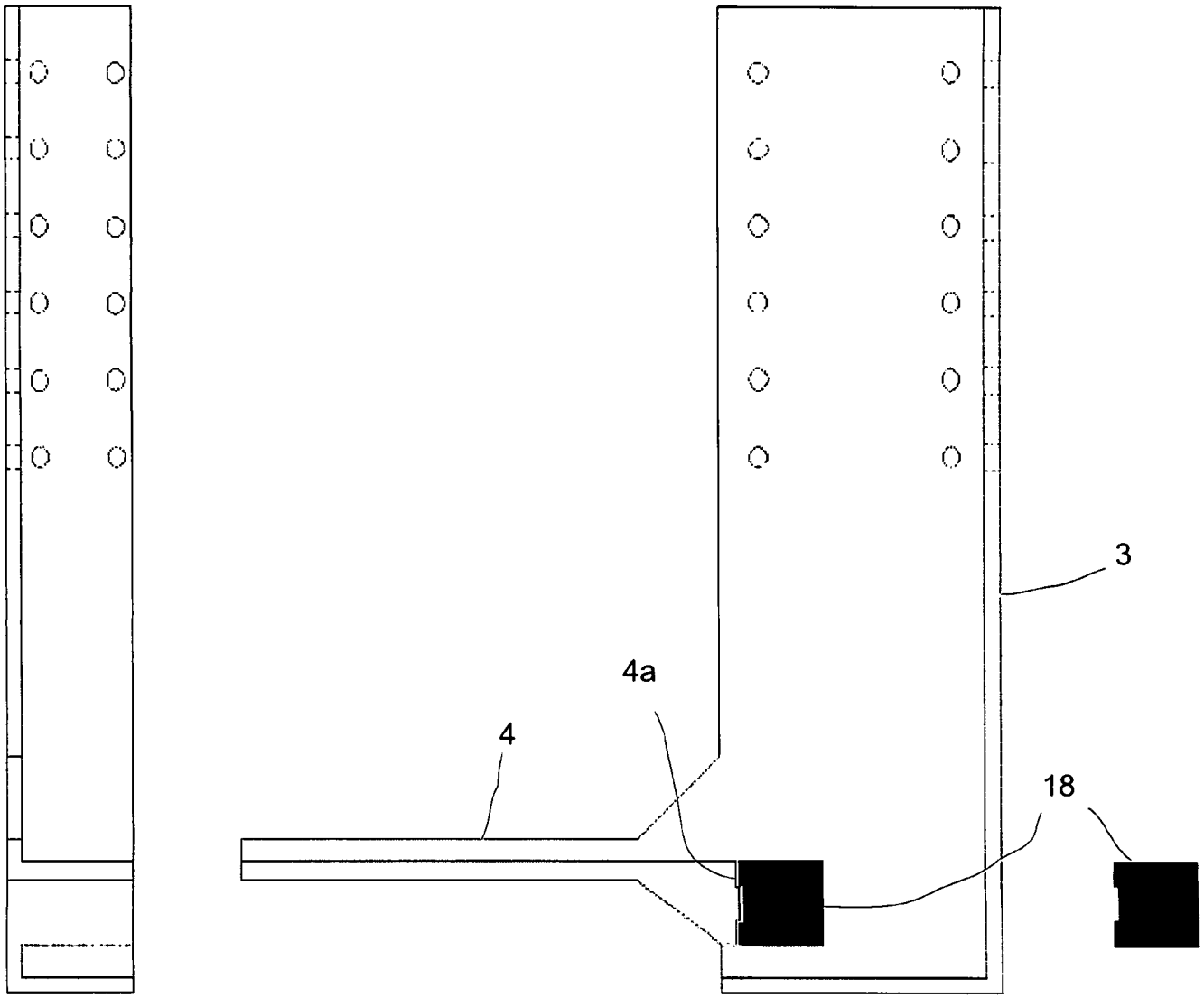

FIG. 11 shows a support spar 3 with integrally formed connecting means 4. The insertion block 18, which is inserted between the boundary surface 4*a* of the connecting means 4 and the spacer block of the not-shown first pallet within one of its notches, is also depicted. The insertion block 18 counteracts a relative motion between the support spar 3 and the not-shown first pallet which is advantageous for introducing the second pallet, particularly during transport. In accordance with one preferred embodiment, the boundary surface 4*a* exhibits a projection which engages in a groove of the insertion block 18 and counters unwanted displacement of the insertion block 18 during transport.

Figure 12:
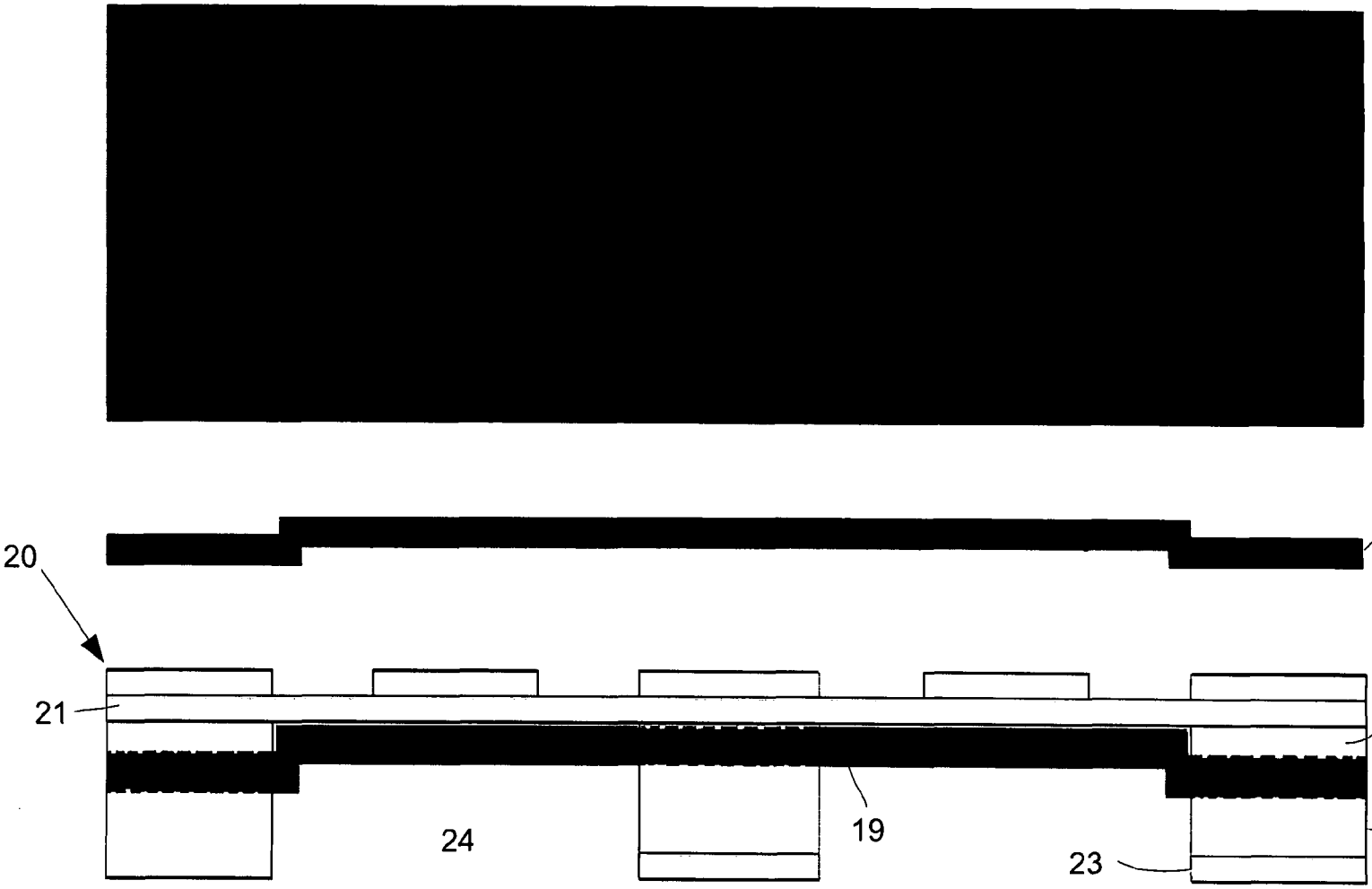

FIG. 12 shows a pallet 20 with loading deck 21, spacer block 22 and bottom deckboard 23. The auxiliary lifting device 19 is introduced underneath the loading deck 21 and through the notches 24 of the pallet 20. In accordance with one preferred embodiment, the auxiliary lifting device 19 is made from fiber-reinforced plastic or a profiled metal. The auxiliary lifting device 19 engages the not-shown connecting means 4 underneath the notches of the pallet 20 under the horizontal support surface 4*b*. When a lifting means is introduced into the notch 24 and the pallet hoisted, the not-shown support spar 3 is supported on the lifting means by the horizontal support surface 4*b* and the auxiliary lifting device 19. It is advantageous in the process for the bottom deckboard 23 to not be part of the flow of force.

Figure 13:
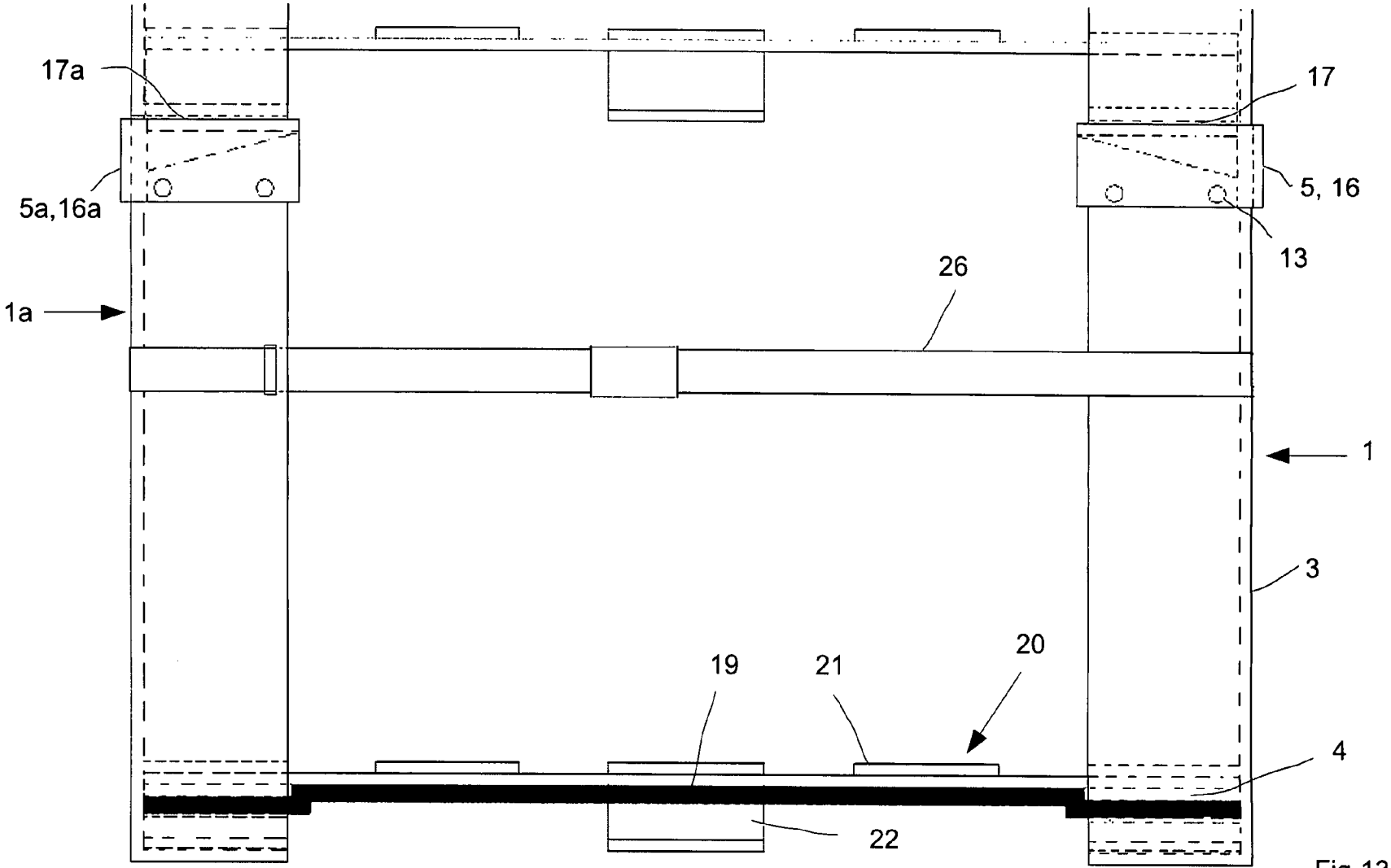

FIG. 13 shows a configuration of a first pallet 20, a second pallet 25, the auxiliary transport unit 1 as well as tensioning means 26, configured here as a tension belt. The connecting means 4 formed integrally with the support spar 3 engages around the spacer block 22 of first pallet 20. The auxiliary lifting device 19 is arranged underneath the loading deck. The retaining collars 16, 16*a* are arranged at the same distance to the loading deck 21 of the first pallet 20. The second pallet 25 rests on the support surfaces 17, 17*a* of the retaining collars 16, 16*a*. The support spars 3 are secured against unwanted relative motion during transport by means of the tension belt 26. The tension belt 26 also runs around two further support spars (not shown in this view). The support spars 3, 3*a* extend over the support elements 17, 17*a* and abut the second pallet 25, in particular its spacer blocks. Thus, the braced support spars 3 advantageously counteract an unwanted horizontal displacement of the second pallet 25.

Figure 14:
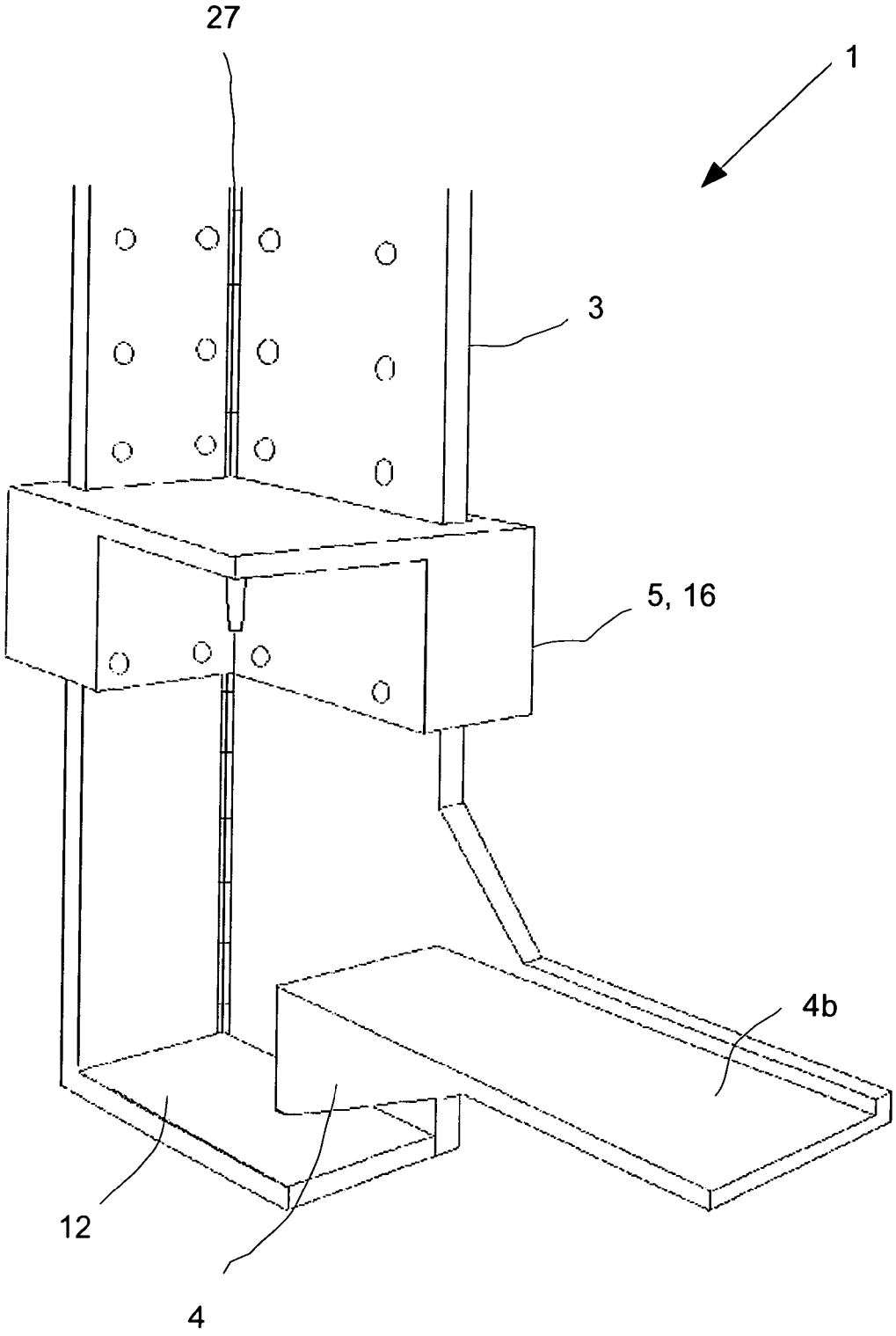
Figure 15:
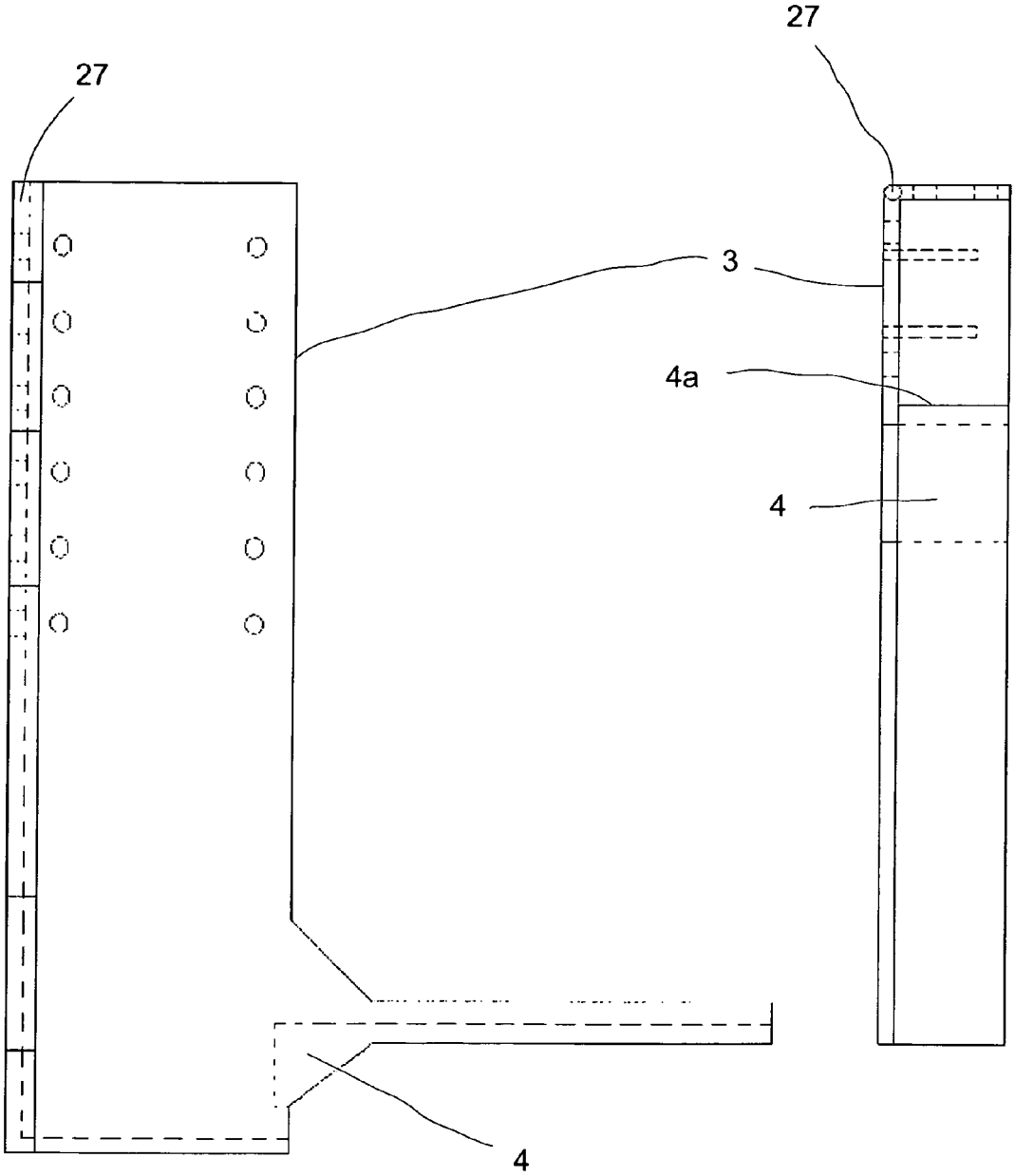

FIG. 14 shows a further preferred embodiment of the auxiliary transport unit 1 with a specially designed support spar 3. The support spar 3 of the present preferred embodiment is designed with limbs which are articulated together by means of hinge 27. A force-transmitting element 4 is integrally formed on one of the limbs. The base plate 12 is integrally formed on the other limb of the support spar 3. The connecting of the auxiliary transport unit 1 to the not-shown pallet initially takes place without retaining device 5. The base plate 12 is first positioned under the bottom deckboard of the first pallet. The limb of the support spar 3 connected to the base plate 12 is pushed forward to contact the first pallet. The limb with the integrally formed force-transmitting element 4 on the base plate 12 and the first pallet is then lifted. The force-transmitting element 4 is thereby pushed into a notch of the not-shown pallet. The horizontal support surface 4*b* is thereby disposed underneath the loading deck. The retaining device 5 is thereafter set onto the supporting device from above so that the support spar 3 is routed into channel 14. The retaining device 5 is connected to the support spar at the desired height. The retaining device 5 advantageously defines the angle of the support spar 3 limbs relative each other. The present preferred embodiment advantageously simplifies in particular the use of US pallets. FIG. 15 shows a support spar 3 with integrally formed force-transmitting element 4 and a hinge 27 in accordance with the embodiment of FIG. 14.

Figure 16:
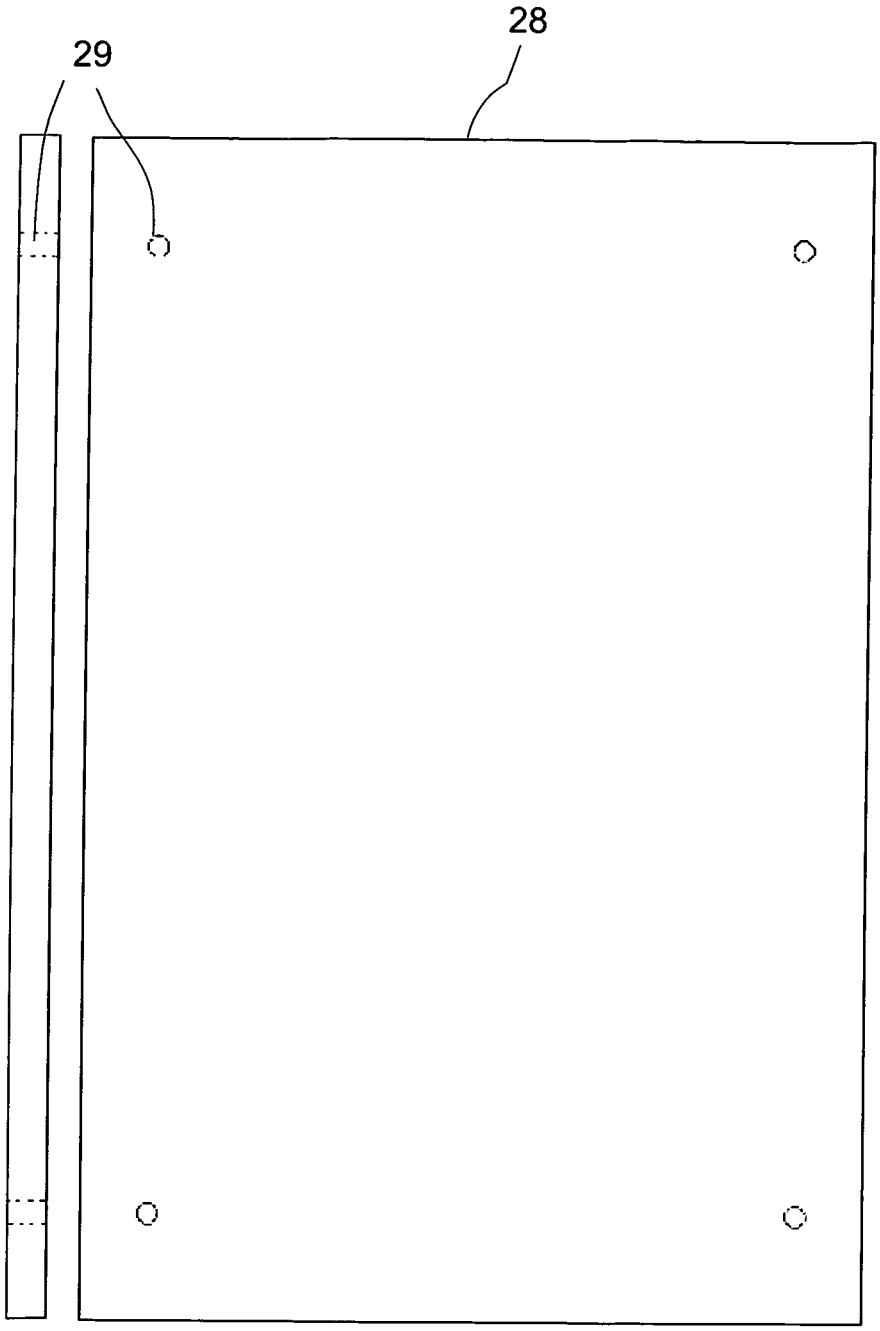

FIG. 16 shows the bearing aid 28 which in particular serves in supporting smaller second pallets. The bearing aid 28 comprises connecting elements 29, configured here as bores, which serve in the connecting to support bodies of different support spars. The bearing aid 28 is secured against unwanted horizontal displacement via said connecting elements 29. Smaller second pallets, particularly two pallets of half the size of the first pallet, can be advantageously supported.

Figure 17:
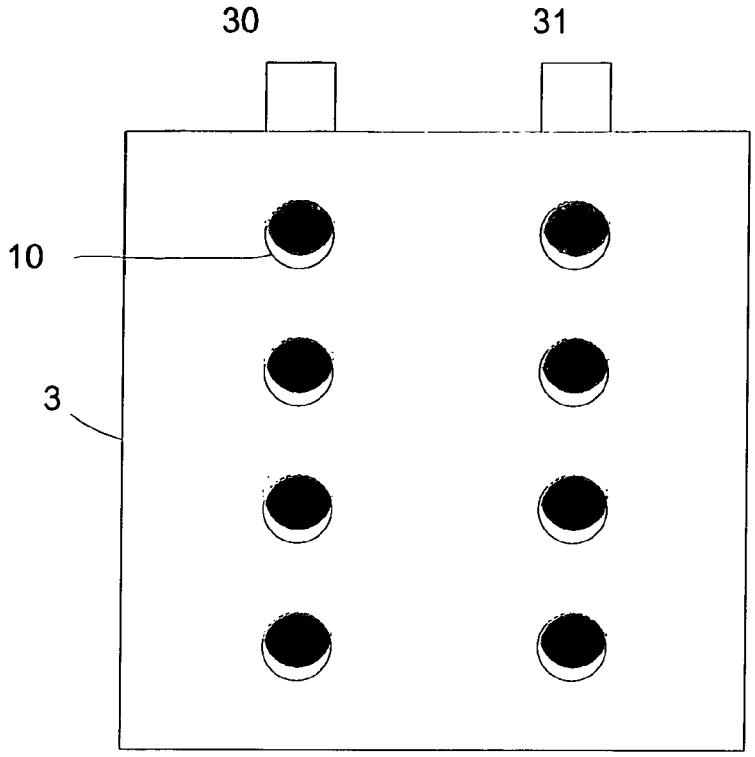

FIG. 17 shows a section of a support spar 3 with first connecting elements 10. Sliders 30, particularly spring-loaded sliders, are introduced into the guides 31 of support spar 3. Not-shown second connecting elements of a retaining device mate into said first connecting elements 10. Each of said second connecting elements, preferably configured as pins, comprise a respective cut into which the in particular spring-loaded slider 30 engages. The slider 30 is thereby pretensioned against a spring so that the second connecting elements can traverse the entire area of the bores 10. After the second connecting elements have been inserted and the slider 30 released, same is brought into engagement with the cuts of the second connecting elements by means of the pretensioned spring and secured against unwanted displacement.

Figure 18:
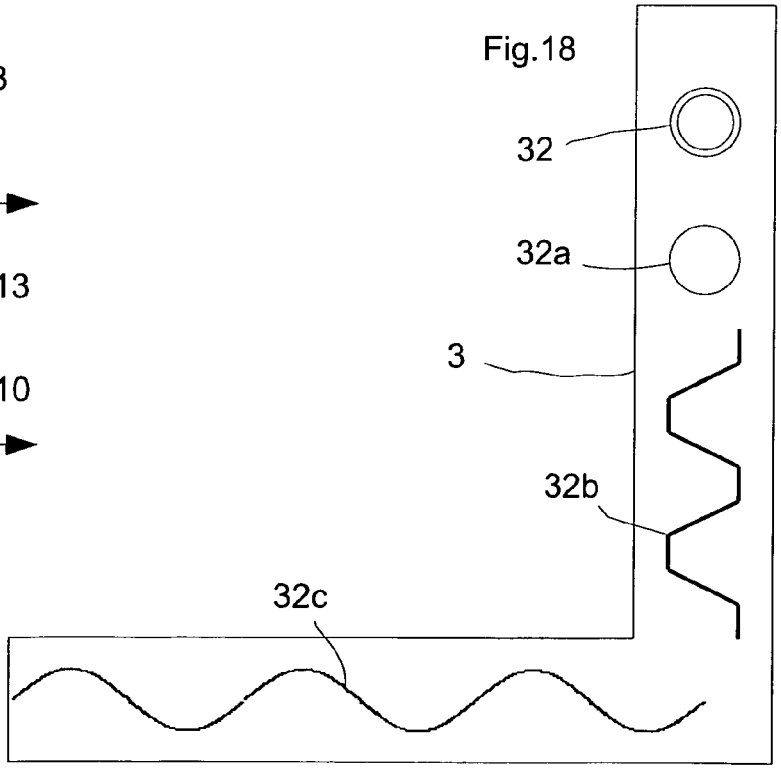

FIG. 18 shows an L-shaped cross section of a support spar 3. The support spar 3 comprises a fiber-reinforced plastic with various inserts 32, 32*a*, 32*b*, 32*c*. Same are preferably of metal configuration, particularly preferentially steel or aluminum. The inserts 32, 32*a*, 32*b*, 32*c* serve in increasing the load capacity of the support spar 3 and are inserted into the injection mold during the manufacture of the support spar 3. Insert 32 is designed as a metal tube, insert 32*a* as a metal rod, insert 32*b* as an edged metal sheet and insert 32*c* as a deep-drawn steel sheet. The latter two inserts 32*b*, 32*c* preferably comprise first connecting elements having increased load capacity, preferably designed as recesses, bores or punch-outs.

Figure 19:
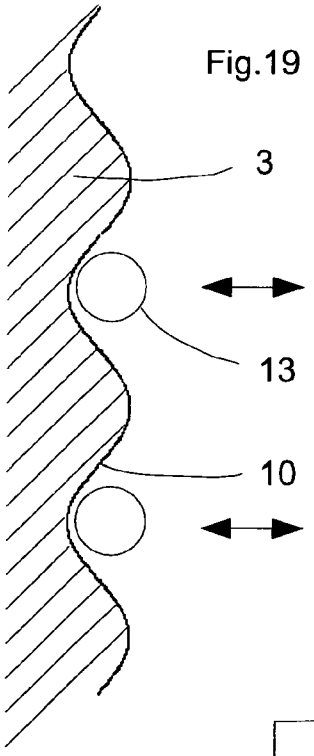

FIG. 19 shows a detail of a support spar 3 in a preferred embodiment having a profiled edge. The profiled edge exhibits first connecting elements 10. Second connecting elements 13, depicted here as disks and led into the not-shown retaining device 5, engage into the first connecting elements 10 and advantageously secure the not-shown retaining device 5 against unwanted displacement.

FIG. 20 shows a section through a preferred embodiment of the auxiliary transport unit 1. The support spar 3 configured as a profile rail, particularly of metal, exhibits first connecting elements 10, 10*a*. The retaining collar 16 with support surface 17 and second connecting elements 13, 13*a*, does not engage completely around the support spar 3. However, by engaging around the edges of the support spar 3, the retaining collar 16 is secured against unwanted horizontal displacement (here the plane of the sheet). The spring-loaded second connecting elements 13, 13*a*, configured here as pins, engage into the first connecting elements 10, 10*a* of the support spar 3. The retaining collar 16 is thus secured against unwanted vertical displacement (here perpendicular to the plane of the sheet).

FIG. 21 shows a further preferred embodiment of the auxiliary transport unit 1. The support spar 3 is designed in correspondence to the embodiment of FIG. 20. Two retaining collars 16, 16*a* exhibit two support surfaces 17, 17*a*. The second connecting element 13 is designed as a two-piece pin and spring. The pin is connected to the retaining collar 16. The spring pretensions the retaining collar 16*a* against the support spar 3. When the retaining collar 16*a* is subjected to a force F in the direction depicted, the spring is pretensioned and the pin 13 exits the bore 10. The retaining collar 16*a* can then be removed from support spar 3 and/or affixed to other positions on support spar 3. Thus, the retaining collar 16*a* with the support spar 3 is brought into the desired height in the arrangement, a force F is applied in the direction depicted, the spring is tensioned and the pin with bore 10 lined up. With decreasing force, the spring slackens and the pin engages into bore 10. The retaining collars 16, 16*a* can advantageously be kept separate from the support spar 3 and/or any quantity thereof also be held to replace defects, for example caused by shipping workers or truck drivers. In accordance with one preferred embodiment, the support spar 3 is manufactured from an edged metal sheet or metal profile, particularly preferentially from a deep-drawn steel sheet. The bores can advantageously be punched during the deep drawing.

FIG. 22 shows a further preferred embodiment of the auxiliary transport unit 1. The support spar 3 made from a metal profile comprises exposed pockets or exposed lugs as first connecting elements 10, particularly preferentially punched recesses. The retaining collar 5 is configured as an L-shaped support piece or metal bracket. During transport, the upper surface of the metal bracket forms the support surface 17. Second connecting elements 13 facing downward during transport, here clips, tongues or hooks, are guided to the desired height in the first connecting elements 10. The weight of the positioned second pallet advantageously improves the cohesion between support piece 5 and supporting device 3. The use of the support piece 5 further advantageously reinforces the supporting device 3. The supporting device 3 of the present preferred embodiment of the auxiliary transport unit 1 can further advantageously be economically manufactured as "bulk stock," particularly as pressed sheet metal parts. The support piece 5 designed as a metal bracket can be likewise just as advantageously manufactured economically.

Figure 23:
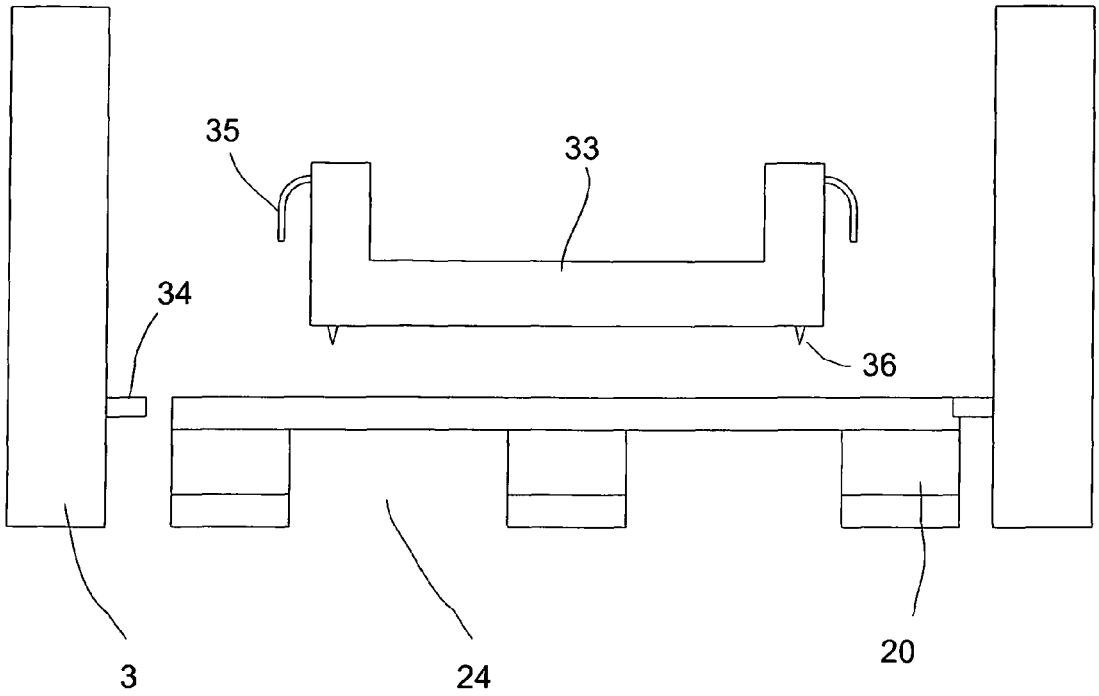

FIG. 23 shows a further embodiment of an auxiliary transport unit 1 with two support spars 3 and one support spar connecting device 33 in an unconnected state. At its lower end, the support spar 3 comprises a connecting part receiving element 34 which is designed as an eye in the embodiment shown in FIG. 23. The support spar connecting device 33 shown in the embodiment depicted in FIG. 23 is configured as a substantially plate-shaped strut. The strut 33 comprises a connecting part 35 designed as a hook in the embodiment shown in FIG. 23. The strut 33 can furthermore comprise at least one loading surface connecting element 36 which is designed in the embodiment shown in FIG. 23 as a pin to be received in the corresponding loading surface notches of a loading surface 37 shown in FIG. 25.

Figure 24:
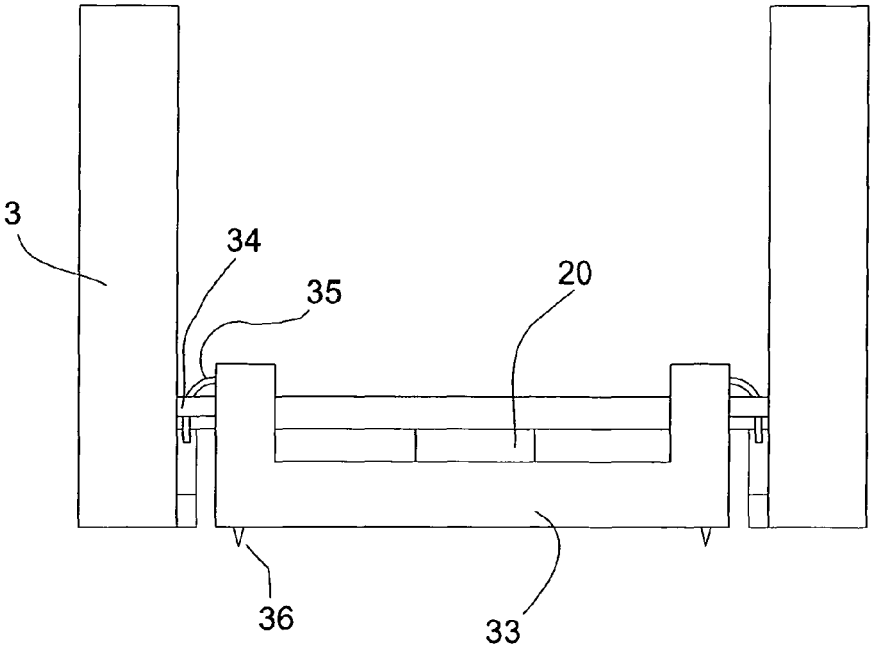

FIG. 24 shows the embodiment of the auxiliary transport unit from FIG. 23 in a connected state. The hooks 35 of the strut 33 engage in the eyes 34 of the support spar 3 such that the lower pallet 20 is secured against slipping during transport as the strut 33 is disposed in the lower pallet 20 area.

Figure 25:
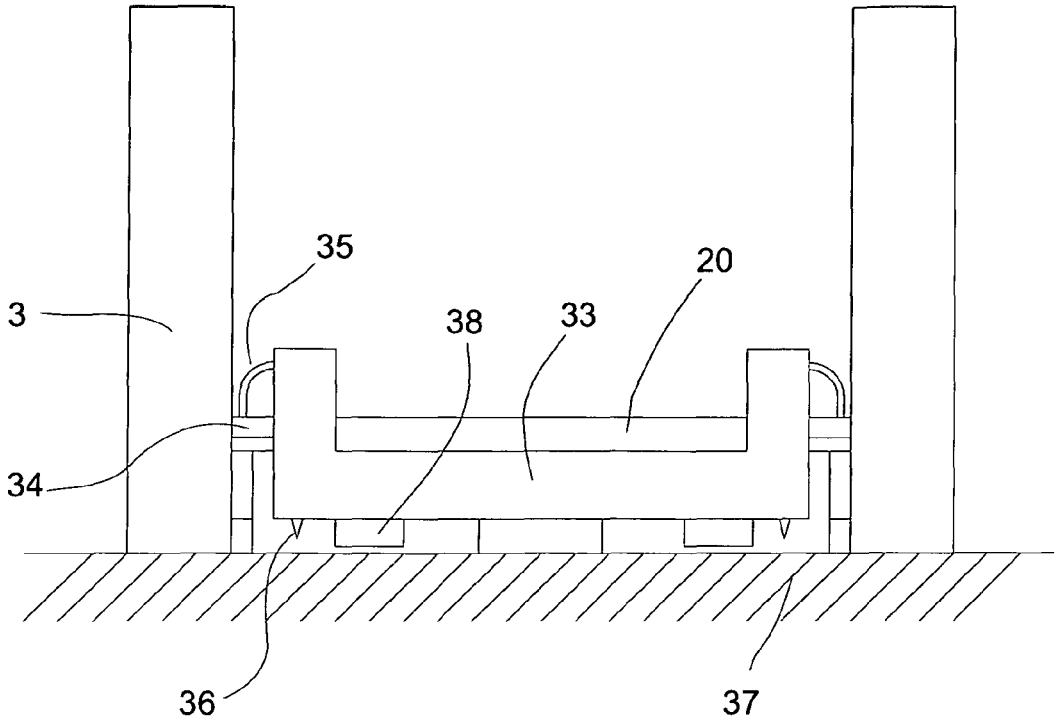

FIG. 25 shows the embodiment of the auxiliary transport unit from FIG. 23 with a lifting means. It can be recognized from this figure that after raising and prior to loading the unit, the strut 33 is disposed in a first position in which the at least one notch 24 of the lower pallet 20 remains exposed to lifting means 38, whereby the hooks 35 are already inserted into the eyes 34.

Figure 26:
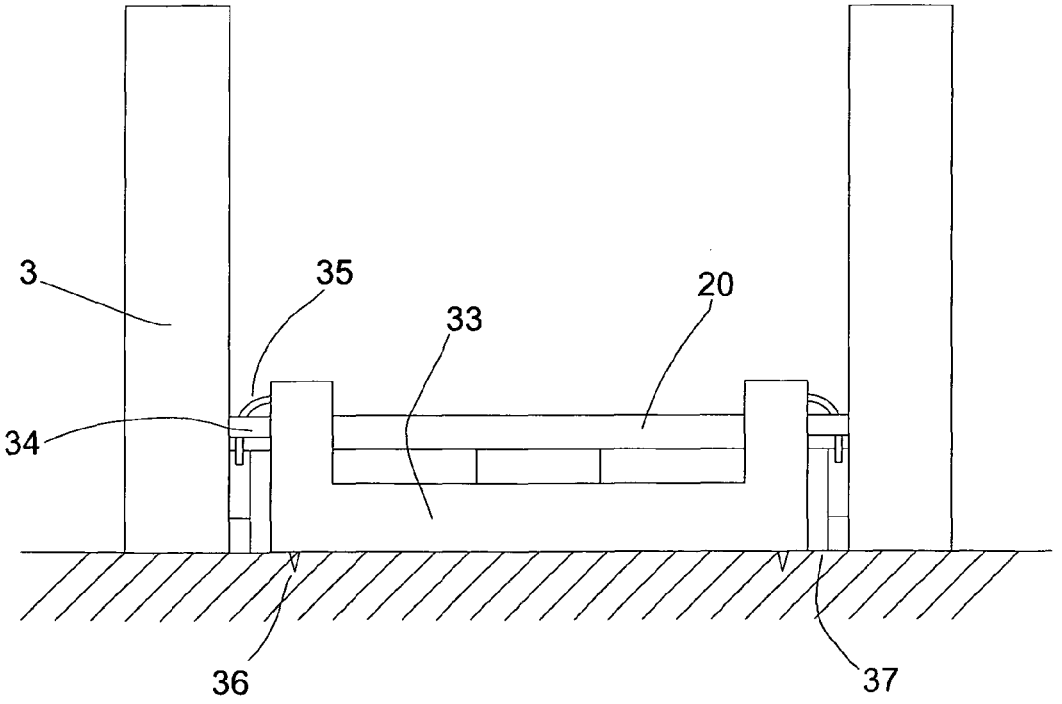

FIG. 26 shows the embodiment of the auxiliary transport unit from FIG. 23 in a state in which the strut 33 is connected to the loading surface 37. After the unit has been deposited on the loading surface 37, the strut 33 assumes a second position in which the pin 36 is force-locked to the loading surface 37, whereby the hooks 35 in eyes 34 can slide downward.

Figure 27:
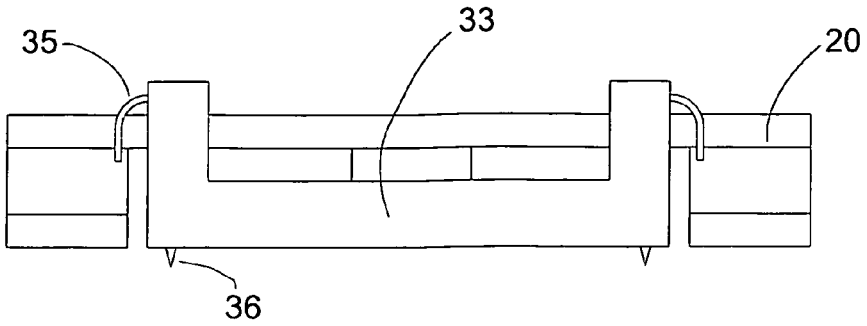

FIG. 27 shows a first embodiment of the strut 33 in which the strut 33 exhibits a window with an upper edge in the area of notch 24 of the first pallet 20 through which a lifting means not shown in the present figure can be routed, wherein the upper edge of the window is arranged in the area of a loading deck of the first pallet 20.

Figure 28:
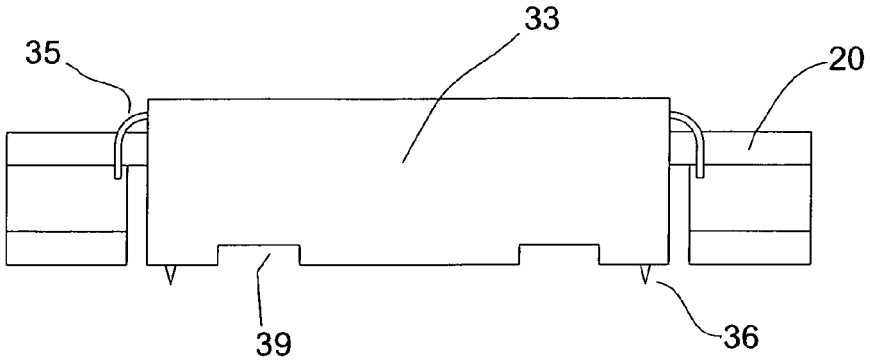

FIG. 28 shows a second embodiment of the strut 33 in which a lower edge exhibits a chamfer with which the lifting means which is routed into notch 24 raises the strut 33 such that the hooks 35 cannot exit the eyes 34.

Figure 29:
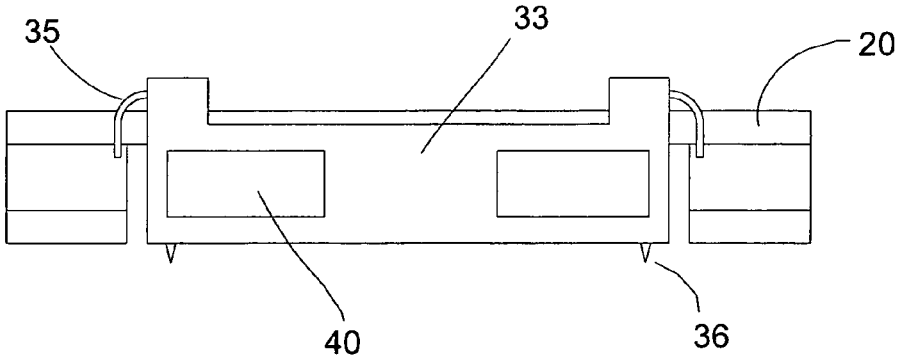

FIG. 29 shows a third embodiment of the support spar connecting device in which an upper edge of a longitudinal opening 40, which partially covers the notch 24 during transport, exhibits a chamfer with which the lifting means which can be routed into the notch 24 raises the strut 33 such that the hooks 35 cannot exit the eyes 34.

Figure 31:
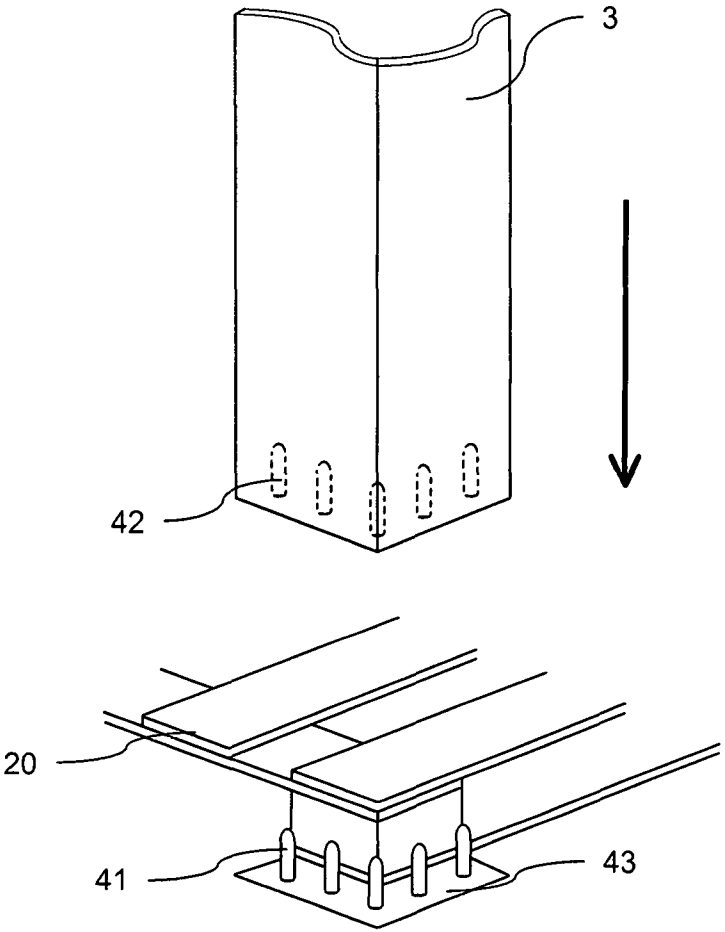
Figure 30:
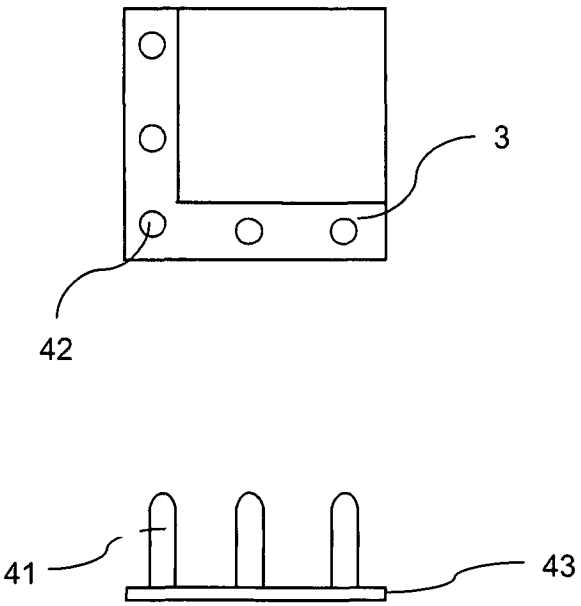

FIG. 30 shows a further embodiment of the auxiliary transport unit with a supporting part 43 and FIG. 31 shows an assembly step for said auxiliary transport unit. The supporting part 43 exhibits connecting parts 41 while the support spar 3 exhibits correspondingly arranged recesses 42 for the connecting parts 41. FIG. 31 shows that the support spar 3 is positioned onto the supporting part 43 such that the connecting parts 41 engage into recesses 42 so as to increase the stability of the auxiliary transport unit.

Figure 32:
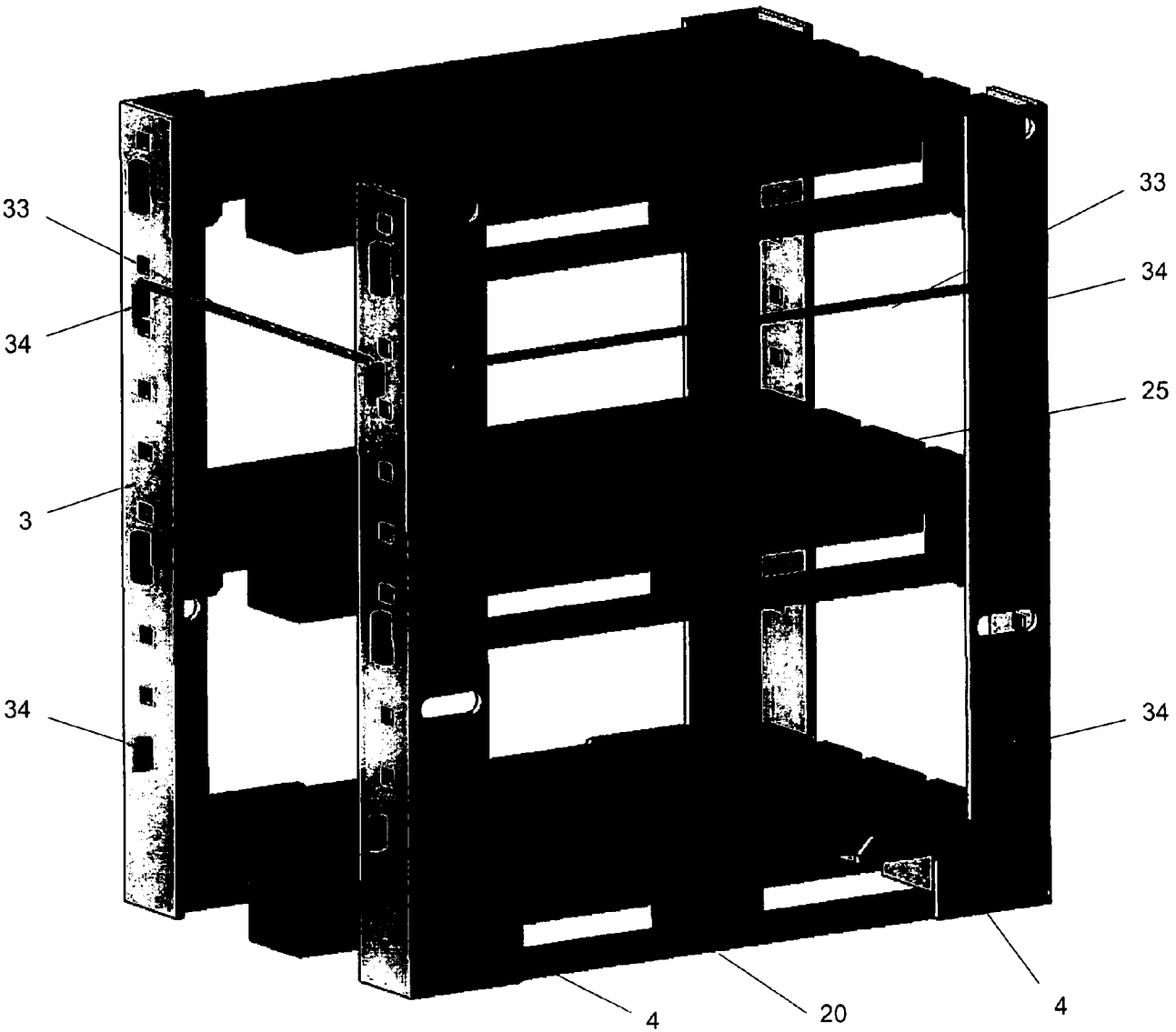
Figure 33:
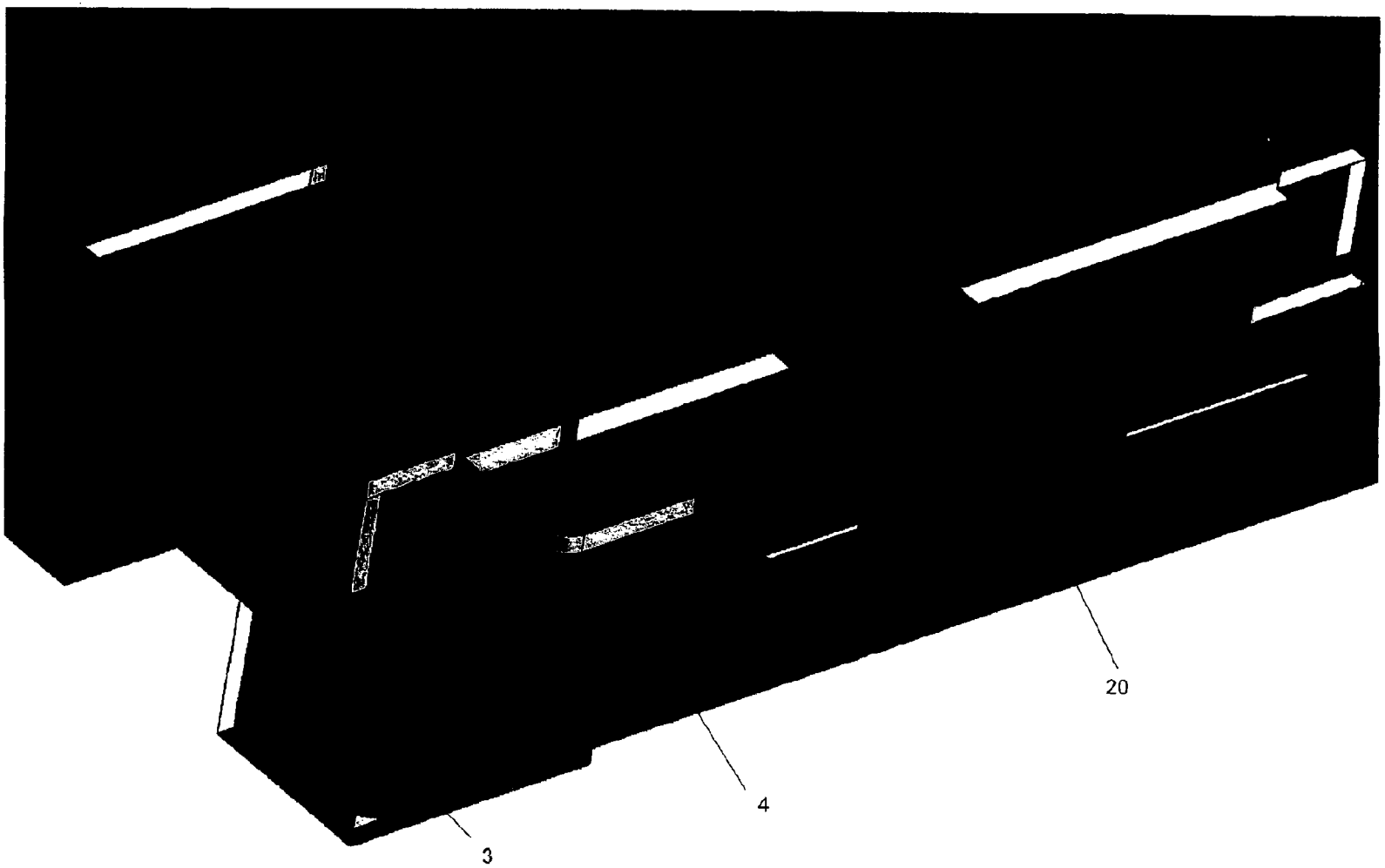
Figure 34:
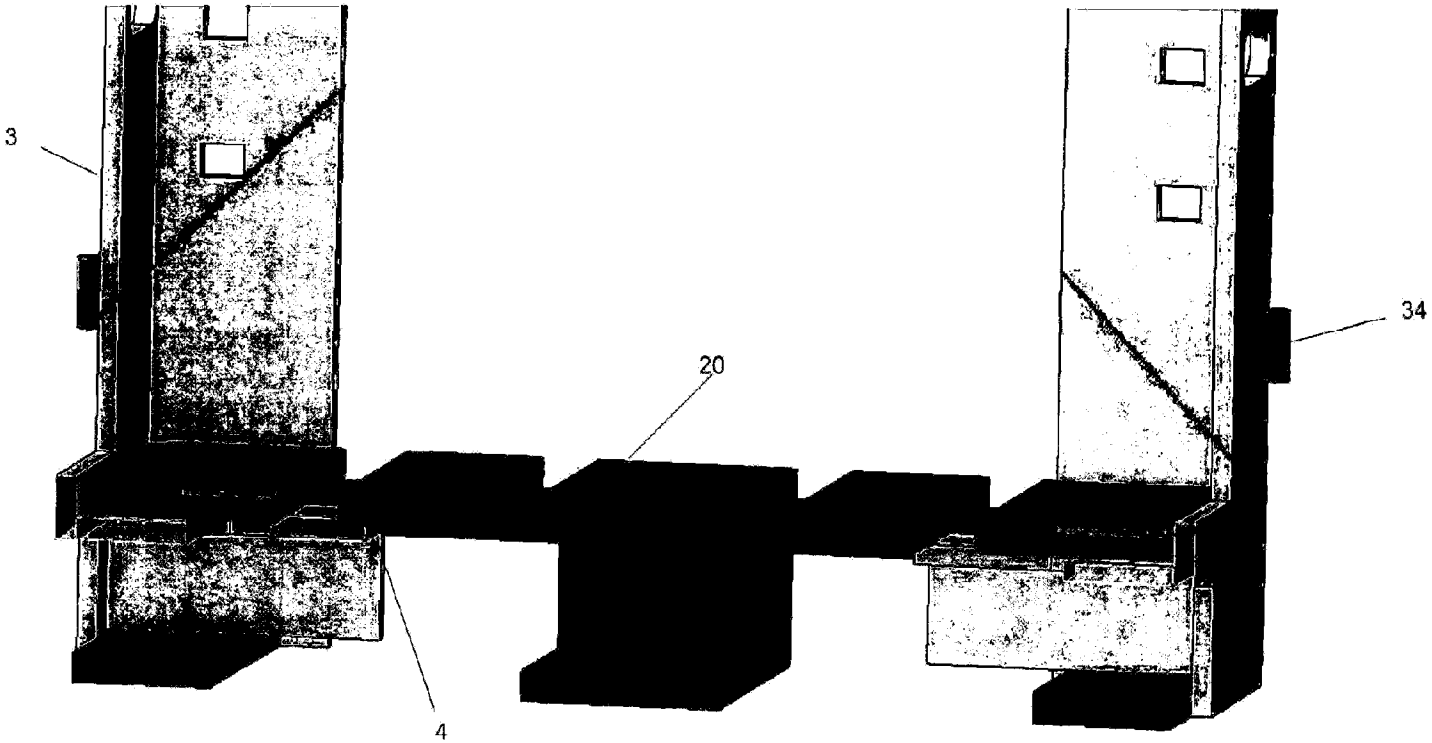
Figure 36:
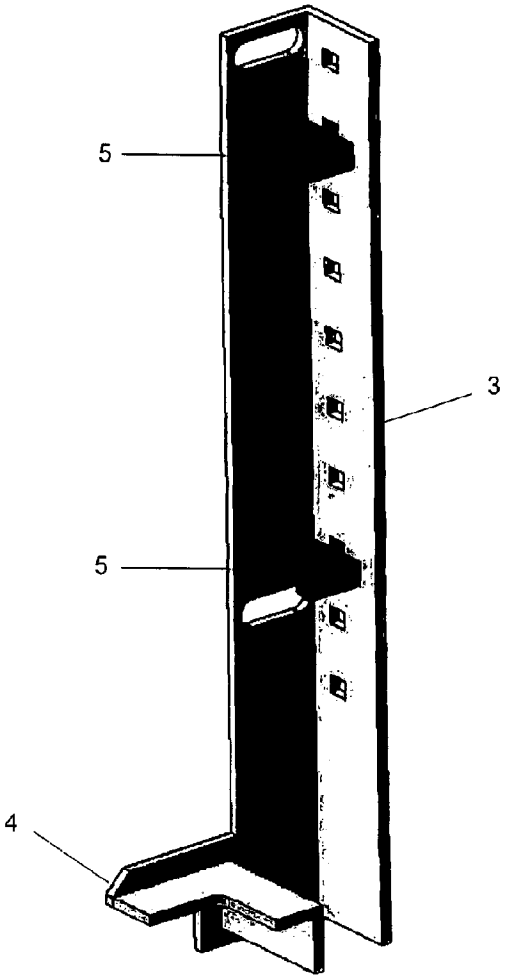
Figure 35:
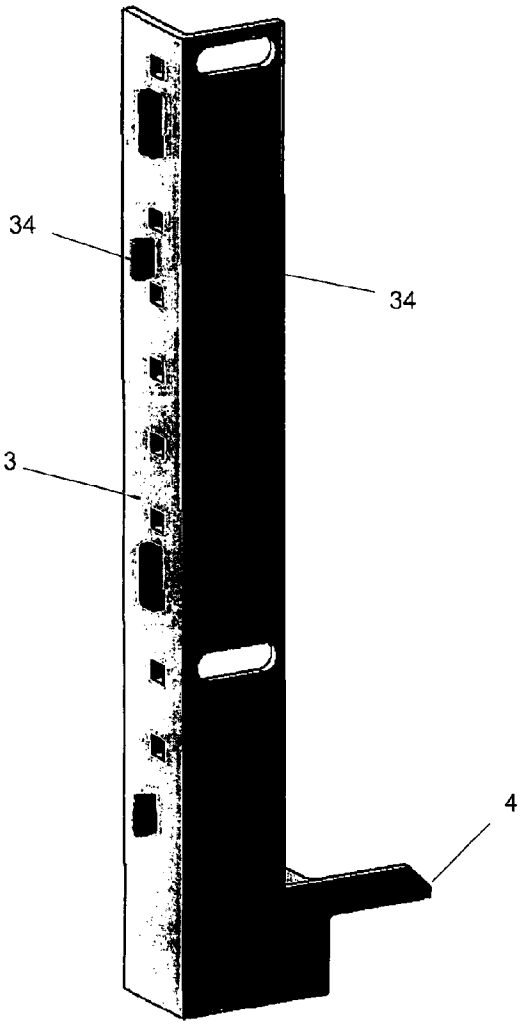

FIG. 32 shows a perspective depiction of a further preferred embodiment of the auxiliary transport unit. FIG. 33 shows a view of the auxiliary transport unit from below and FIG. 34 shows a cross-sectional depiction of said auxiliary transport unit. The present auxiliary transport unit preferably comprises four support spars 3 with connection receiving elements 34, wherein the connection receiving elements 34 are designed to receive a support spar connecting device 33 which can for example be configured as a crossbar having two connecting parts. FIGS. 35 and 36 show perspective views of a support spar 3 of the present auxiliary transport unit, wherein the support spar 3 in this example exhibits four connection receiving elements 34 arranged on its exterior and two preferably releasably affixed retaining devices 5 arranged on its interior.

Figure 37:
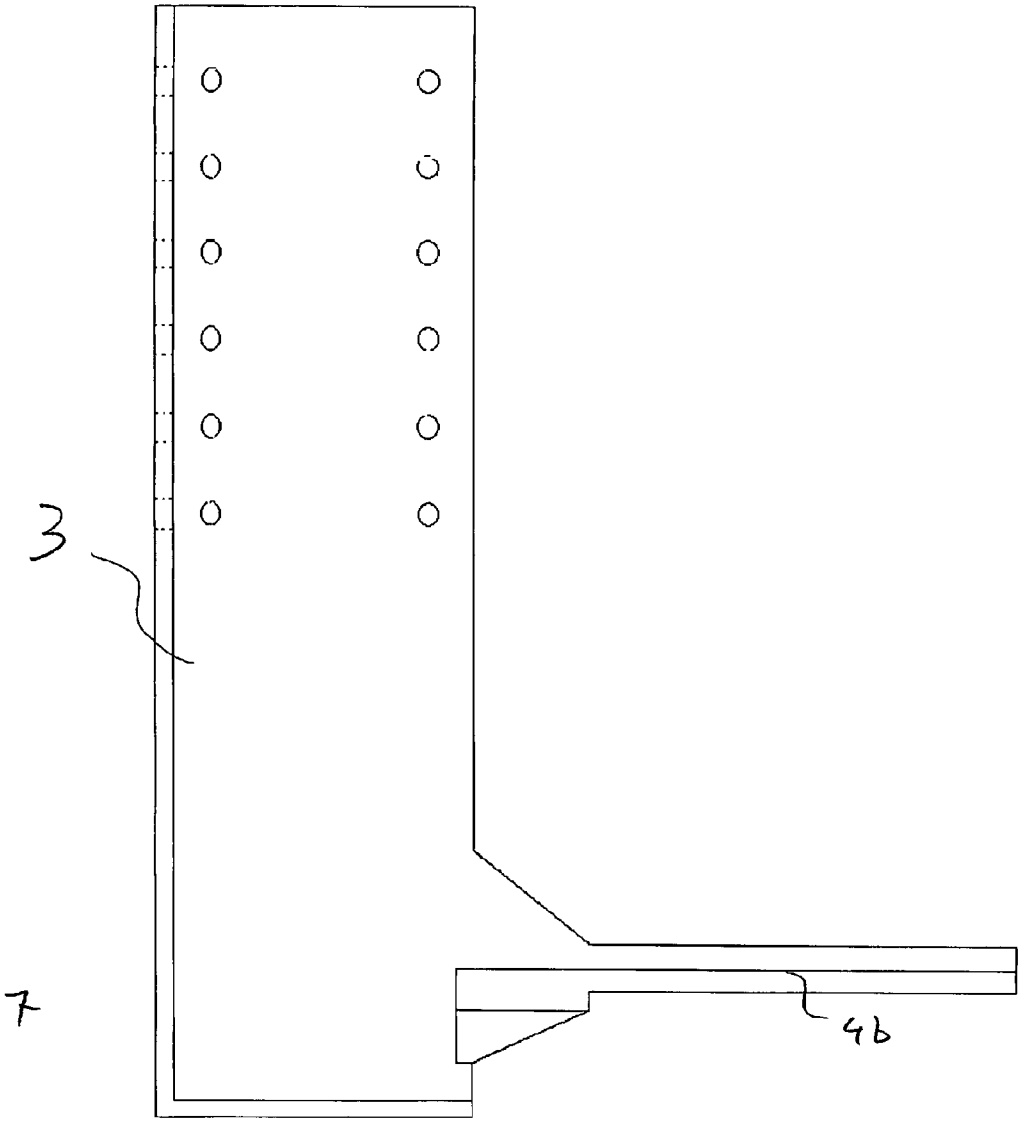
Figure 38:
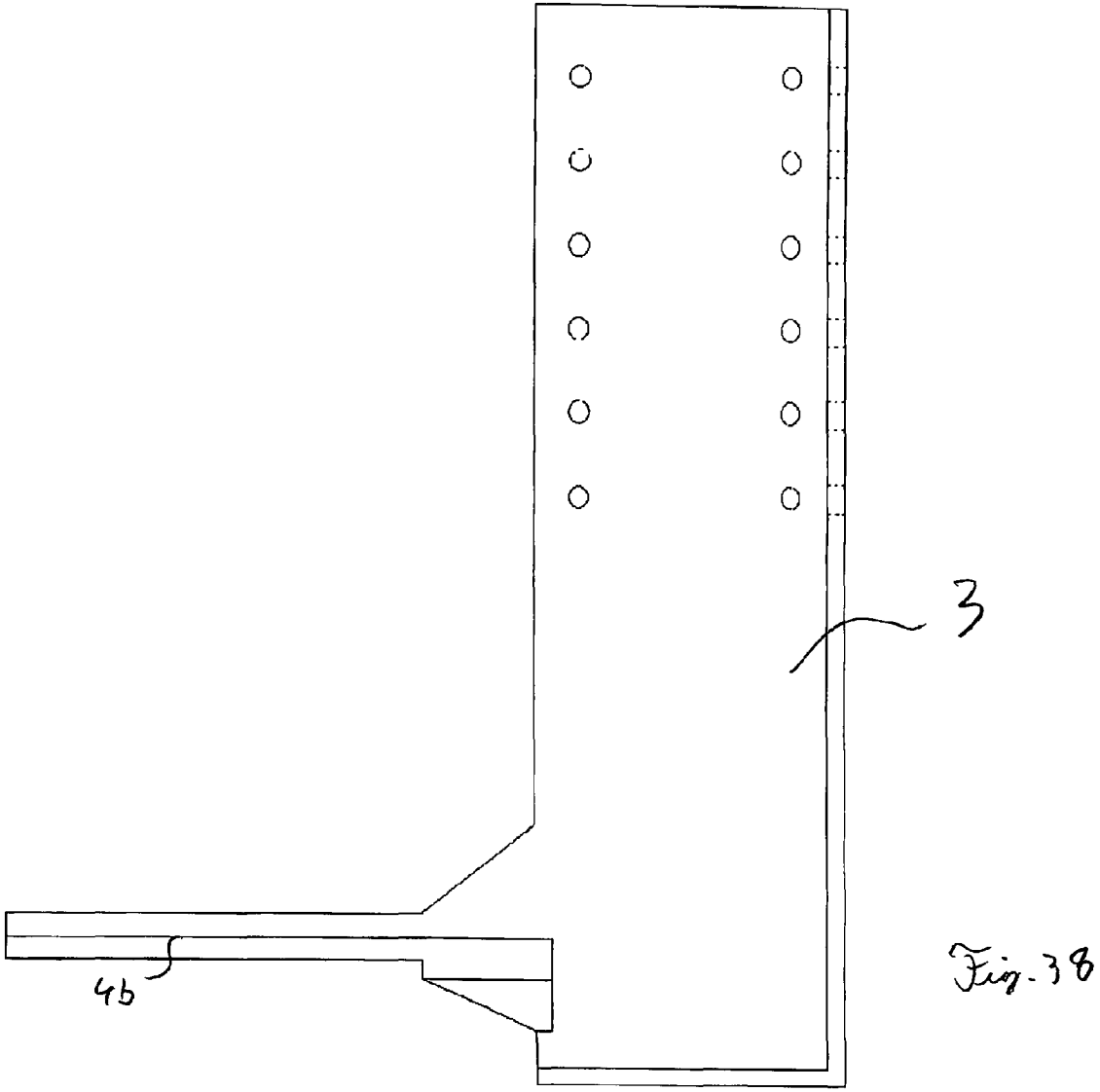

FIGS. 37 and 38 show a further embodiment of a support spar 3 having a connecting device arranged on the right or left side which comprises at least one rod-shaped horizontal support surface 4*b*. The rod-shaped horizontal support surface 4*b* preferably has a height of approximately 21 mm.

Figure 39:
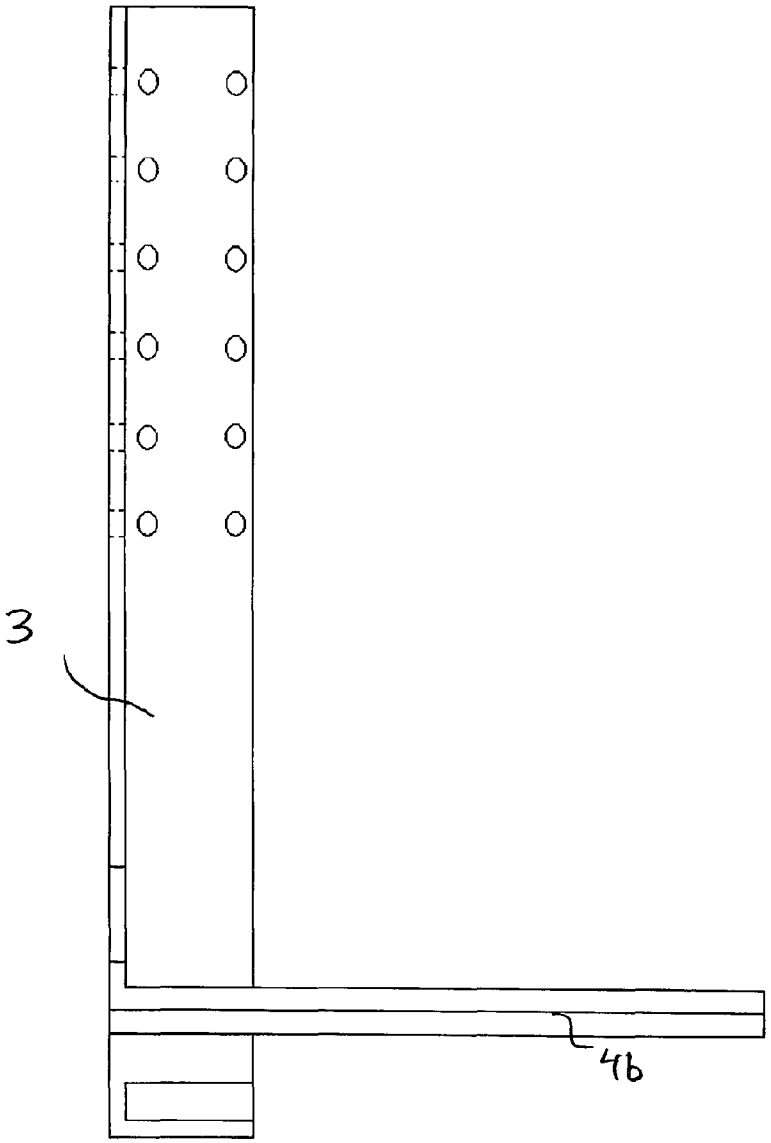
Figure 40:
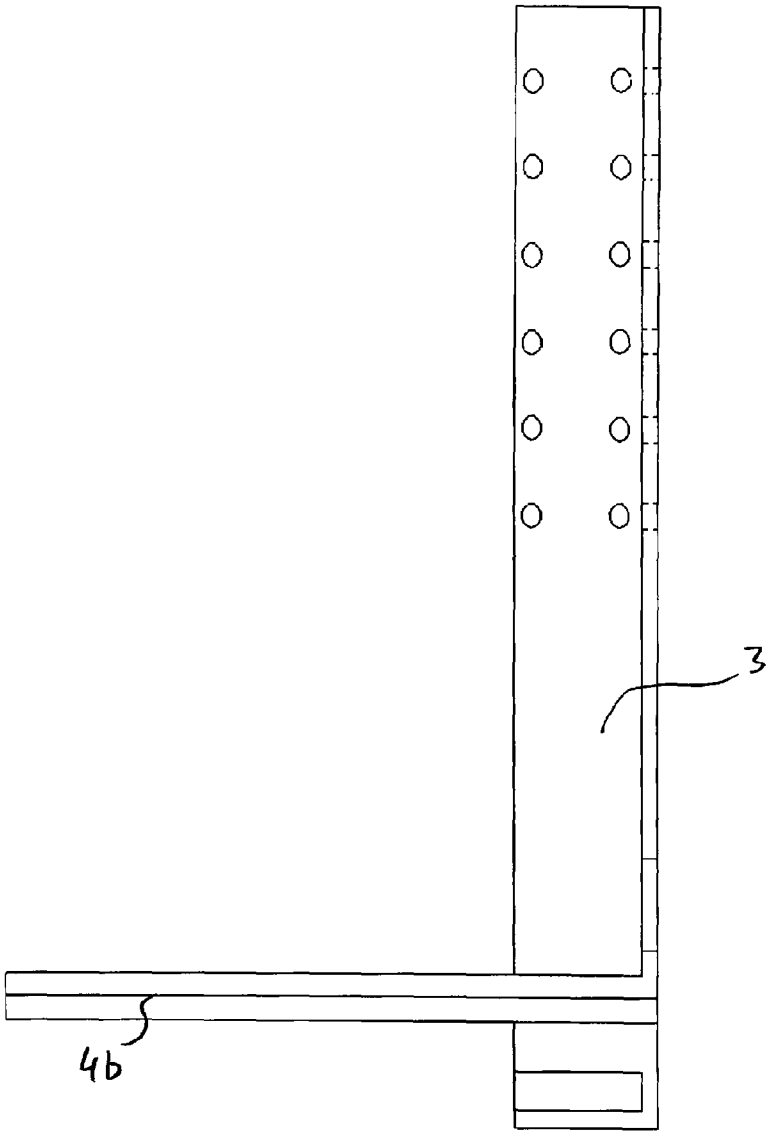

FIGS. 39 and 40 further show yet another embodiment of a support spar 3 having a connecting device arranged on the right or left side which comprises at least one rod-shaped horizontal support surface 4*b*.

Figure 42:
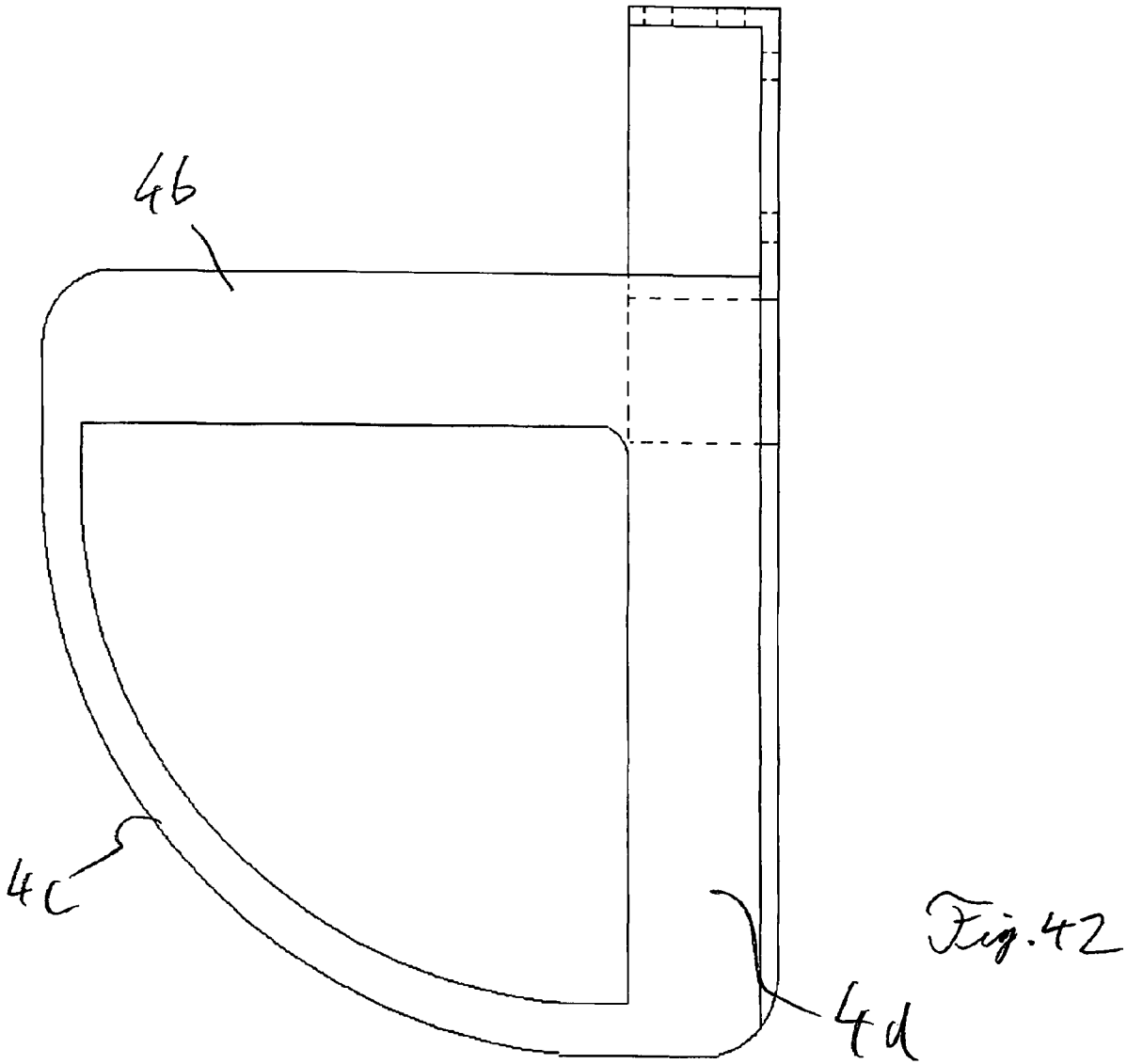

FIGS. 41 and 42 show plan views of a further embodiment of a support spar 3 having a connecting device arranged on the right or left side which comprises two rod-shaped horizontal support surfaces 4*b*, 4*d* and one arched support surface 4*c*. The first rod-shaped horizontal support surface 4*b* is preferably at an approximate 90° angle to support spar 3, while the second rod-shaped horizontal support surface 4*d* is configured horizontally along said support spar. The arched support surface 4*c* connects the two ends of the two rod-shaped horizontal support surfaces 4*b*, 4*d*. The arched support surface 4*c* is preferably of chamfered design, whereby easier pallet insertion becomes possible. The first rod-shaped horizontal support surface 4*b* in this embodiment preferably exhibits a length of approximately 300 mm and the second rod-shaped horizontal support surface 4*d* exhibits a length of approximately 310 mm.

Figure 43:
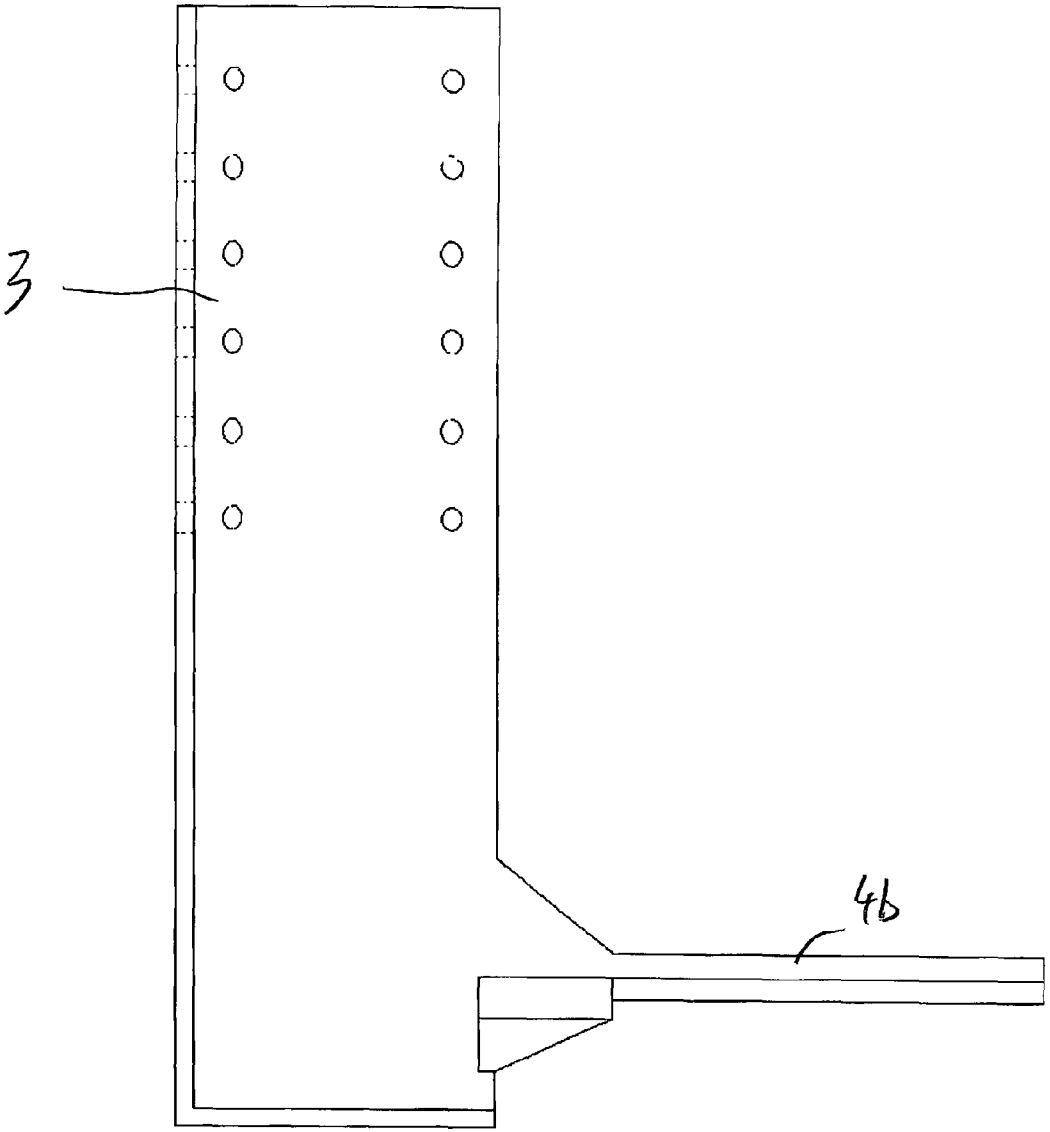
Figure 44:
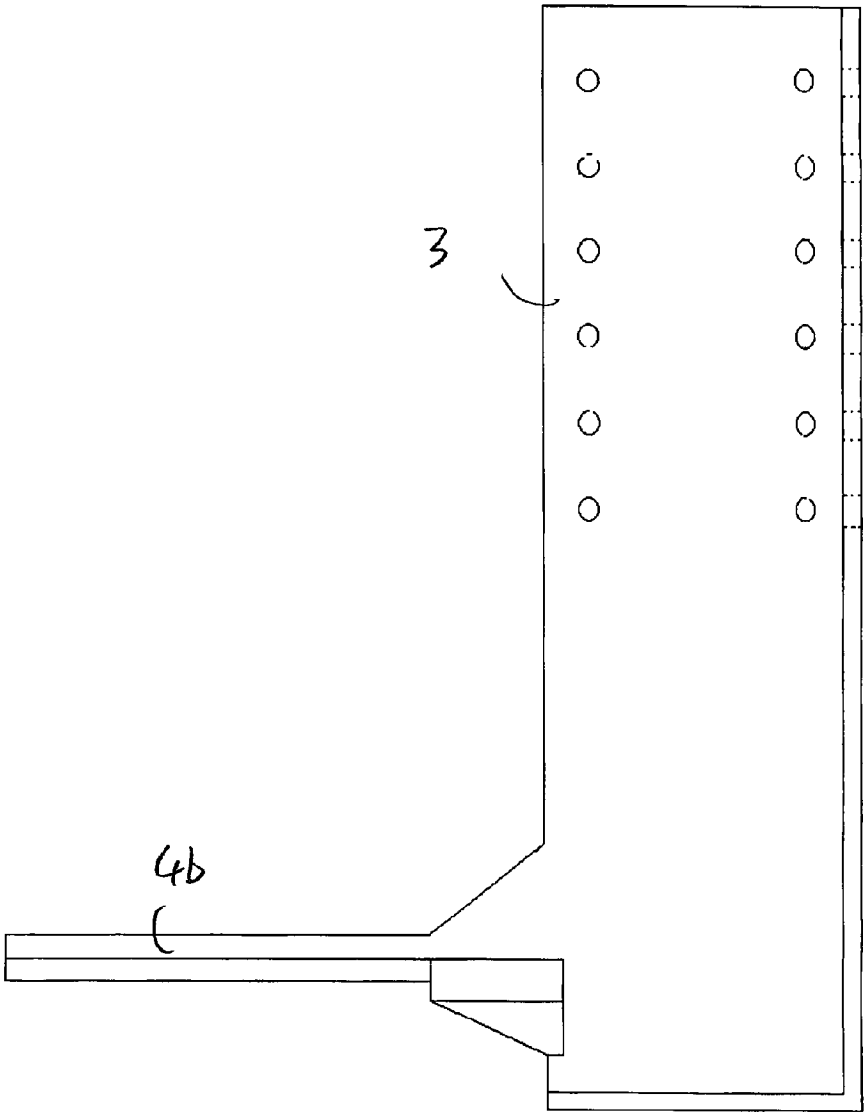

FIGS. 43 and 44 show yet another embodiment of a support spar 3 having a connecting device arranged on the right or left side which comprises at least one rod-shaped horizontal support surface 4*b*.

Figure 45:
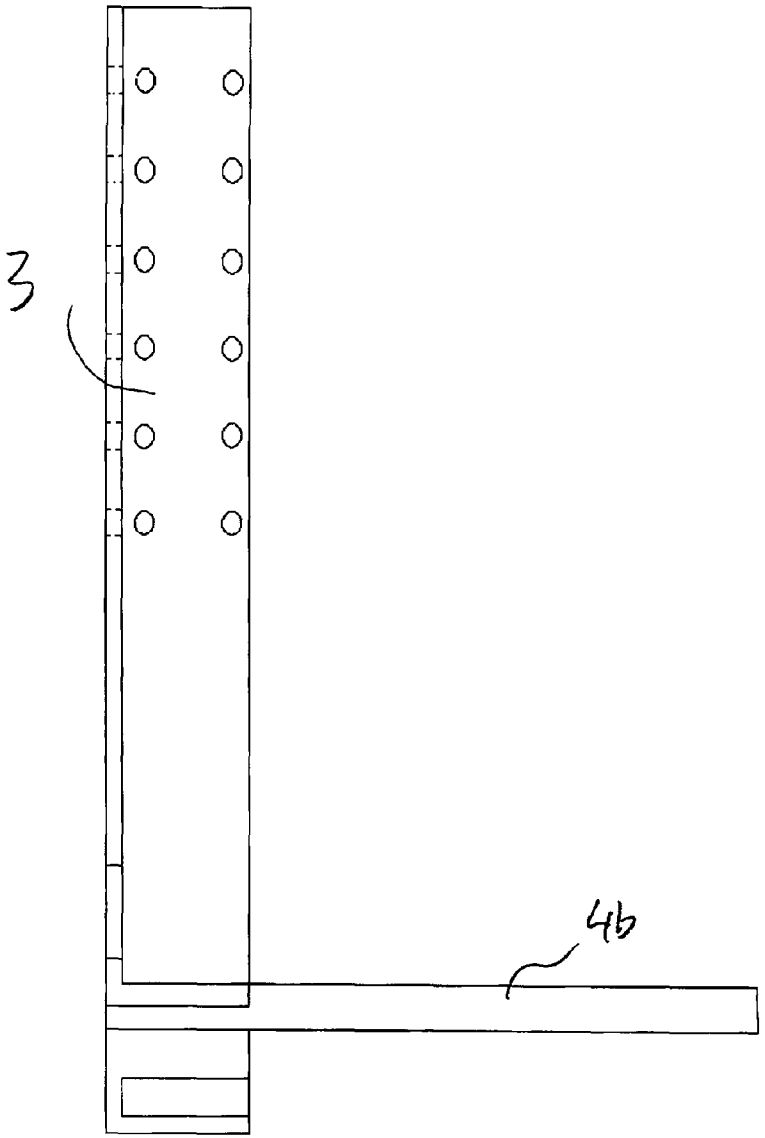
Figure 46:
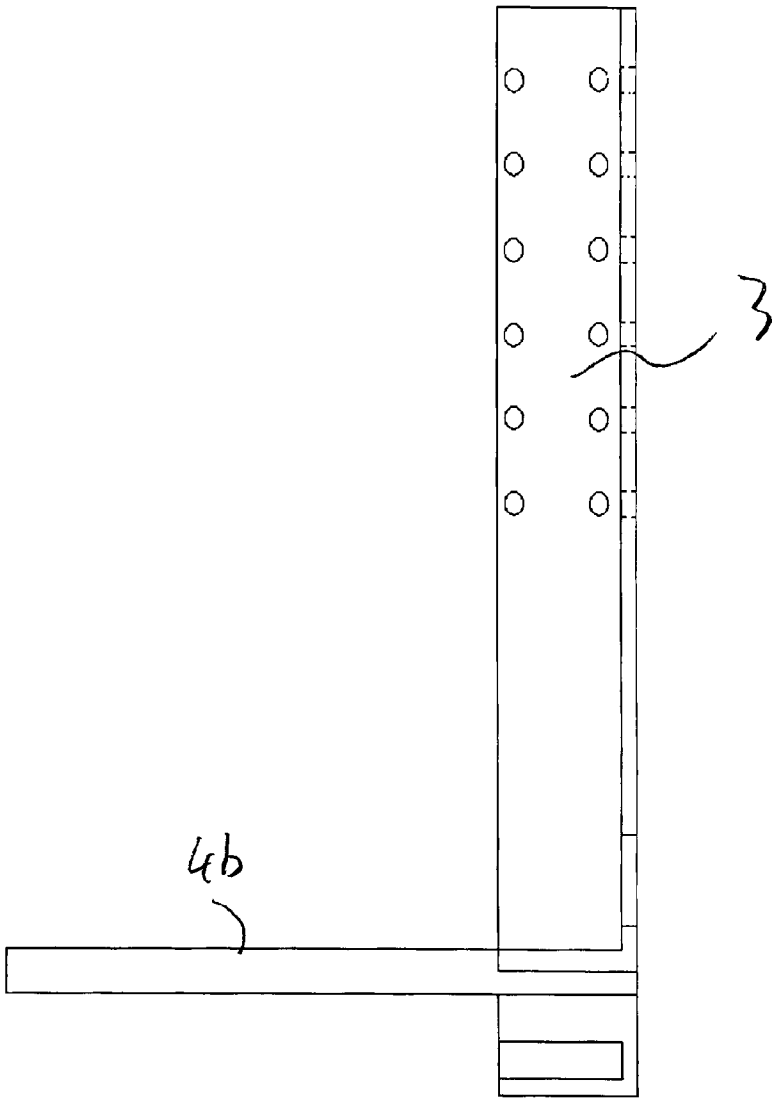
Figure 47:
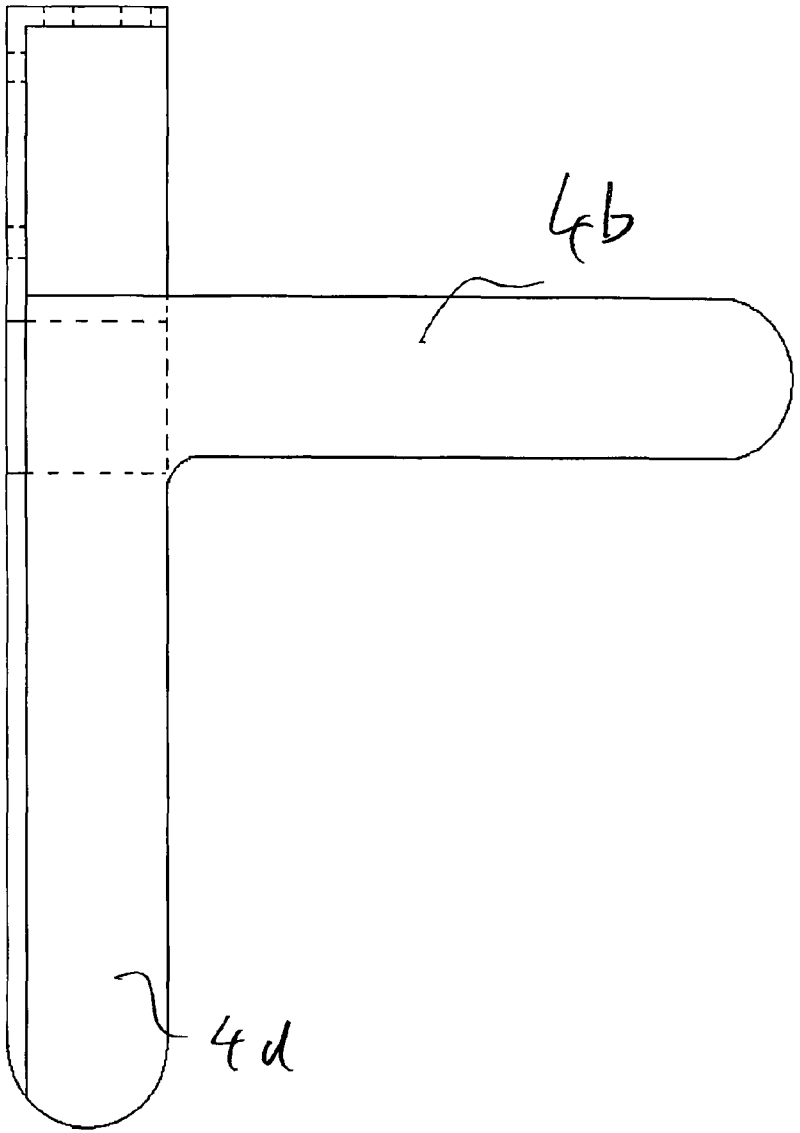

FIGS. 45 and 46 further show yet another embodiment of a support spar 3 having a connecting device arranged on the right or left side which comprises at least one rod-shaped horizontal support surface 4*b*.

Figure 47:
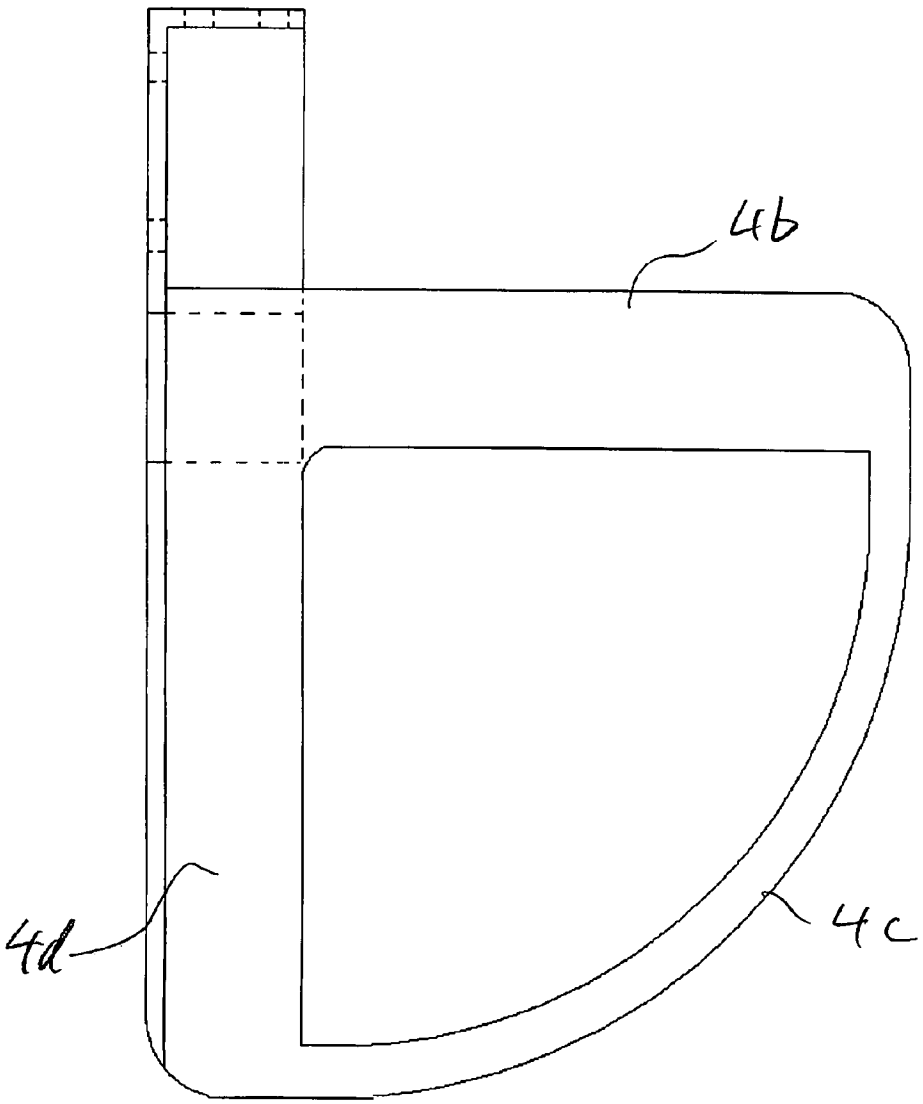
Figure 48:
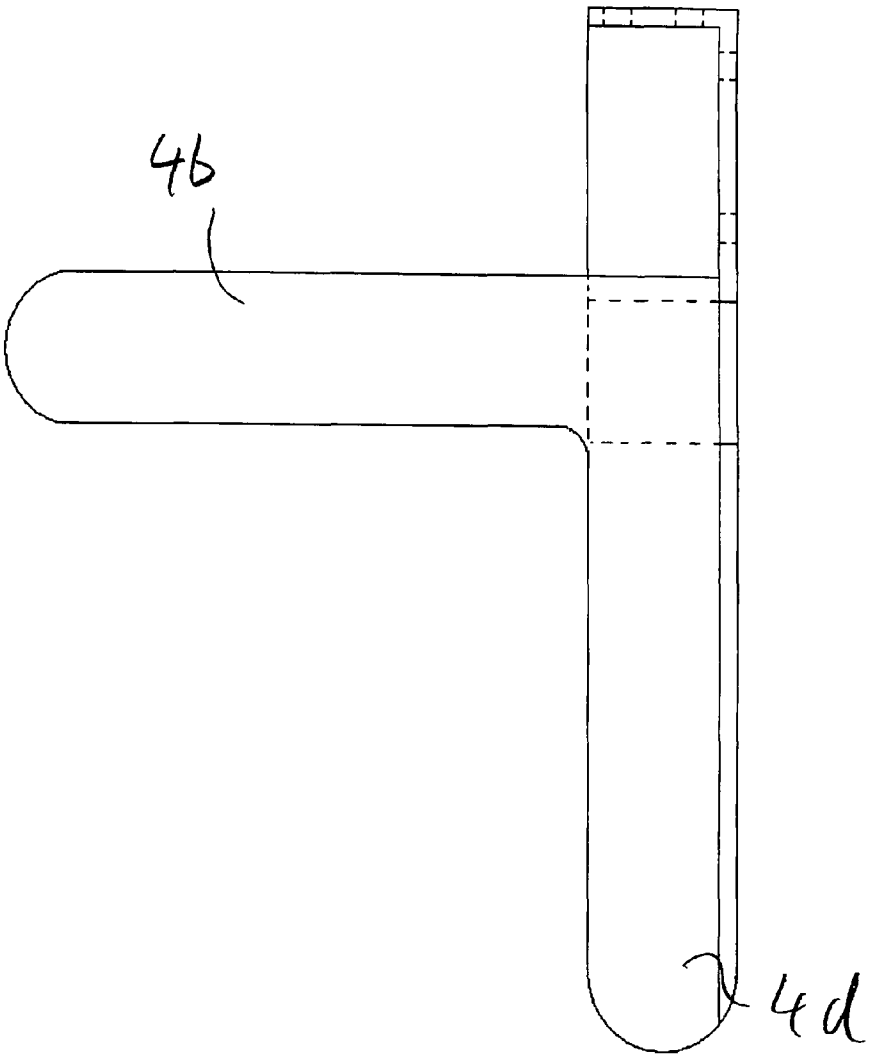

FIGS. 47 and 48 show plan views of a further embodiment of a support spar 3 having a connecting device arranged on the right or left side and comprising two rod-shaped horizontal support surfaces 4*b*, 4*d*. The first rod-shaped horizontal support surface 4*b* is preferably at an approximate 90° angle to support spar 3, while the second rod-shaped horizontal support surface 4*d* is configured horizontally along said support spar. The first rod-shaped horizontal support surface 4*b* in this embodiment preferably exhibits a length of approximately 285 mm and the second rod-shaped horizontal support surface 4*d* exhibits a length of approximately 310 mm.

The support spars 3 preferably have a wall thickness of less than 22 mm. It is further preferable for the support spars 3 to exhibit a height of approximately 1.3 m.

Figure 49:
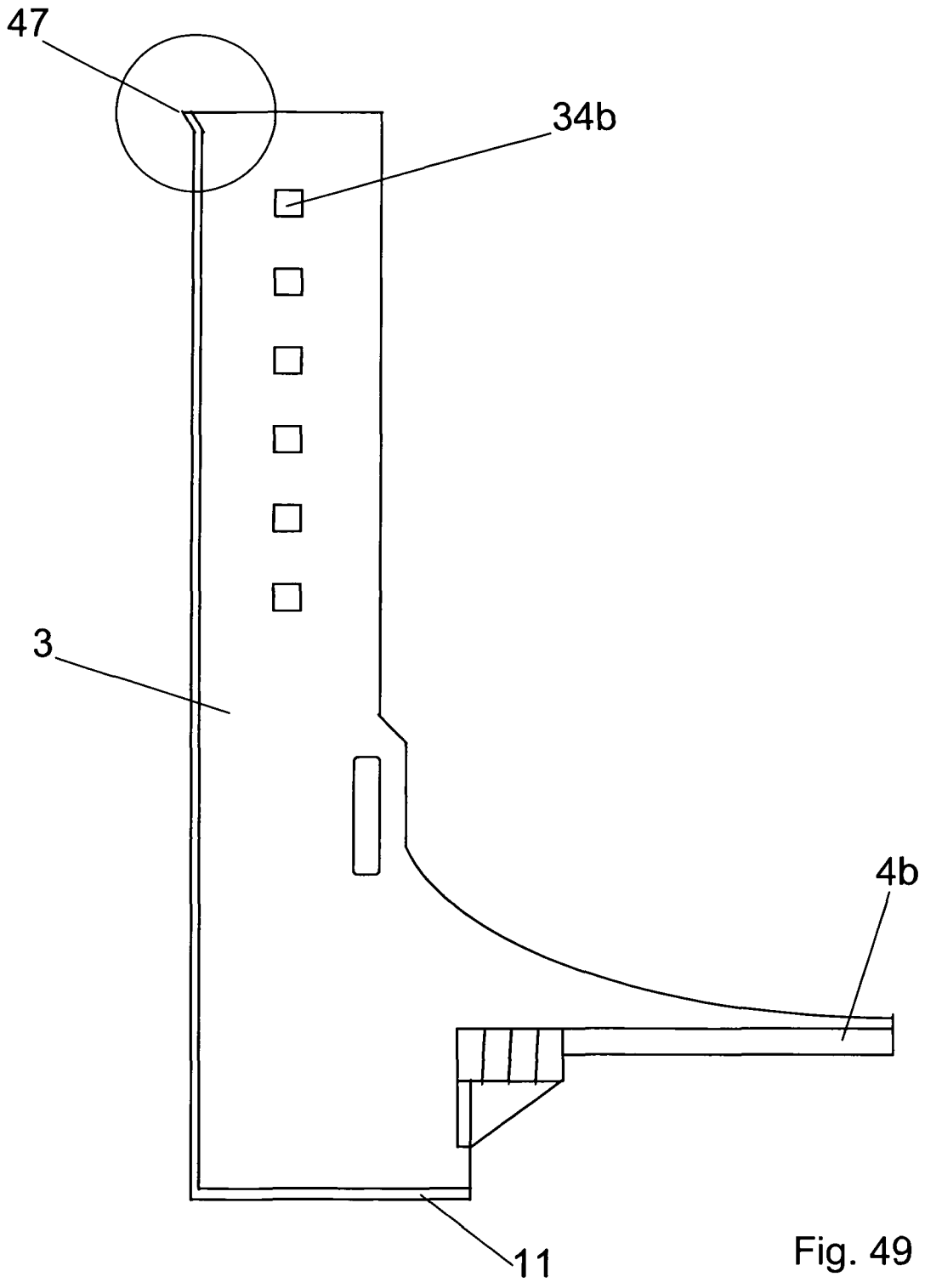
Figure 50:
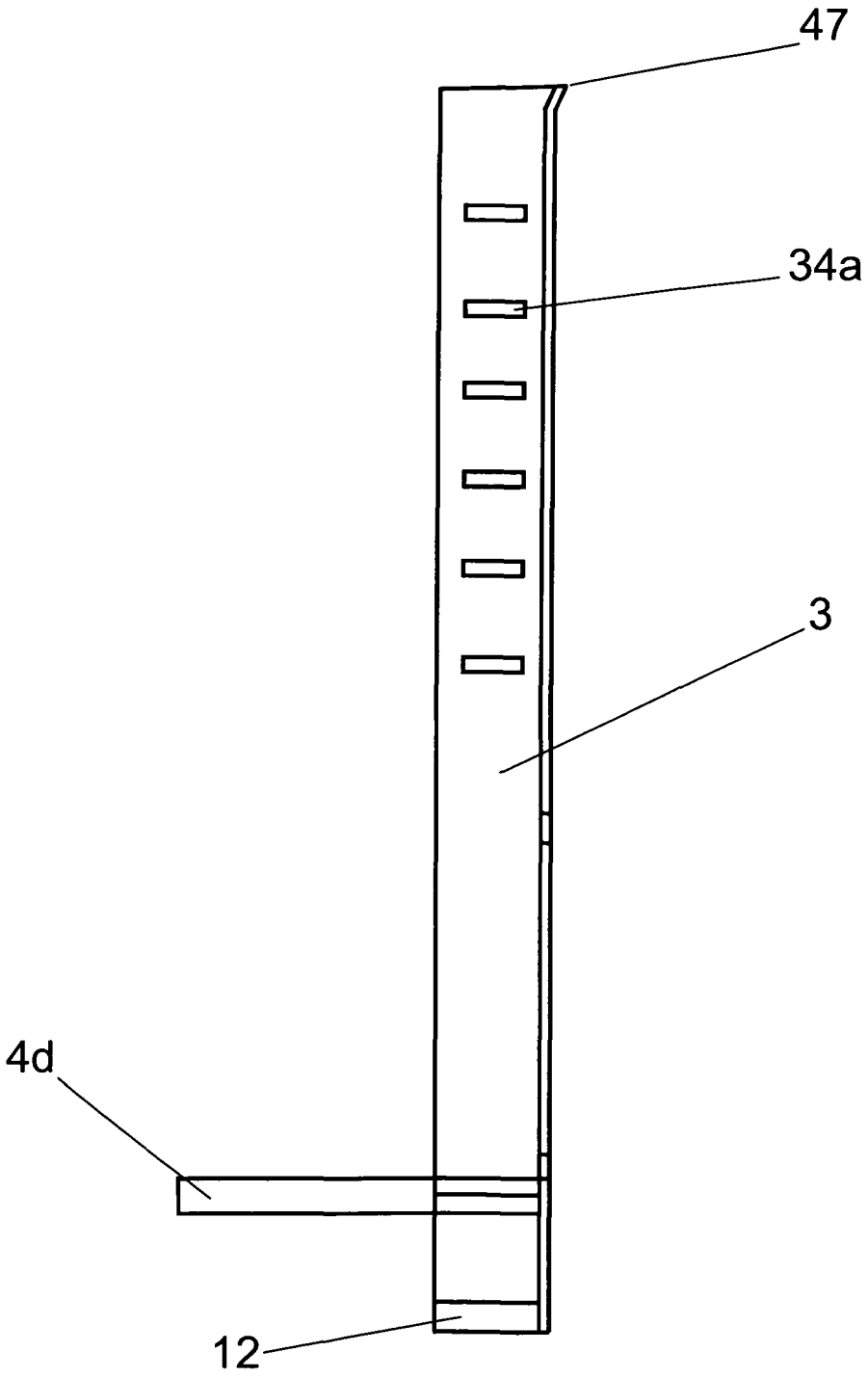
Figure 51:
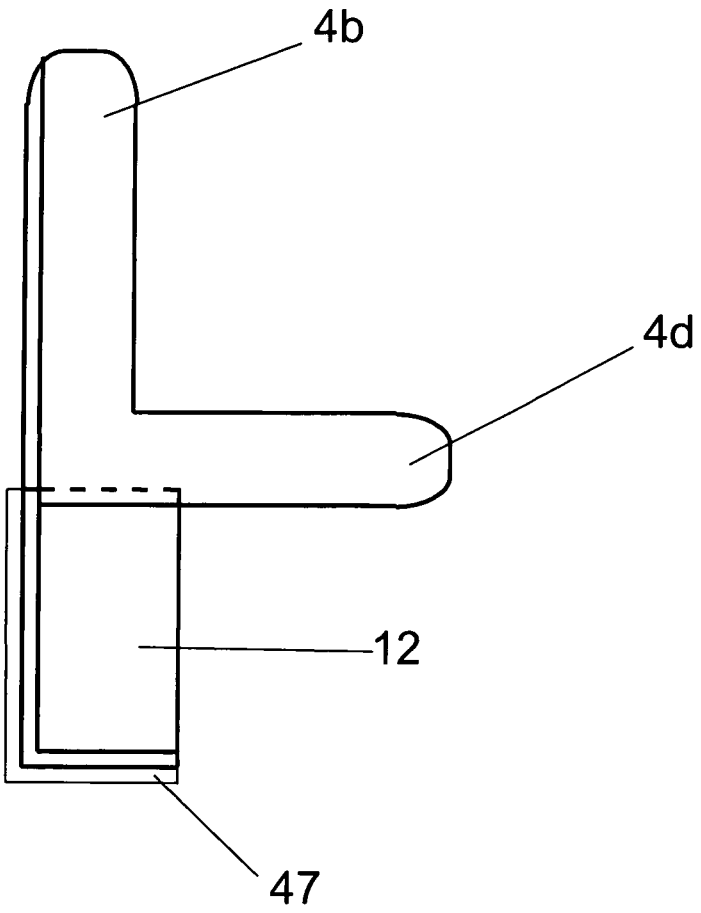
Figure 52:
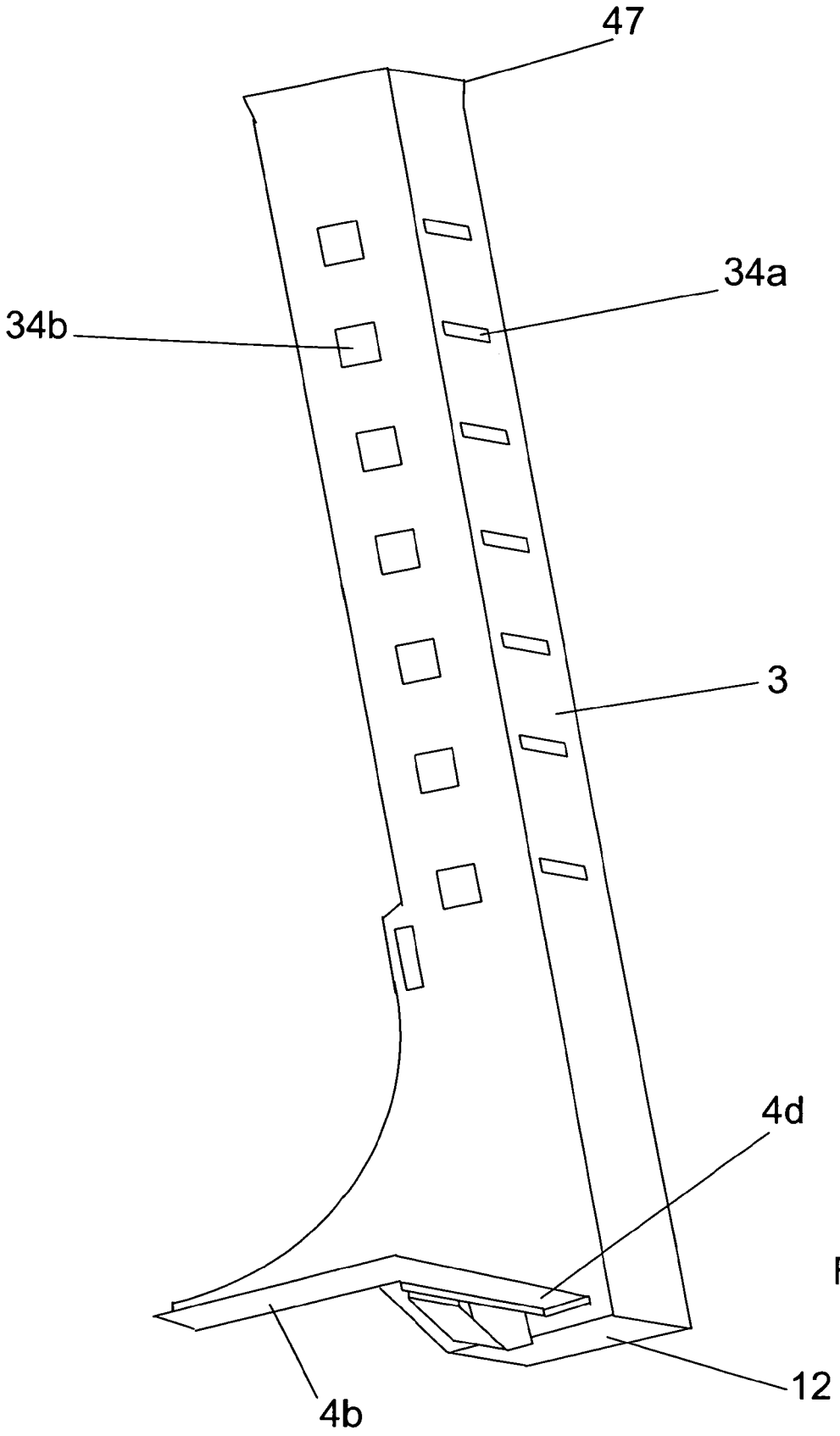

FIGS. 49 to 52 show a further embodiment of a support spar 3 exhibiting a base plate 12 having an upper edge section 47 which is flared to facilitate the introduction of the pallet when stacking, wherein FIG. 49 shows a front view of said support spar 3, FIG. 50 shows a side view of said support spar 3, FIG. 51 shows a plan view of said support spar 3, and FIG. 52 shows a perspective depiction of said support spar 3, with reference being made to the respective parts of the description for the features addressed in the preceding embodiments so as to avoid repetition. The upper edge section 47 preferably has a height of approximately 50 mm.

Figure 53:
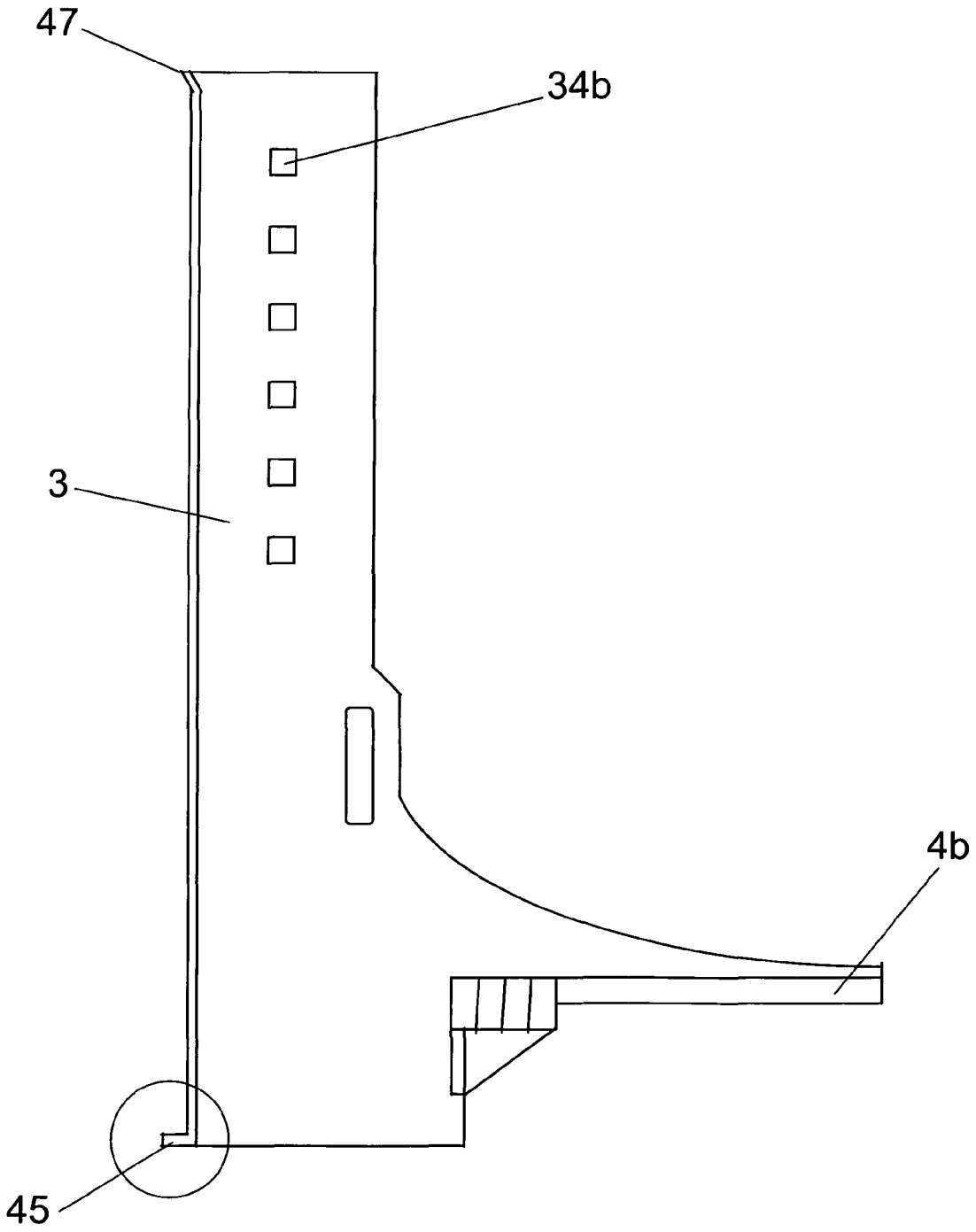
Figure 54:
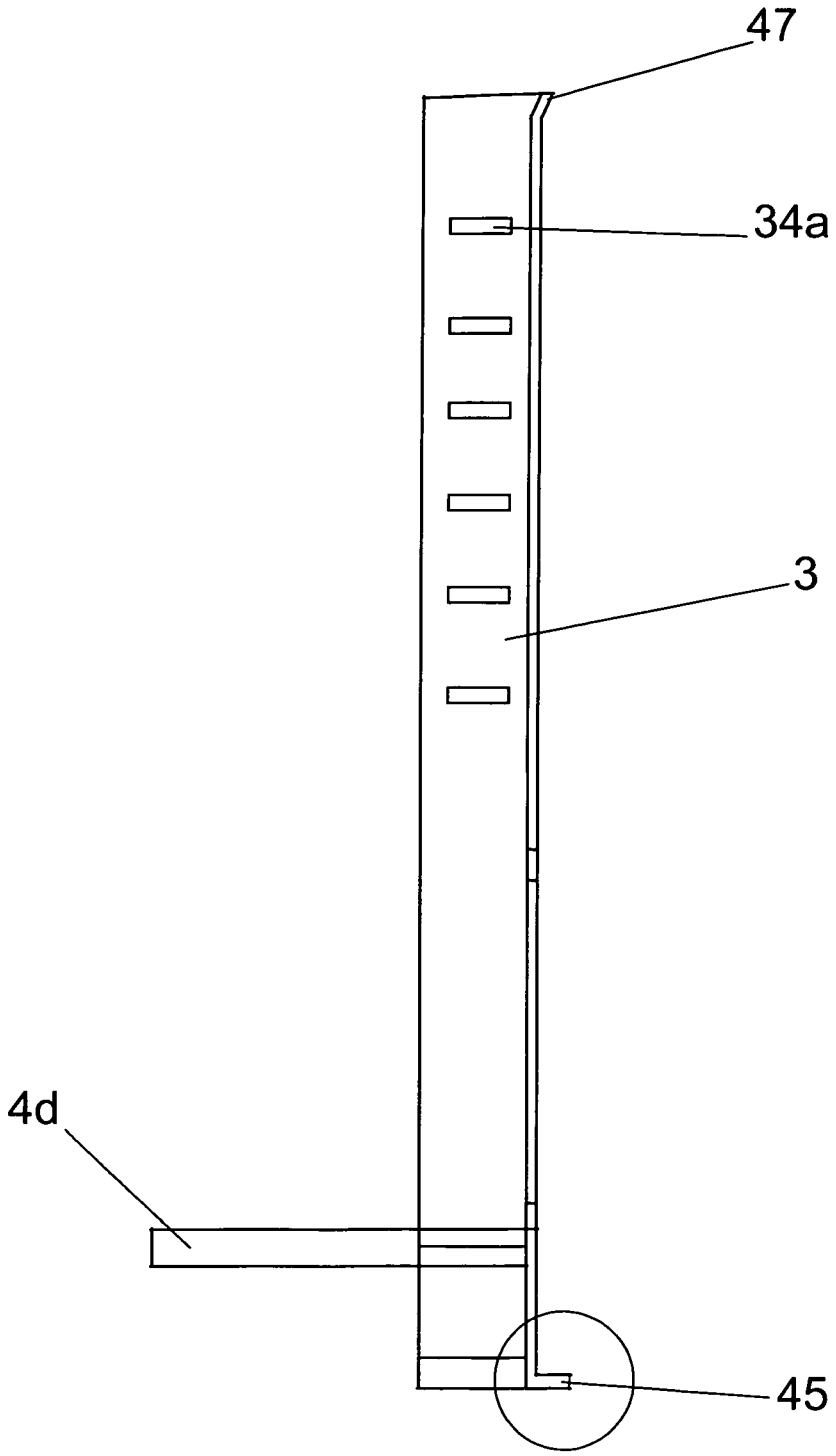
Figure 55:
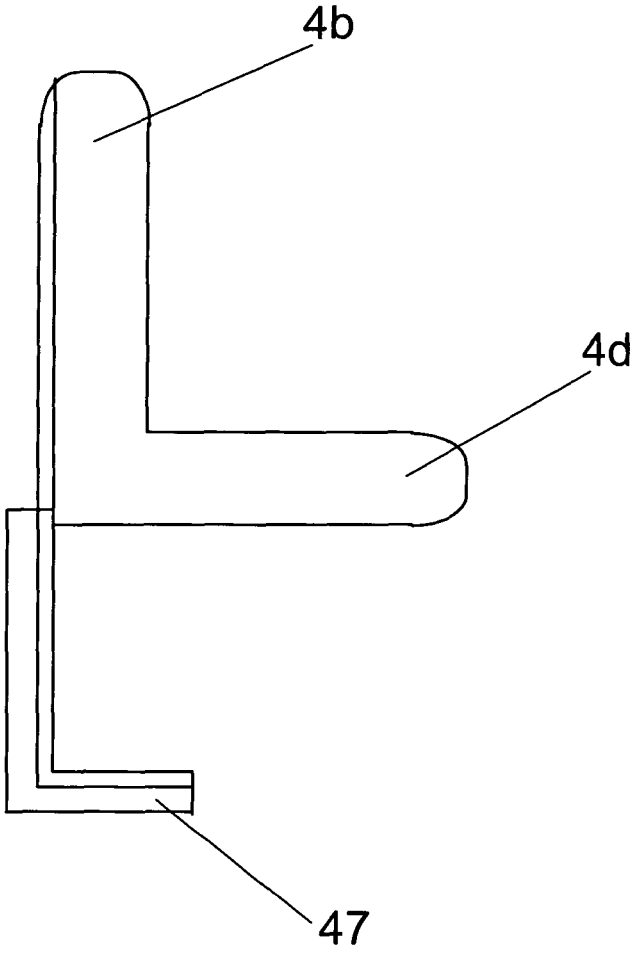
Figure 56:
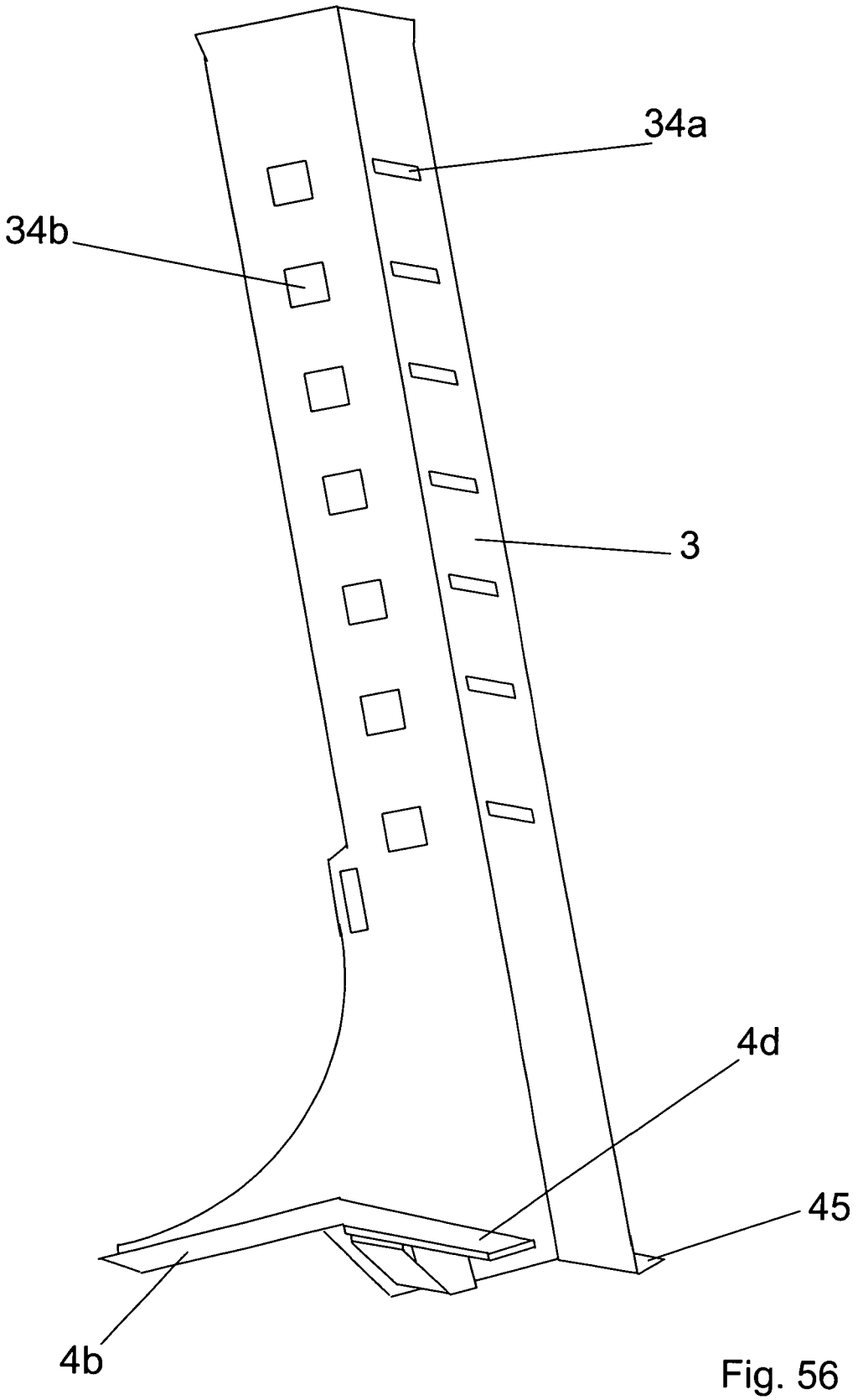

FIGS. 53 to 56 show a further embodiment of a support spar 3 without a base plate comprising an upper edge section 47 which is flared to facilitate the introduction of the pallet when stacking, wherein FIG. 53 shows a front view of said support spar 3, FIG. 54 shows a side view of said support spar 3, FIG. 55 shows a plan view of said support spar 3, and FIG. 56 shows a perspective depiction of said support spar 3, with reference being made to the respective parts of the description for the features addressed in the preceding embodiments so as to avoid repetition. As can be noted from FIGS. 53 to 56, the support spar 3 comprises a stand support 45 at its base, preferably arranged on the exterior, whereby the force caused by the weight of the pallets can be better distributed at the base and overloading of the lower edges of the support spar 3 prevented.

Figure 57:
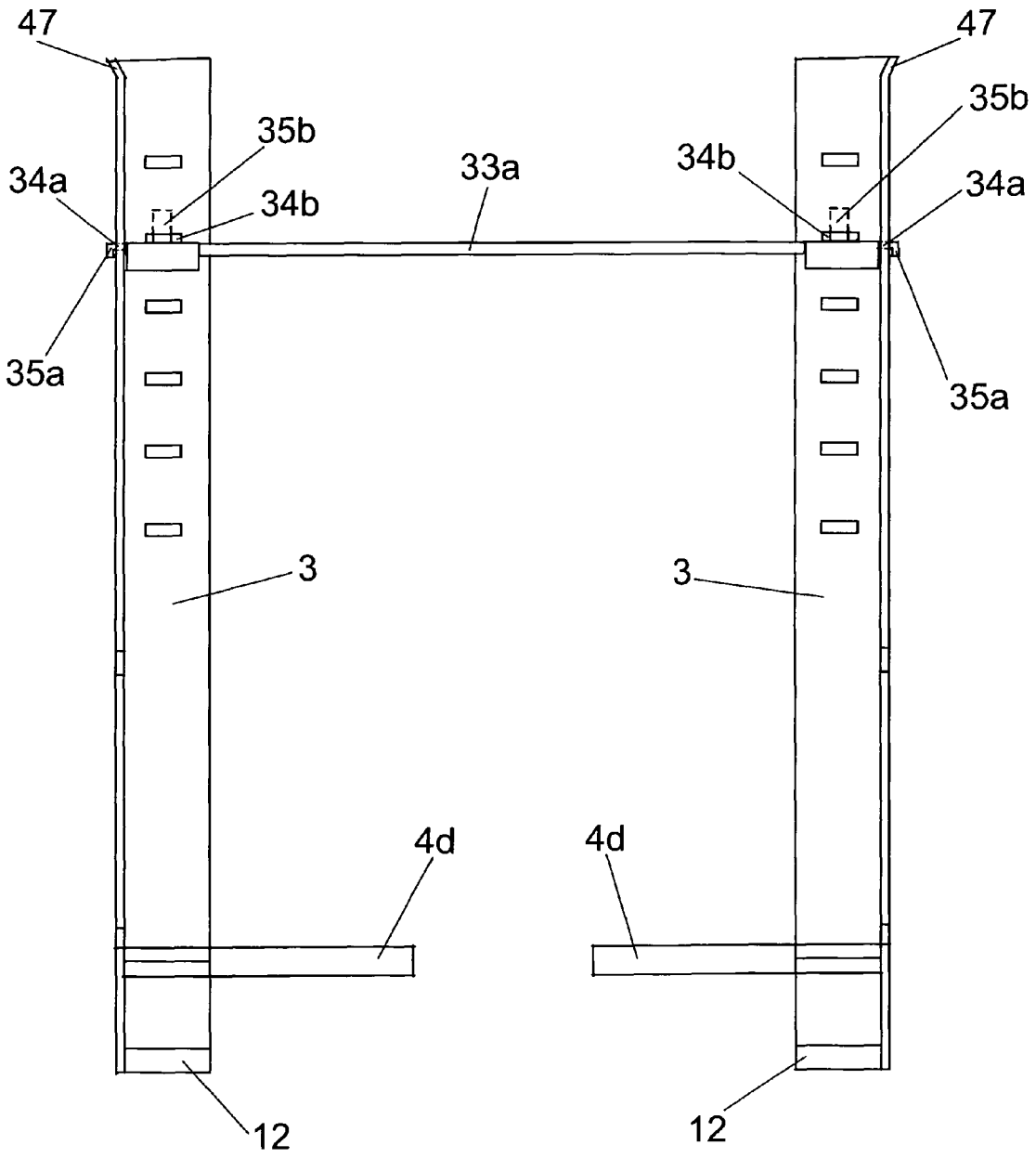
Figure 59:
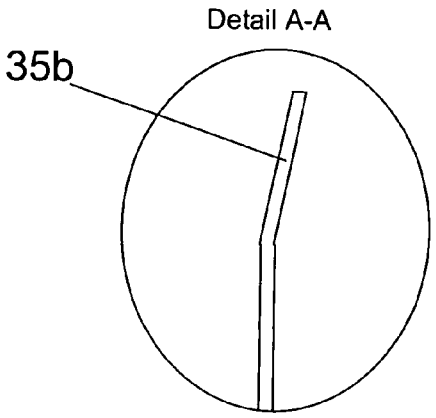
Figure 58:
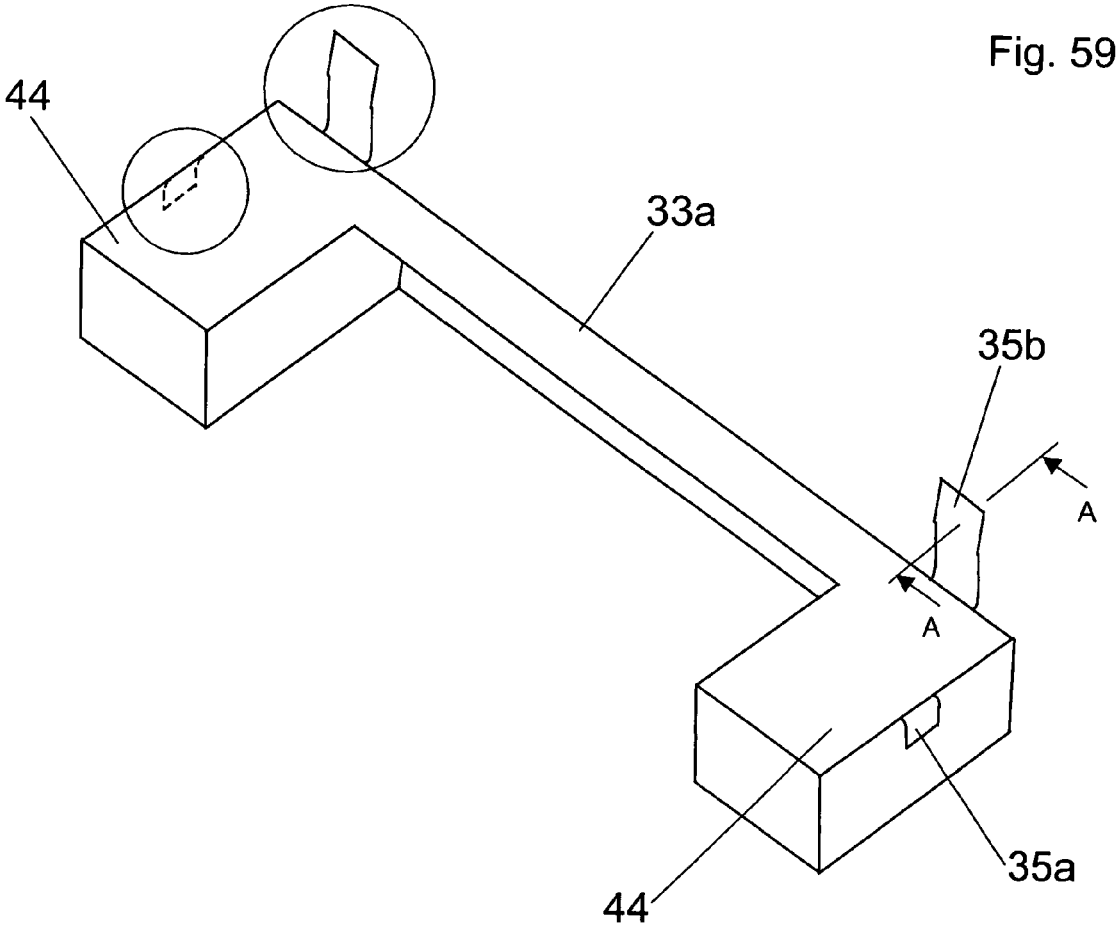

FIGS. 57 to 59 show a further embodiment for connecting two support spars, wherein FIG. 57 shows a perspective depiction of the support spar connecting device 33*a* having a first connecting part 35*a* and a second connecting part 35*b*, FIG. 58 shows a detail of said second connecting part 35*b*, and FIG. 59 shows the connection of two support spars 3 by means of the support spar connecting device 33*a*, with reference being made to the respective parts of the description for the features addressed in the preceding embodiments so as to avoid repetition. As can be seen in FIGS. 57 to 59, the support spar connecting device 33*a* can comprise two end regions 44 having a first connecting part 35*a* and a second connecting part 35*b* on their outer longitudinal ends. To connect the support spars 3, the first connecting part 35*a* can be inserted into a first connecting part receiving element 34*a* and the second connecting part 35*b* into a second connecting part receiving element 34*b*. The end regions 44 are preferably designed to bear on the support spar and the first connecting part 35*a* and the second connecting part 35*b* are preferably arranged on different bearing surfaces of the end regions 44.

Figure 60:
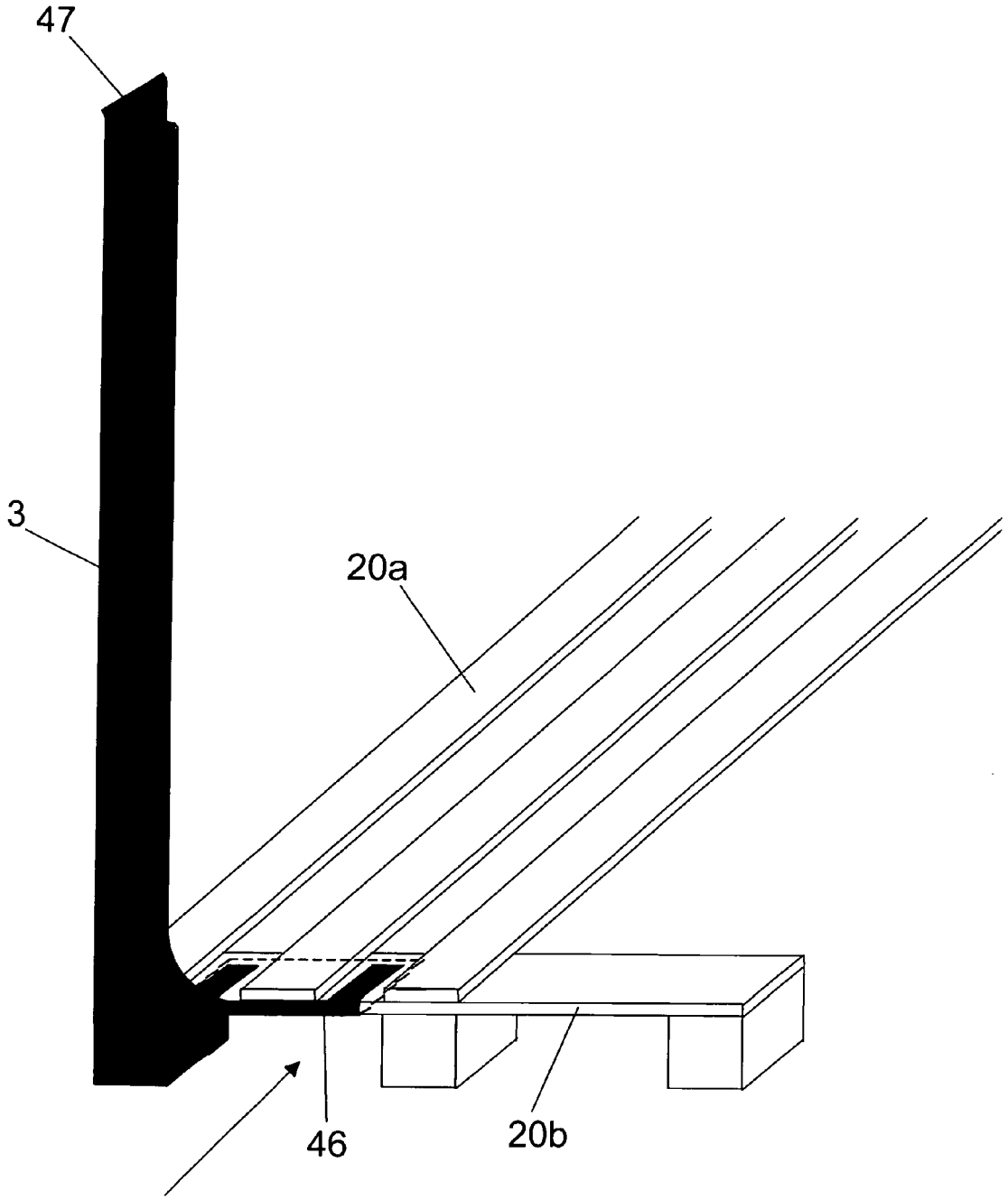
Figure 61:
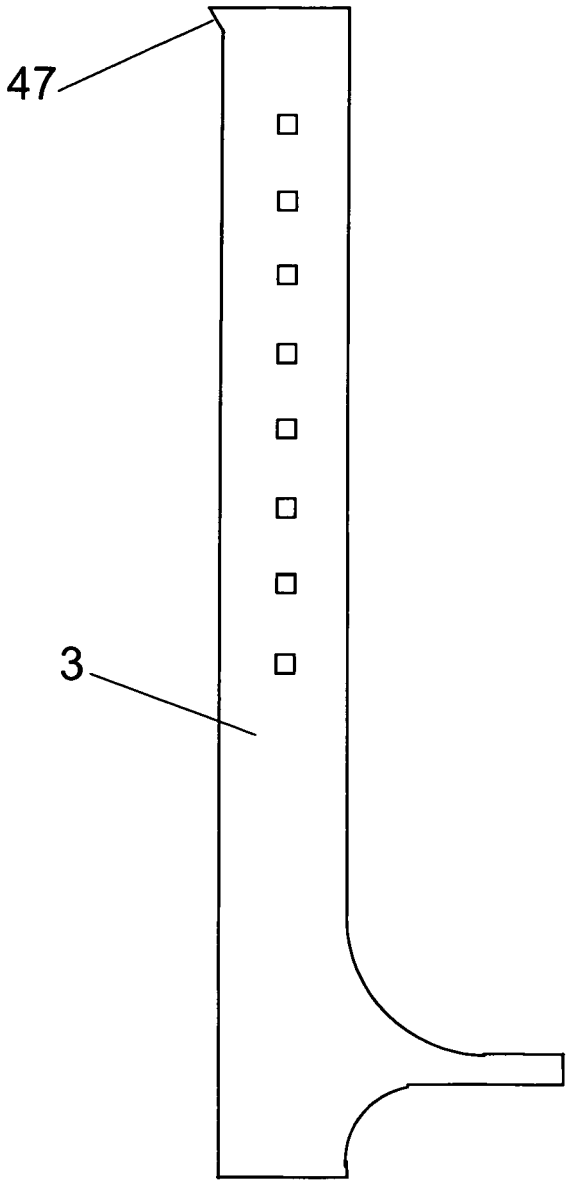
Figure 62:
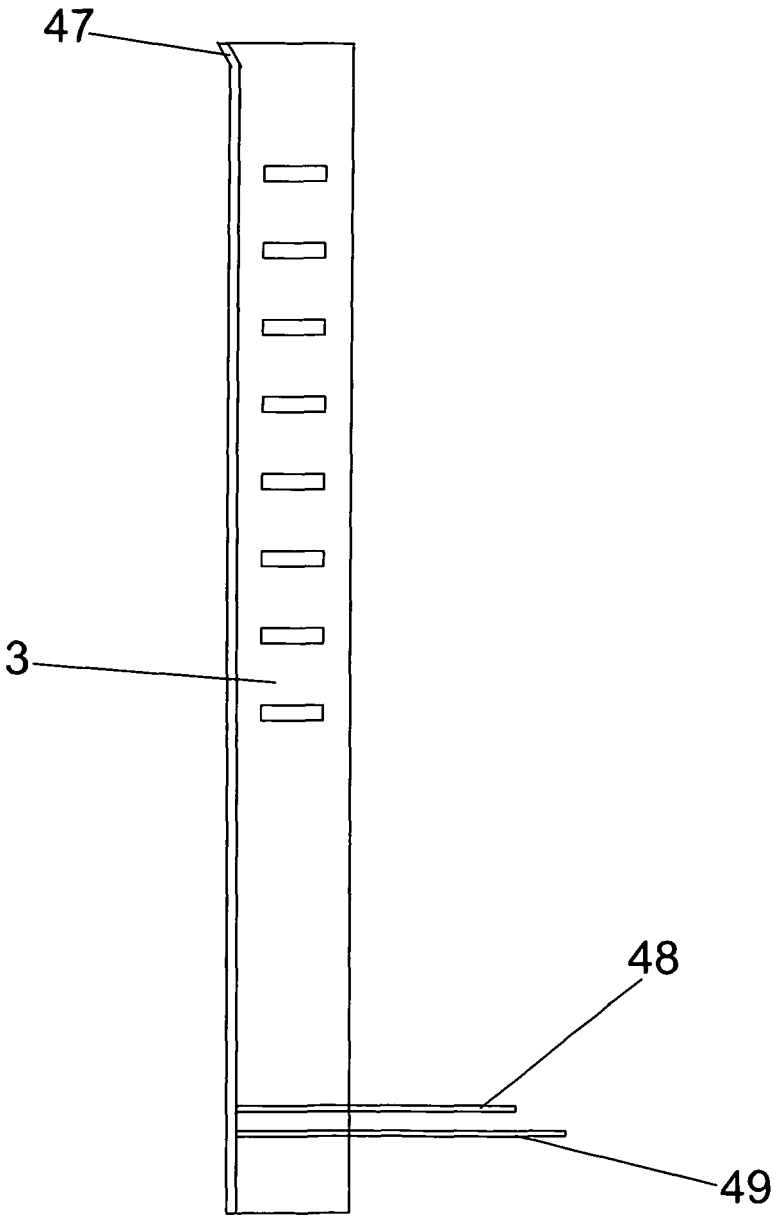
Figure 63:
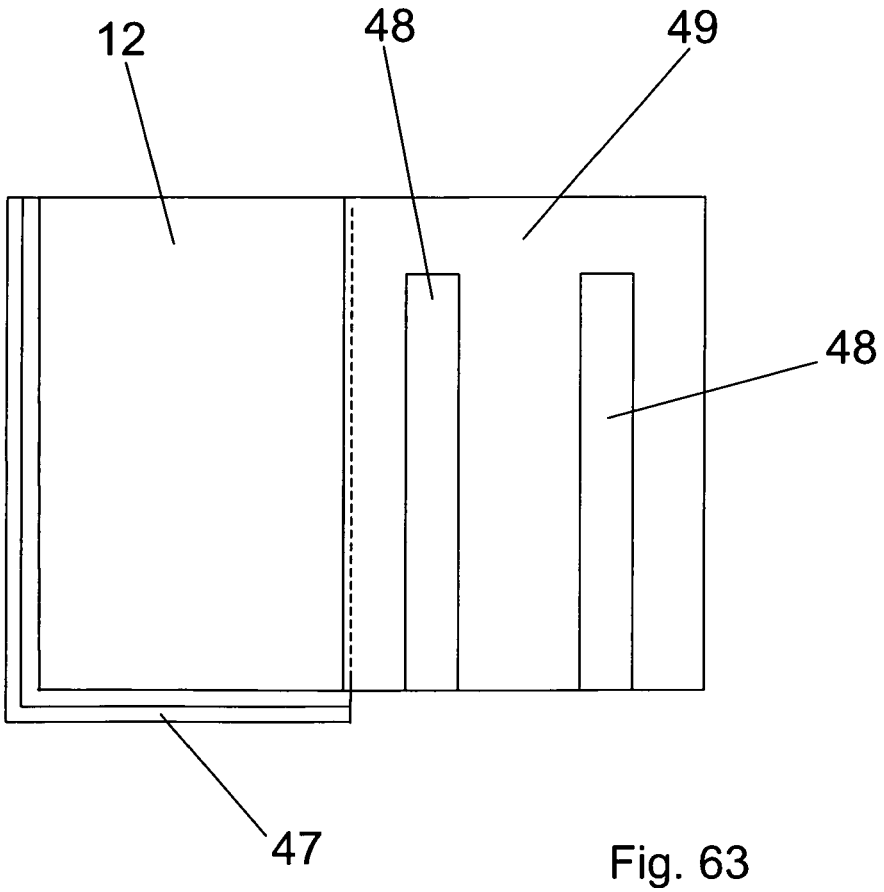

FIGS. 60 to 63 show a further embodiment for the retention of the pallets 20 having support spars 3 comprising a base plate 12, wherein FIG. 60 shows a perspective depiction of support spar 3 with pallet 20, FIG. 61 shows a front view of the support spar 3, FIG. 62 shows a side view of the support spar 3, and FIG. 63 shows a plan view of the support spar 3, with reference being made to the respective parts of the description for the features addressed in the preceding embodiments so as to avoid repetition. As can be seen from FIGS. 60 to 63, the support spar 3 comprises a pallet receiving element 46, into which the pallet 20 can be inserted for retention. The pallet receiving element 46 preferably comprises a pallet receiving element upper part 48, preferably two or more pallet receiving element upper parts 48, and a pallet receiving element lower part 49, between which the pallet can be inserted. Both pallet receiving element upper parts 48 are preferably arranged at a distance adapted to the width of the loading plank so that a loading plank 20*a* of the pallet 20 can be positioned between the pallet receiving element upper parts 48 supported on a loading plank bearer 20*b*.

Figure 64:
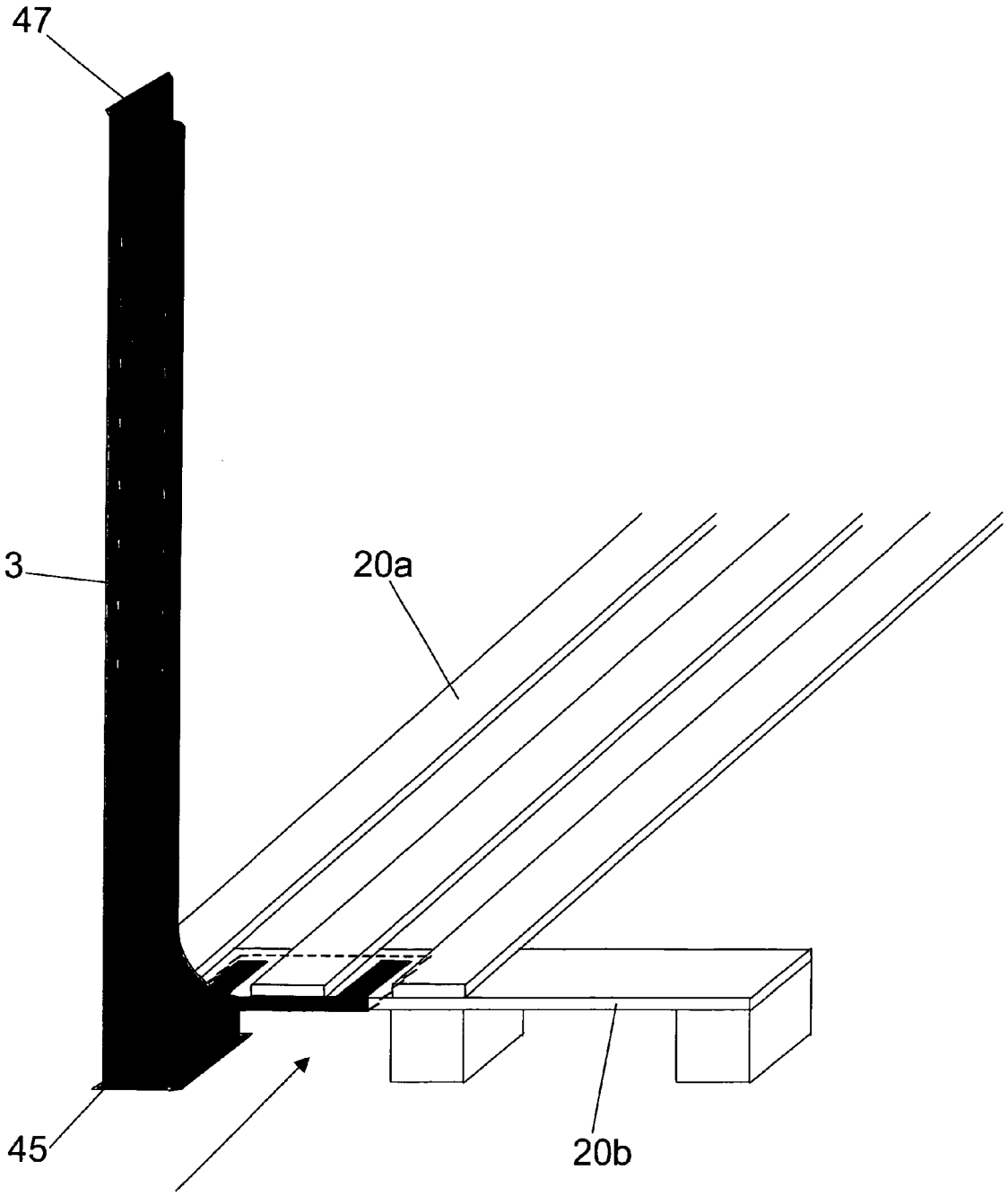
Figure 65:
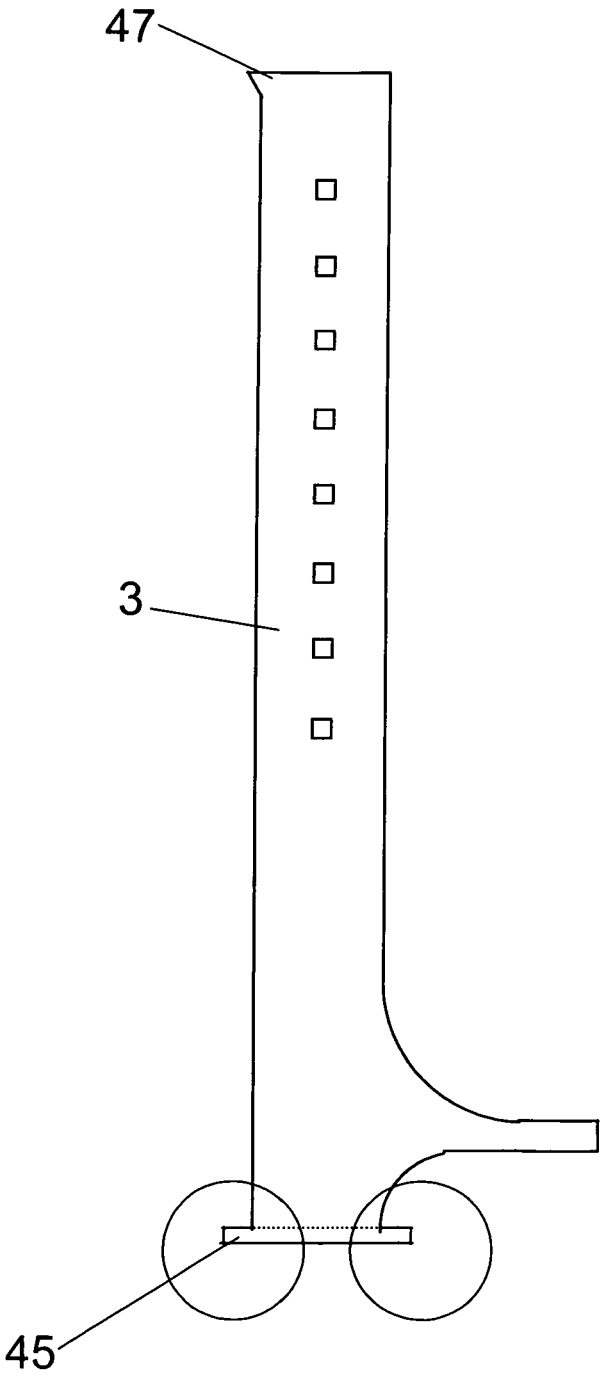
Figure 66:
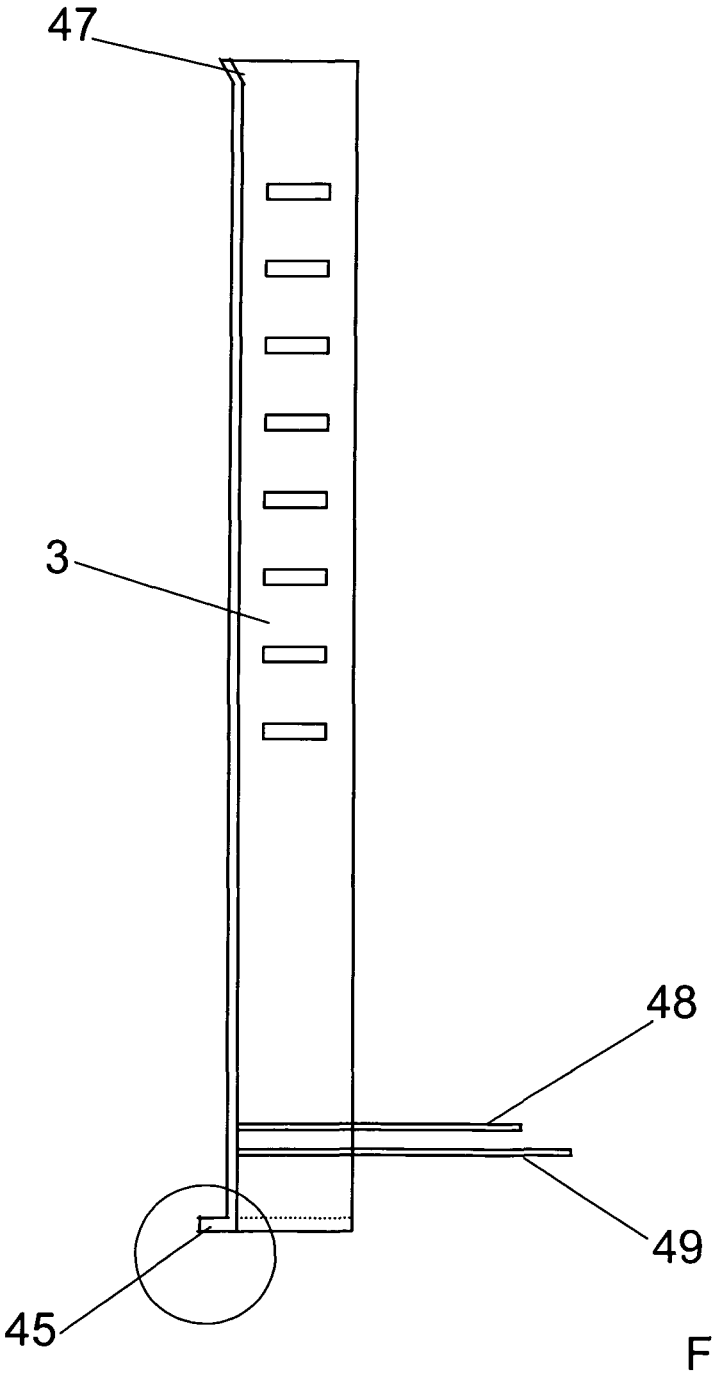
Figure 67:
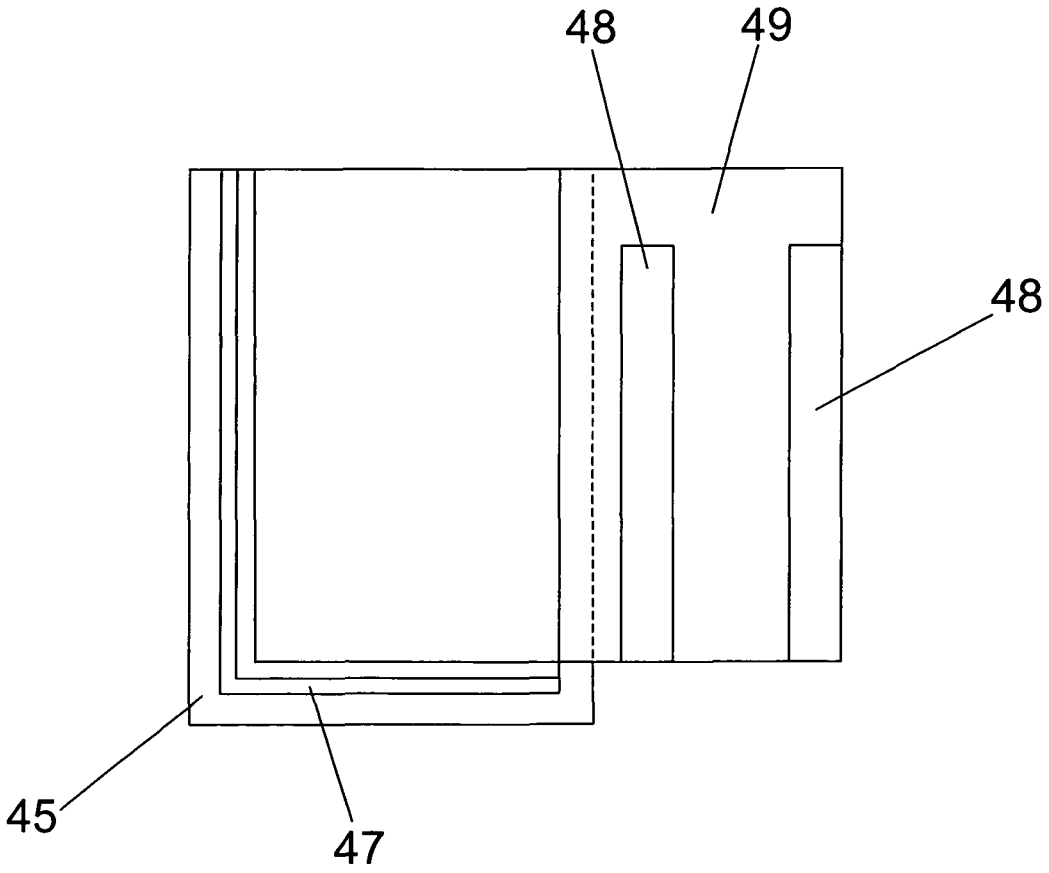

FIGS. 64 to 67 show a further embodiment for the retention of the pallets 20 having support spars 3 comprising a stand support 45 and no base plate, wherein FIG. 64 shows a perspective depiction of the support spar 3 with the pallet 20, FIG. 65 shows a front view of the support spar 3, FIG. 66 shows a side view of the support spar 3, and FIG. 67 shows a plan view of the support spar 3, with reference being made to the respective parts of the description for the features addressed in the preceding embodiments so as to avoid repetition.

Figure 68:
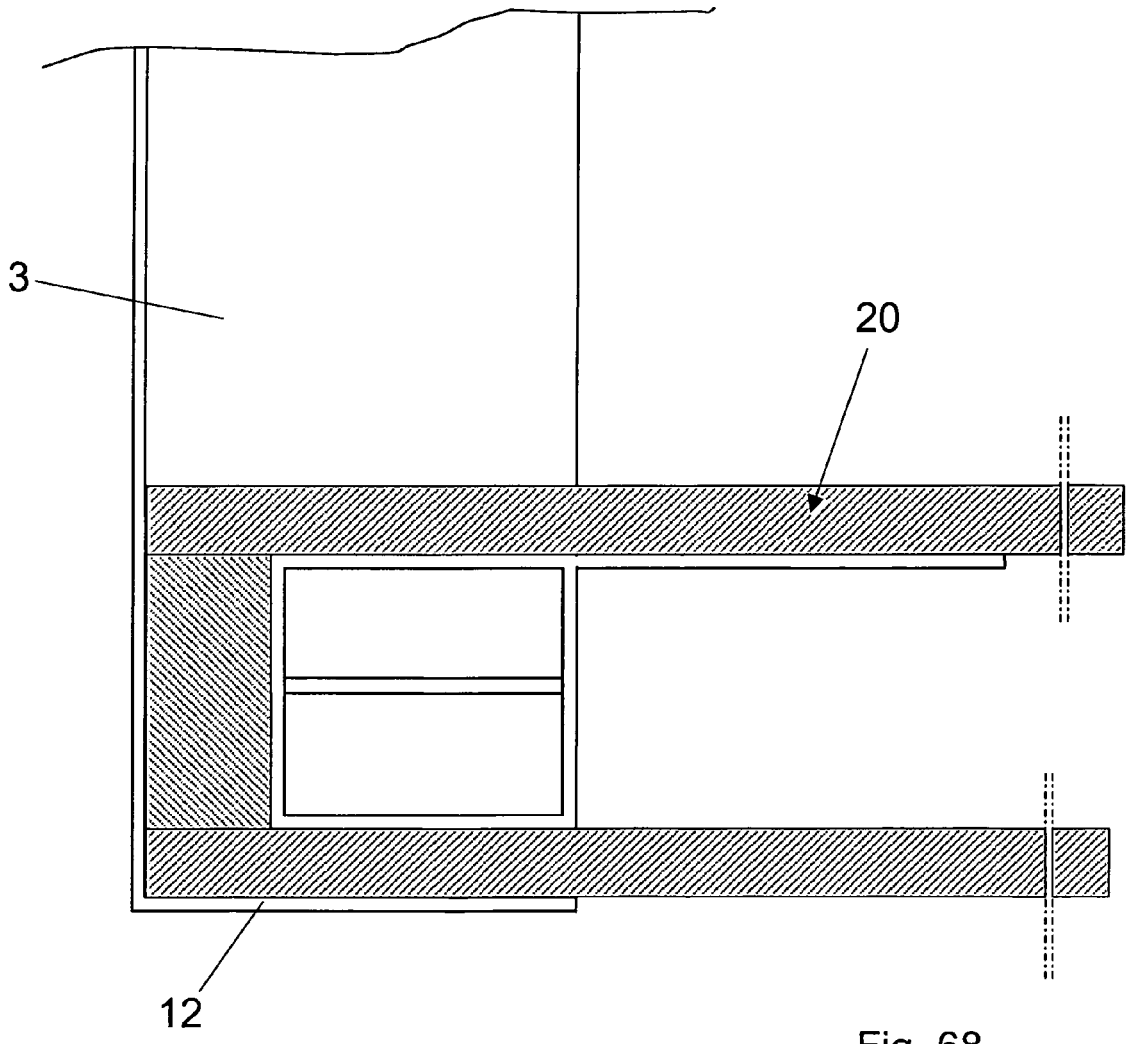
Figure 69:
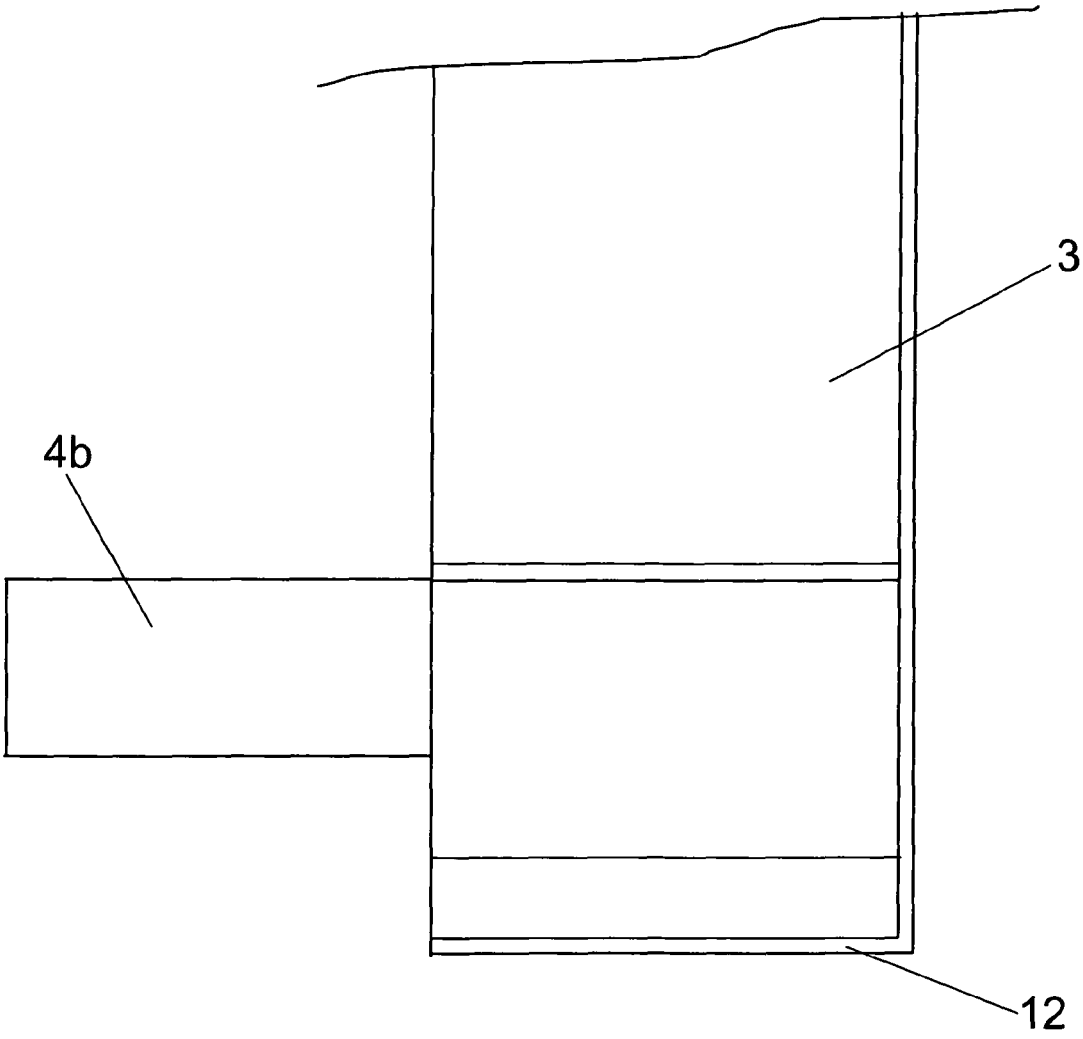
Figure 70:
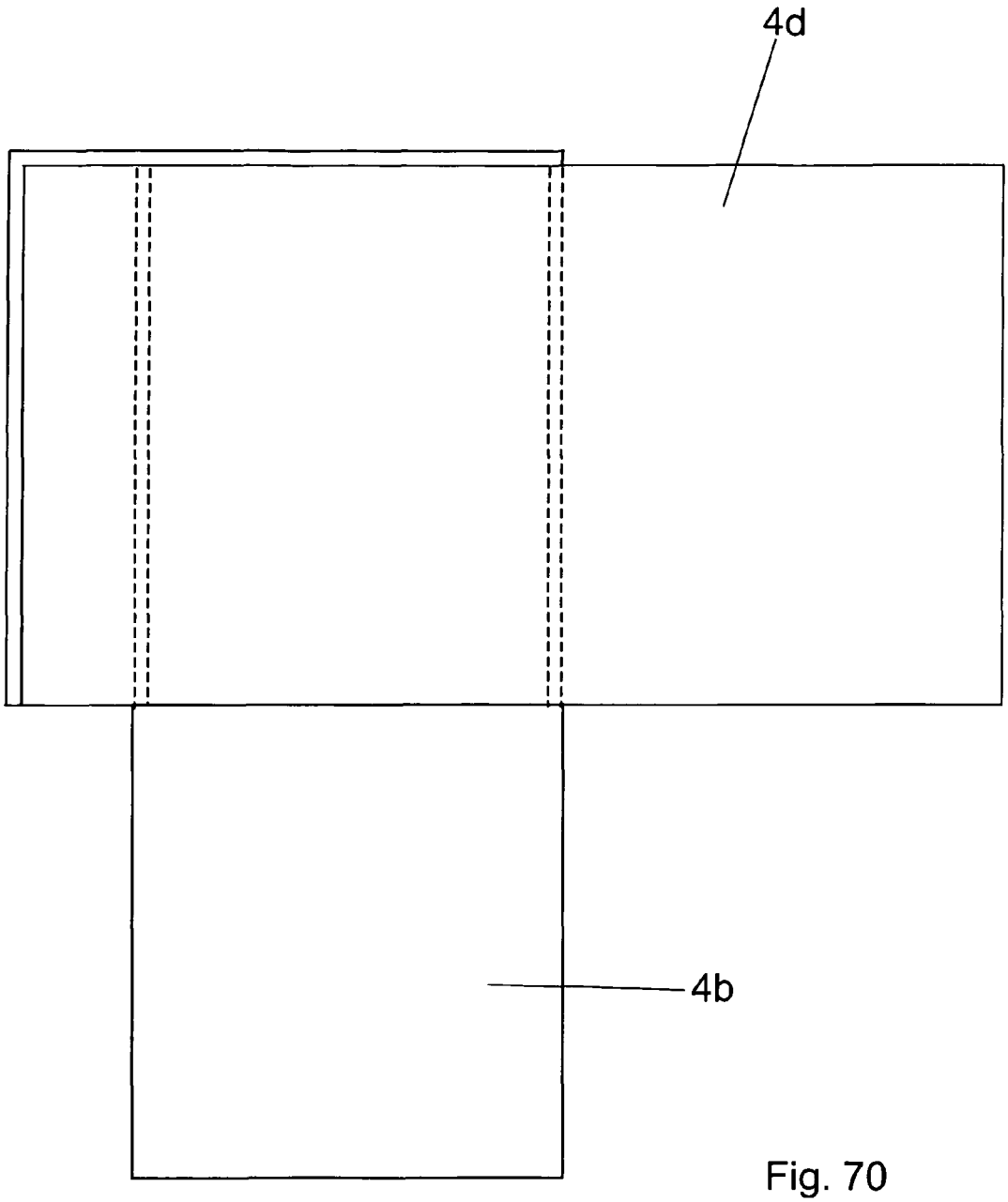

FIGS. 68 to 70 show a further embodiment of a support spar 3 comprising a base plate 12 which is not adapted to the dimensions of Euro pallets, but rather the dimensions of US pallets, wherein FIG. 68 shows a front view of said support spar 3 with a pallet, FIG. 69 shows a side view of the support spar 3, and FIG. 70 shows a plan view of the support spar 3, with reference being made to the respective parts of the description for the features addressed in the preceding embodiments so as to avoid repetition.

Figure 71:
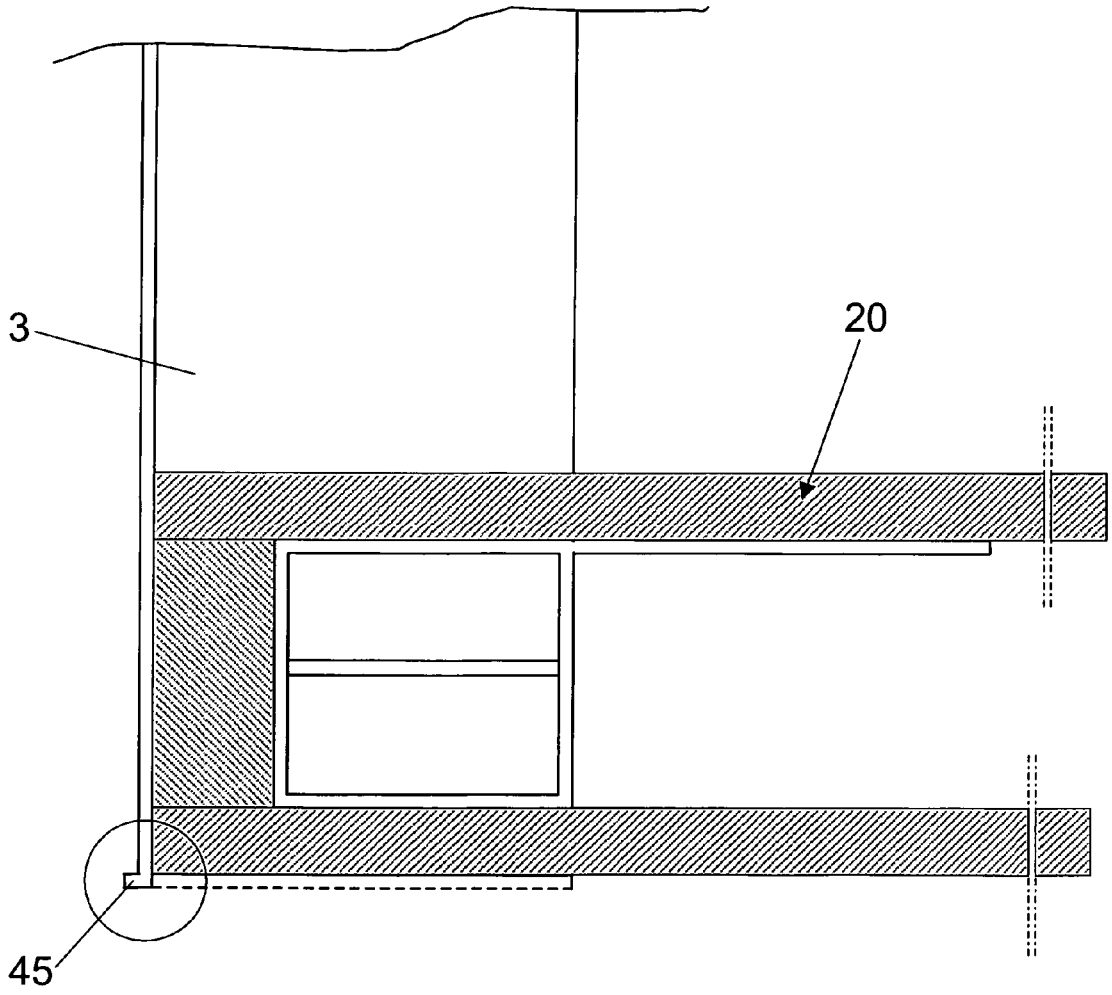
Figure 72:
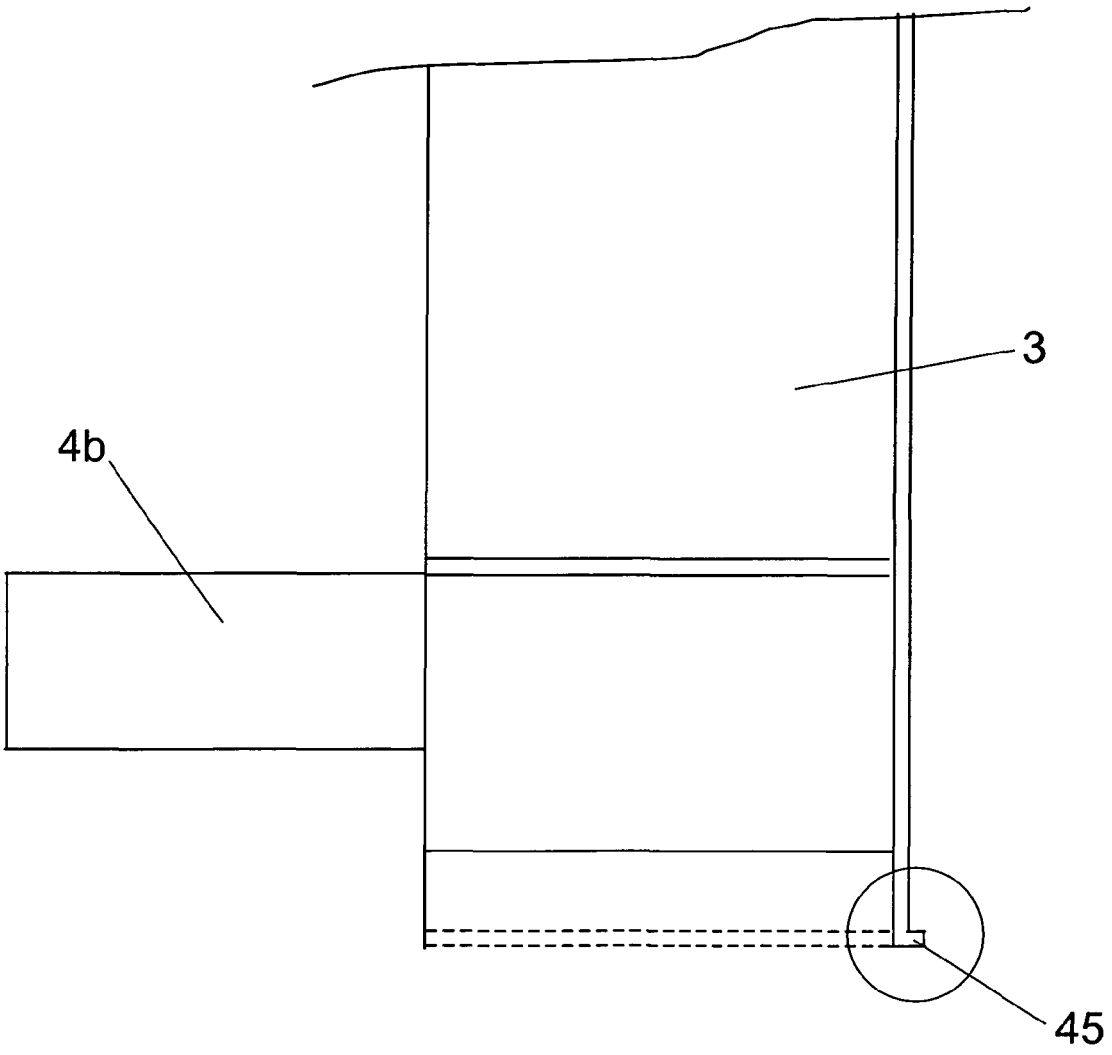
Figure 73:
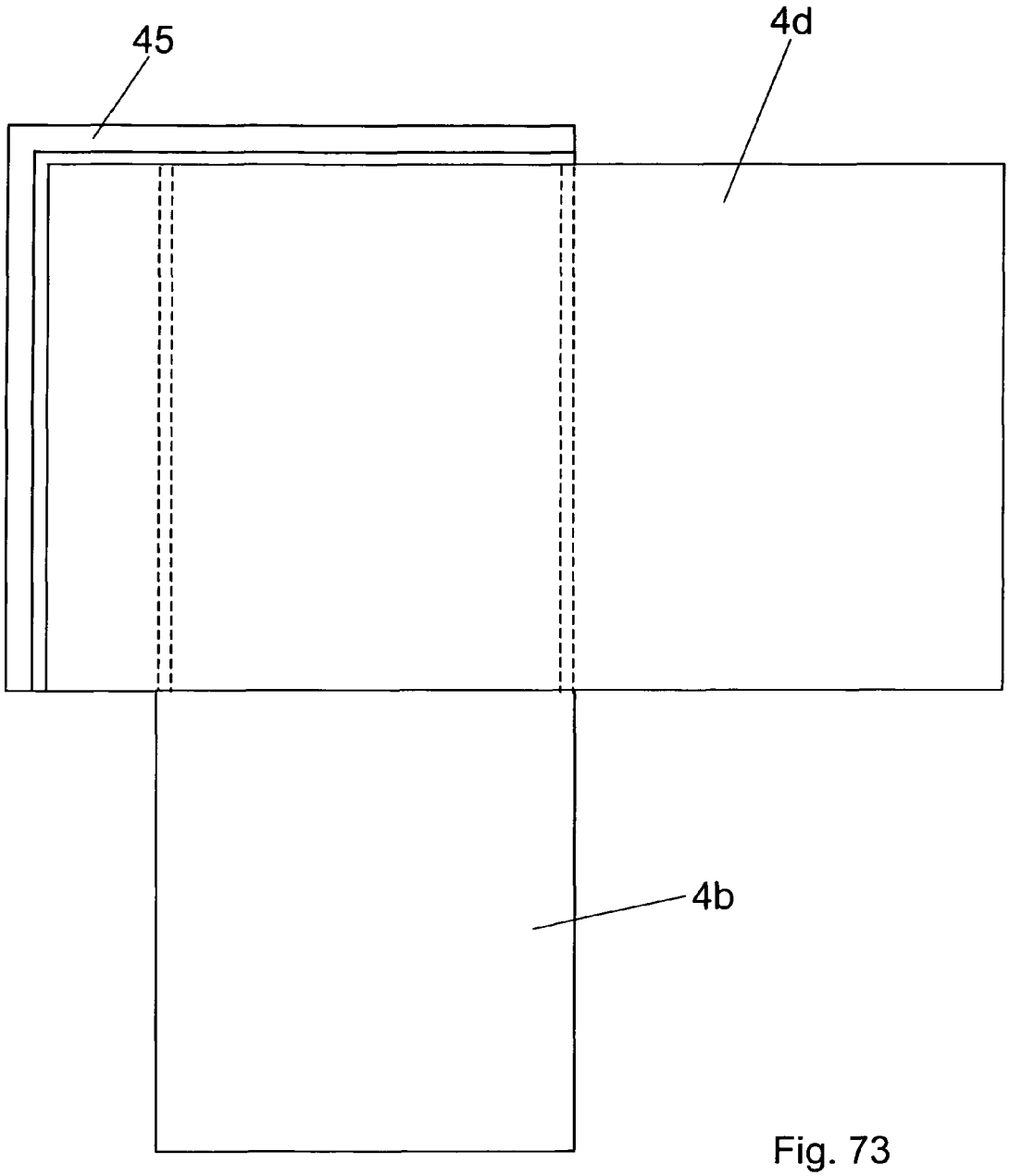

FIGS. 71 to 73 show a further embodiment of a support spar 3 without a base plate which is not adapted to the dimensions of Euro pallets, but rather the dimensions of US pallets, wherein FIG. 71 shows a front view of said support spar 3 with a pallet, FIG. 72 shows a side view of the support spar 3, and FIG. 73 shows a plan view of the support spar 3, with reference being made to the respective parts of the description for the features addressed in the preceding embodiments so as to avoid repetition.

LIST OF REFERENCE NUMERALS

1 auxiliary transport unit
3 support spar
3*a* inner surface of support spar
4 connecting device
4*a* boundary surface of connecting device
4*b* first horizontal support surface
4*c* arched support surface
4*d* second horizontal support surface
5, 5*a* retaining device
10, 10*a* first connecting element
11 recess
12 base plate
13, 13*a* second connecting element
14 retaining device shaft
15 strut
16, 16*a* retaining device
17, 17*a* retaining device support surface
18 insertion block
19 auxiliary lifting device
20 first pallet
20*a* loading plank
20*b* loading plank bearer
21 first pallet loading deck
22 spacer block
23 deckboard
24 notch
25 second pallet
26 tensioning means
27 hinge
28 bearing aid
29 connecting element
30 slider
31 support spar guide
32 insert, metal tube
32*a* insert, metal rod
32*b* insert, edged metal sheet
32*c* insert, deep-drawn steel sheet
33, 33*a* support spar connecting device
34 support spar connecting part receiving element
35*a* first connecting part receiving element
35*b* second connecting part receiving element
35 support spar connecting device connecting part
35*a* first connecting part
35*b* second connecting part
36 loading surface connecting element
37 loading surface
38 lifting means
39 longitudinal notch
40 longitudinal opening
41 connecting part
42 recess
43 supporting part
44 end region
45 stand support
46 pallet receiving element
47 edge section
48 pallet receiving element upper part
49 pallet receiving element lower part

The invention claimed is:

1. An auxiliary transport unit for pallets, wherein the pallets exhibit a loading deck aligned substantially horizontal during transport, comprising:

a supporting device extending substantially vertical during transport, a connecting device which connects said supporting device to at least one first, lower pallet, and a retaining device which is connected to said supporting device and which is provided to hold at least one second pallet at a vertical distance from said at least one first pallet; and at least one support spar extending substantially vertical during transport, wherein the at least one support spar exhibits a transverse section, the resisting torque of which is at a predetermined ratio to two bending axes arranged at right angles to each other, wherein the resisting torque ratio is preferably between 2 and 0.5, further preferably between 1.5 and 0.75, particularly preferably between 1.1 and 0.9.

2. An auxiliary transport unit for pallets, wherein the pallets exhibit a loading deck aligned substantially horizontal during transport, comprising;

a supporting device extending substantially vertical during transport, and including an inner surface;

a connecting device which connects said supporting device to at least one first, lower pallet, said connecting device including an end having a boundary surface, wherein said boundary surface is substantially parallel to said inner surface of said supporting device; and a retaining device connected to said supporting device and provided to hold at least one second pallet at a vertical distance from said at least one first pallet, wherein the boundary surface of the connecting device is spaced at a designated distance from the inner surface of the supporting device, wherein said designated distance between the boundary surface and the inner surface is calculated from a predetermined factor for a nominal dimension of the first pallet or at a predetermined allowance for said nominal dimension.

3. An auxiliary transport unit for pallets, wherein the pallets exhibit a loading deck aligned substantially horizontal during transport, comprising:

a supporting device extending substantially vertical during transport, a connecting device which connects said supporting device to at least one first, lower pallet, and a retaining device which is connected to said supporting device and which is provided to hold at least one second pallet at a vertical distance from said at least one first pallet; and an insertion block, wherein the insertion block is at least intermittently connected to a supporting device of an auxiliary transport unit.

4. An auxiliary transport unit for pallets, wherein the pallets exhibit a loading deck aligned substantially horizontal during transport, comprising:

a supporting device extending substantially vertical during transport, a connecting device which connects said supporting device to at least one first, lower pallet, wherein the connecting device comprises two rod-shaped horizontal support surfaces;

a retaining device which is connected to said supporting device and which is provided to hold at least one second pallet at a vertical distance from said at least one first pallet; and wherein the connecting device further comprises an arched horizontal support surface designed and disposed to connect two ends of the two rod-shaped horizontal support surfaces.

5. The auxiliary transport unit according to claim 4, wherein the arched horizontal support surface is of chamfered configuration.

6. An auxiliary transport unit for pallets, wherein the pallets exhibit a loading deck aligned substantially horizontal during transport, comprising:

a supporting device extending substantially vertical during transport, a connecting device which connects said supporting device to at least one first, lower pallet, said connecting device including an inner end that is spaced from an inner surface of said supporting device, wherein said inner end is substantially parallel to said inner surface of said supporting device, and a retaining device which is connected to said supporting device and which is provided to hold at least one second pallet at a vertical distance from said at least one first pallet; and at least one support spar extending substantially vertical during transport, wherein the at least one support spar comprises a base plate on its underside which is designed and disposed to receive the pallet.

7. An auxiliary transport unit for pallets, wherein the pallets exhibit a loading deck aligned substantially horizontal during transport comprising:

a supporting device extending substantially vertical during transport, a connecting device which connects said supporting device to at least one first, lower pallet, and a retaining device which is connected to said supporting device and which is provided to hold at least one second pallet at a vertical distance from said at least one first pallet; and at east one support spar having sidewalls and extending substantially vertical during transport, wherein the side walls of the at least one support spar flare outwardly and at an upper edge region.

8. An auxiliary transport unit for pallets, wherein the pallets exhibit a loading deck aligned substantially horizontal during transport, comprising:

a supporting device extending substantially vertical during transport, a connecting device which connects said supporting device to at least one first, lower pallet, and a retaining device which is connected to said supporting device and which is provided to hold at least one second pallet at a vertical distance from said at least one first pallet, the retaining device comprising at least one support body having a support surface aligned substantially horizontal during transport, wherein the support body is provided to support the second pallet during transport; and one of: a belt, a bar, a strap, a spring and a cable, is provided and extends substantially parallel to the loading deck between two support spars to stabilize the two support spars.

9. A method for using an apparatus according to claim 1, further including the steps:

a) connecting one, two or more support spars to said first pallet;

b) inserting said at least one second pallet into the retaining device; and c) preferably bracing at least one or more support spars with a tensioning means.

10. The method according to claim 9, further including the steps:

a1) providing a support spar connecting device; and b1) connecting one, two or more support spars to said support spar connecting device.

11. The method according to claim 10, wherein the support spar connecting device is frictionally connected to a loading surface during transport.

* * * * *